US009543667B2

(12) United States Patent
Kamor et al.

(10) Patent No.: US 9,543,667 B2
(45) Date of Patent: Jan. 10, 2017

(54) TERMINAL WITH STRAIN RELIEF

(71) Applicant: Leviton Manufacturing Co., Inc., Melville, NY (US)

(72) Inventors: Michael Kamor, North Massapequa, NY (US); Adam Kevelos, Coram, NY (US); Walter Ancipiuk, Staten Island, NY (US); Michael Williams, Morganton, NC (US); R. David Alderson, Morganton, NC (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 143 days.

(21) Appl. No.: 14/515,285

(22) Filed: Oct. 15, 2014

(65) Prior Publication Data

US 2015/0111440 A1 Apr. 23, 2015

Related U.S. Application Data

(60) Provisional application No. 61/893,697, filed on Oct. 21, 2013.

(51) Int. Cl.

| | |
|---|---|
| ***H01R 4/30*** | (2006.01) |
| ***H01R 4/34*** | (2006.01) |
| *H01R 24/78* | (2011.01) |

(52) U.S. Cl.

CPC ..... *H01R 4/305* (2013.01); *H01R 4/34* (2013.01); *H01R 24/78* (2013.01)

(58) Field of Classification Search

CPC ..... H01R 24/78; H01R 4/34; H01R 4/305
USPC ..... 439/801–815, 709, 539, 719, 723, 107; 175/51, 57

See application file for complete search history.

(56) References Cited

U.S. PATENT DOCUMENTS

| | | | |
|---|---|---|---|
| 1,994,880 | A | 3/1935 | Wallbillich |
| 2,015,858 | A | 10/1935 | Leviton |
| 2,082,994 | A | 6/1937 | Wallbillich |
| 2,163,722 | A | 6/1939 | Wallbillich |
| 2,175,098 | A | 10/1939 | Wertzheiser |
| 2,201,743 | A | 5/1940 | Petersen |
| 2,201,751 | A | 5/1940 | Wertzheiser |
| 2,205,871 | A | 6/1940 | Young |
| 2,249,471 | A | 7/1941 | Hamm et al. |
| 2,506,212 | A | 5/1950 | Grohsgal |
| 2,952,831 | A | 9/1960 | Ehrlich |
| 3,006,003 | A | 10/1961 | Johnson, Jr. |

(Continued)

FOREIGN PATENT DOCUMENTS

| | | |
|---|---|---|
| DE | 2627313 A1 | 1/1977 |
| DE | 4033074 A1 | 5/1991 |

OTHER PUBLICATIONS

PCT International Search Report and Written Opinion dated Mar. 21, 2011 for PCT/US2010/001612.

(Continued)

*Primary Examiner* — Edwin A. Leon
(74) *Attorney, Agent, or Firm* — Leviton Manufacturing Co., Inc.

(57) ABSTRACT

A wiring device terminal may include a contact having an aperture formed therethrough for receiving a fastener. One or more conductors may be engaged in the terminal directly between the fastener and the contact without requiring a pressure plate. When the fastener is tightened, the one or more conductors may be securingly held between the contact and the fastener.

33 Claims, 46 Drawing Sheets

(56) References Cited

U.S. PATENT DOCUMENTS

| | | | | |
|---|---|---|---|---|
| 3,010,126 | A | 11/1961 | Willcox | |
| 3,060,562 | A | 10/1962 | Fransson | |
| 3,431,546 | A | 3/1969 | Averill | |
| 3,439,315 | A | 4/1969 | Hamel et al. | |
| 3,713,071 | A | 1/1973 | Poliak et al. | |
| 3,718,894 | A * | 2/1973 | Schumacher | H01R 27/00 439/689 |
| 3,740,613 | A | 6/1973 | Strachan | |
| 3,793,607 | A | 2/1974 | Smith et al. | |
| 3,904,266 | A | 9/1975 | Fitzpatrick | |
| 3,944,314 | A | 3/1976 | Weitzman et al. | |
| 3,945,711 | A | 3/1976 | Hohorst et al. | |
| 4,060,305 | A | 11/1977 | Poliak et al. | |
| 4,099,826 | A | 7/1978 | Mazzeo et al. | |
| 4,146,289 | A | 3/1979 | Kirrish | |
| 4,172,628 | A | 10/1979 | Lingaraju | |
| 4,174,148 | A | 11/1979 | Obuch et al. | |
| 4,261,402 | A | 4/1981 | Stanaitis | |
| 4,836,793 | A * | 6/1989 | Munroe | H01R 13/655 439/106 |
| 4,900,259 | A | 2/1990 | Ludwig et al. | |
| 5,181,310 | A | 1/1993 | Josephson | |
| 5,266,039 | A | 11/1993 | Boyer et al. | |
| 5,470,183 | A | 11/1995 | Swick | |
| 5,658,108 | A | 8/1997 | Swick | |
| 5,692,930 | A | 12/1997 | Garver et al. | |
| 5,839,908 | A | 11/1998 | Bonilla et al. | |
| 5,866,844 | A | 2/1999 | Osterbrock et al. | |
| 5,975,925 | A * | 11/1999 | Tiberio, Jr. | H01R 13/648 439/107 |
| 6,082,942 | A | 7/2000 | Swick | |
| 6,174,177 | B1 | 1/2001 | Auclair | |
| 6,188,020 | B1 | 2/2001 | Osterbrock et al. | |
| 6,263,922 | B1 | 7/2001 | Kerner et al. | |
| 6,293,812 | B1 | 9/2001 | Ewer et al. | |
| 6,313,403 | B1 | 11/2001 | Livingston et al. | |
| 6,683,251 | B1 | 1/2004 | Brant et al. | |
| 6,743,029 | B1 | 6/2004 | Greene et al. | |
| 6,814,629 | B1 | 11/2004 | Donfrancesco et al. | |
| 6,861,189 | B1 | 3/2005 | Greene et al. | |
| 6,864,422 | B1 | 3/2005 | Dionne et al. | |
| 6,877,996 | B1 | 4/2005 | Franks, Jr. | |
| 6,878,876 | B2 | 4/2005 | Brant et al. | |
| 7,175,485 | B1 | 2/2007 | Alderson et al. | |
| 7,446,666 | B2 | 11/2008 | Fair et al. | |
| 7,589,639 | B2 | 9/2009 | Fair et al. | |
| 7,667,616 | B2 | 2/2010 | Fair et al. | |
| 7,806,736 | B2 | 10/2010 | Alderson et al. | |
| 7,817,060 | B2 | 10/2010 | Fair et al. | |
| 7,852,231 | B2 | 12/2010 | Fair et al. | |
| 8,115,591 | B2 | 2/2012 | Fair et al. | |
| 8,542,089 | B1 | 9/2013 | Fair et al. | |
| 2007/0046487 | A1 | 3/2007 | Fair et al. | |
| 2007/0046492 | A1 | 3/2007 | Fair et al. | |
| 2007/0047233 | A1 | 3/2007 | Wilson | |
| 2007/0047234 | A1 | 3/2007 | Wilson et al. | |
| 2007/0047235 | A1 | 3/2007 | Wilson | |
| 2007/0047236 | A1 | 3/2007 | Wilson et al. | |
| 2010/0003865 | A1 | 1/2010 | Alderson et al. | |
| 2010/0304596 | A1 | 12/2010 | Ilkhanov | |
| 2011/0093094 | A1 | 4/2011 | Goyal et al. | |

OTHER PUBLICATIONS

PCT International Preliminary Report on Patentability dated Dec. 4, 2012 for PCT/US2010/001612.

* cited by examiner

TERMINAL WITH STRAIN RELIEF

FIELD OF THE DISCLOSURE

The present disclosure relates generally to a wiring device terminal and, more particularly, relates to a wiring device terminal that does not require a pressure plate.

DESCRIPTION OF THE RELATED ART

A terminal is a component of a wiring device such as a receptacle, switch, ground fault circuit interrupter, lighting control, and the like. Wiring devices include terminals to secure electrical conductors to the wiring device, and wiring devices may include a ground terminal, load terminal, line terminal, and/or neutral terminal. Referring to FIG. 1, terminals typically include a contact 14, a pressure plate 16, and a fastener 2. The contact 14 and the pressure plate 16 typically each include a respective aperture 22, 20 formed therethrough that can receive the fastener 2. Conventional terminals are assembled so that the pressure plate 16 overlies the contact 14 with the fastener 2 passing through the apertures 20, 22. A conductor (not shown) may be stripped to expose a conductive layer; that is, the outer insulating material may be removed to expose the inner conductor. The stripped portion of the conductor may then be bent or wrapped around the fastener 2 in one of a plurality of termination techniques. The fastener 2 may be tightened to compress the exposed conductor between the pressure plate 16 and the contact 14. The pressure plate 16 applies relatively even pressure and securely holds the conductor. Alternatively, the fastener 2 may be tightened to compress the exposed conductor between the head of the fastener 2 and the pressure plate 16.

Terminals must be capable of securing or clamping the conductors to the terminations of the wiring device and must meet accepted tightening-torque and pullout-load performance standards as set forth, for example, by Underwriters Laboratories Inc. and the Federal Specification WC-596. In a conventional terminal, the pressure plate 16 provides pressure in the form of a clamping load, pullout-load, holding force or clamping force to one or more conductors positioned beneath the pressure plate 16. The conductors are captivated or held between the pressure plate 16 and the contact 14. When the fastener is tightened, the pressure plate 16 applies pressure on the conductor and securely holds the conductor.

It would desirable to have a terminal that eliminates the need of a pressure plate, while meeting accepted industry performance standards. A terminal without a pressure plate would decrease the number of unique parts required for manufacturing wiring devices, which would reduce manufacturing complexity and costs, including inventory costs, labor costs, stamping costs, molding costs, etc.

BRIEF DESCRIPTION OF THE SEVERAL VIEWS OF THE DRAWING(S)

One or more aspects of the present invention are particularly pointed out and distinctly claimed as examples in the claims at the conclusion of the specification. The foregoing and other objects, features, and advantages of the present invention may be more readily understood by one skilled in the art with reference being had to the following detailed description of several embodiments thereof, taken in conjunction with the accompanying drawings wherein like elements are designated by identical reference numerals throughout the several views, and in which:

DETAILED DESCRIPTION

Figure 1:
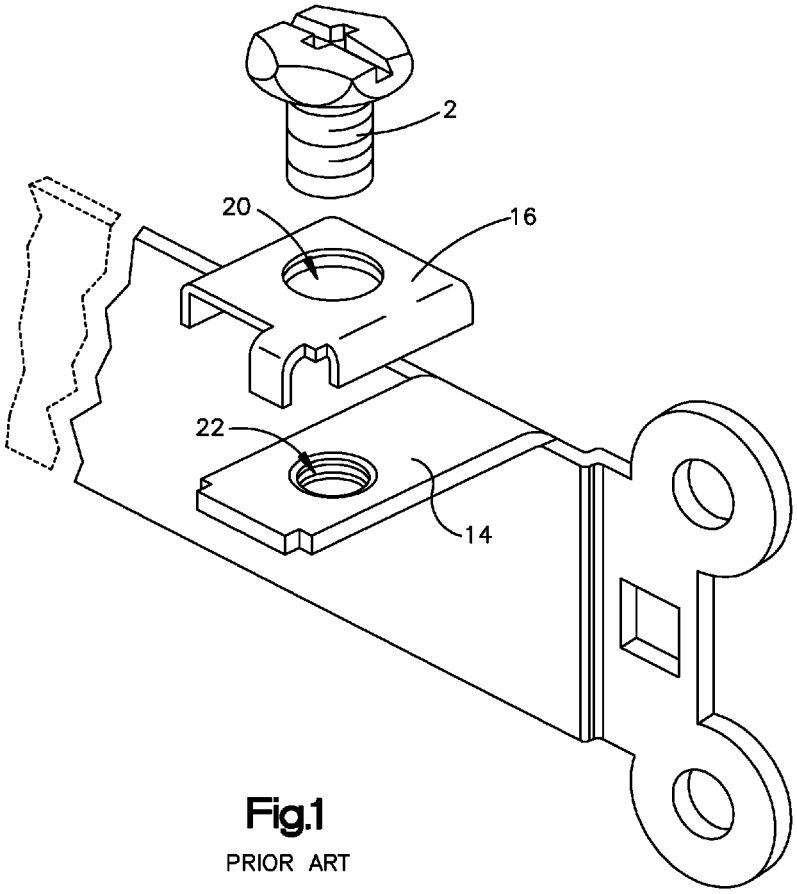
Fig.1 PRIOR ART
FIG. 1 is a perspective view of a prior art terminal including a pressure plate.

The present disclosure describes a system and method for a wiring device having one or more terminals that do not require a pressure plate. Embodiments will be described below while referencing the accompanying figures. The accompanying figures are merely examples and are not intended to limit the scope of the present disclosure. Some of the embodiments will be described in different types of wiring devices, such as ground fault circuit interrupters, receptacles, etc. However, it will be understood by one of ordinary skill in the art that any of the embodiments described may be used in any type of wiring device. Examples of wiring devices include, but are not limited to electrical receptacles, switches, wiring boxes, ground fault circuit interrupters, are fault circuit interrupters, resettable circuit interrupting device, immersion detection circuit interrupter, appliance leakage circuit breaker, latching interrupting device, contactor, lighting control, occupancy sensor, etc. Furthermore, the embodiments will be described with respect to different types of terminals, such as ground terminals, load terminals, line terminals, and neutral terminals. However, it will be understood by one of ordinary skill in the art that any of the embodiments described may be used in any type of terminal in a wiring device.

In FIGS. 2A-D, an exemplary embodiment of a mounting strap 5 is shown. The mounting strap 5 enables a wiring device 30 to be secured to an electrical box (not shown) and provides structural integrity and overall device grounding, such as by grounding the mounting strap to earth ground. The mounting strap 5 may also be known as a conductive strap, a frame or a yoke in the electrical industry. The mounting strap 5 may be composed of any suitable metals, alloys, or other electrically conductive materials, such as but not limited to, aluminum, carbon, copper, gold, iron, manganese, nickel, palladium, platinum, steel, tin, tungsten, zinc, etc.

The mounting strap 5 may include a body 6 and a contact 10, wherein the contact 10 may be preferably integral with the mounting strap 5. The contact 10 may extend outward from the mounting strap 5 in a perpendicular direction. In the embodiment shown in FIGS. 2A-D, the contact 10 is offset from the body 6 and extends from the back of the mounting strap 5; however, in other embodiments the contact may be aligned with the body and/or may extend from the side of the mounting strap, front of the mounting strap, etc.

The contact 10 may be generally rectangular or square. The contact 10 may include a first side 12, a second side 14, a third side 16, a fourth side 18, a top substantially planar surface 11, and a bottom surface 19. The first side 12 couples the contact 10 to the mounting strap 5. In addition, the contact 10 may include an aperture 13 formed therethrough that is configured to receive a fastener 34. In some embodiments, the aperture may be threaded.

Figure 2B:
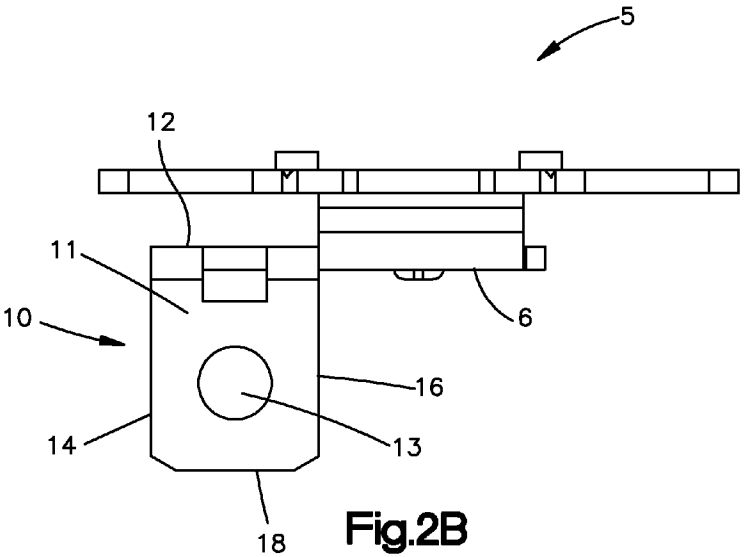
FIG. 2B is a top view of the mounting strap of FIG. 2A.
Figure 2A:
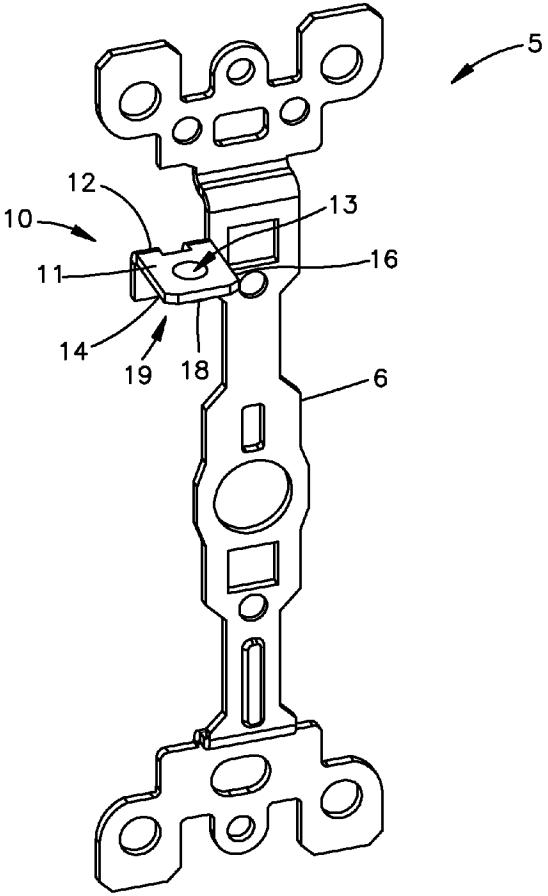
FIG. 2A is a perspective view of an exemplary embodiment of a mounting strap including a contact.
Figure 2C:
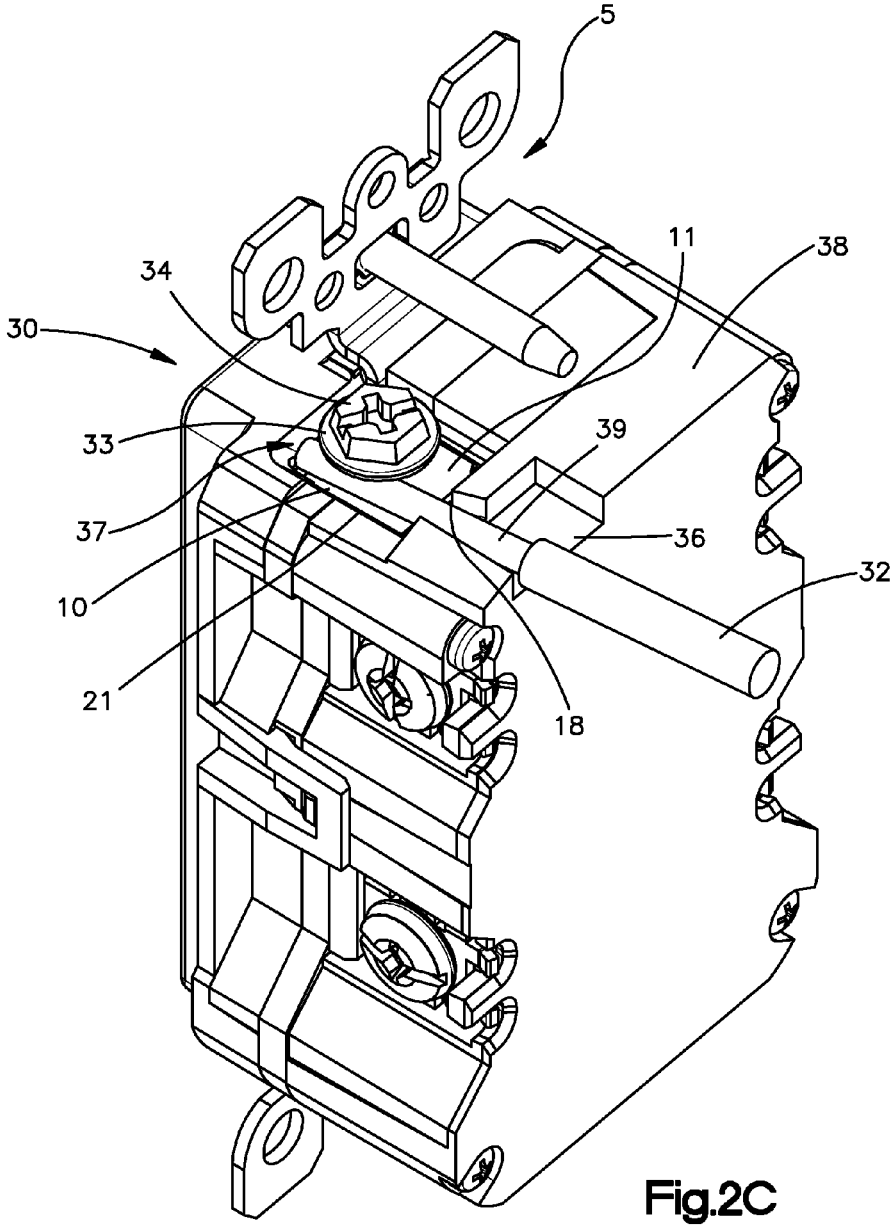
FIG. 2C is a perspective view of an exemplary embodiment of a wiring device including the mounting strap of FIGS. 2A-B.
Figure 2D:
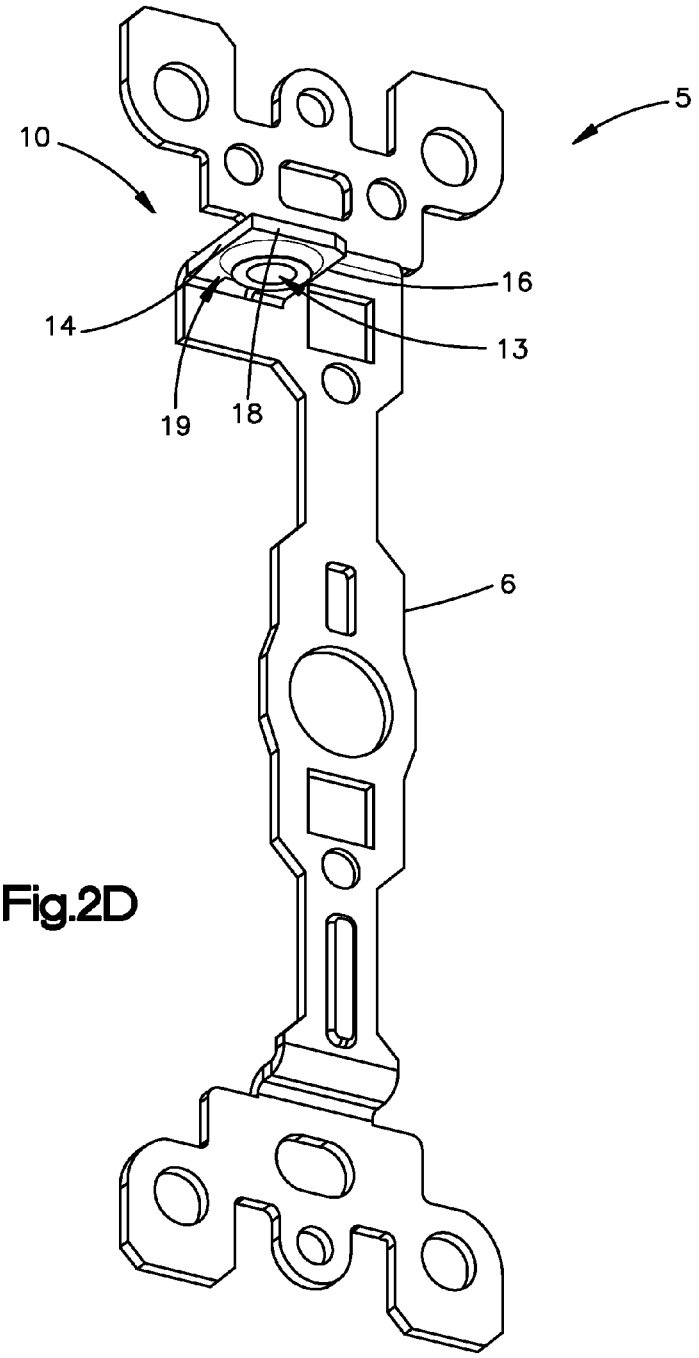
FIG. 2D is a bottom perspective view of the mounting strap of FIG. 2A.

In use, as shown in FIG. 2C, the mounting strap 5 may be inserted into a wiring device 30. The wiring device 30 may include a body 38 and a ground terminal 37, in which the ground terminal 37 may include the contact 10 of the mounting strap 5 and the fastener 34. When the mounting strap 5 is inserted into the wiring device 30, the fourth side 18 of the contact 10 may be exposed. The fastener 34 may preferably include an enlarged or washer-style head 33 (see also FIGS. 28A-C), and may pass through the aperture 13 formed in the contact 10. The body 38 may include an opening 36 for a conductor 32, and the conductor 32 may be positioned in the terminal 37. More specifically, a bare portion 39 of the conductor 32 may be placed between the substantially planar surface 11 of the contact 10 and the head 33 of the fastener 34. When the fastener 34 is tightened in the terminal, the conductor 32 is engaged directly between the fastener 34 and the contact 10. A pressure plate is not required. As discussed in more detail in the exemplary embodiments, the contact may include various additional features that help engage and/or provide additional strain relief for the conductor connected to the terminal.

As described, the body 38 may include an opening 36. The opening 36 helps position the conductor 32 in the ground terminal 37. It will be understood by one of ordinary skill in the art that a wire device body shown in the embodiments of this disclosure may include similar openings, such as opening 36, to assist in positioning the conductor in the terminal.

Figure 28B:
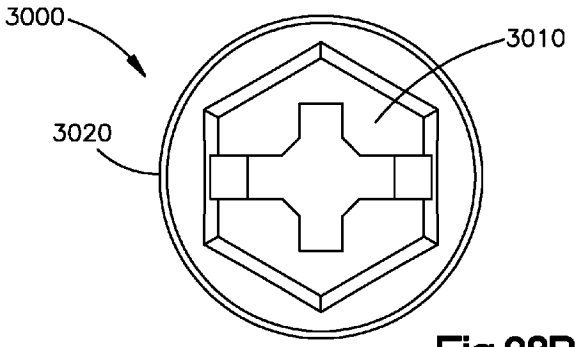
FIG. 28B is a top view of the fastener of FIG. 28A.
Figure 28C:
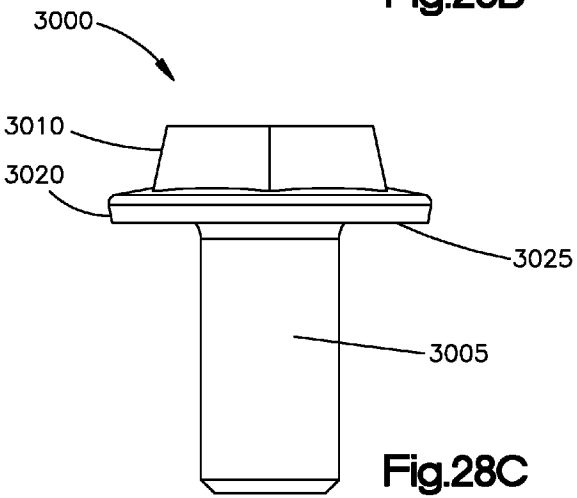
FIG. 28C is a side view of the fastener of FIGS. 28A-B.
Figure 28A:
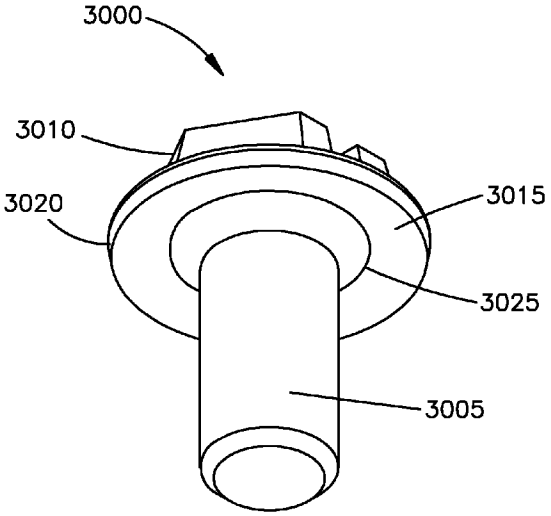
FIG. 28A is a perspective view of a fastener.

As shown in FIGS. 28A-C, a fastener 3000 may include a fastener head 3010 and a fastener body 3005. The fastener body 3005 may be adapted and configured to pass through an aperture (not shown) in a contact. The fastener head 3010 may include a bottom surface 3015 that is adapted and configured for selectively and securely engaging a conductor (not shown). The bottom surface 3015 may also include an undercut or concave shaped region 3025, in which the undercut or concave region 3025 may push a respective conductor inward towards the fastener body 3005 when the fastener 3000 is tightened in the terminal. The undercut or concave region 3025 increases the engagement level of the conductor in the terminal between the fastener head 3010 and the contact. In some embodiments, the fastener head may include a bottom surface having serrations (not shown) to increase the engagement level of the conductor(s) that are compressed between the fastener head and the contact. In some embodiments, the fastener head 3010 may include a washer 3020 that may be configured to push down on the conductor that is inserted in the respective terminal. In the embodiment shown in FIGS. 28A-C, the washer is integral with the fastener head. However, it will be understood by one of ordinary skill in the art that in other embodiments, the washer may be separate from the fastener head. In addition, the washer may include a bottom surface with an undercut region and/or serrations. In use, in some embodiments, the fastener may be positioned at an angle in the terminal to increase the engagement level of the conductor between the head of the fastener and the contact. In the embodiments disclosed, the fastener may be any fastener now or hereafter known in the art including, but not limited to, a serrated head fastener, a washer head fastener, a conventional screw, a washer head screw, a serration screw, etc.

Figure 3B:
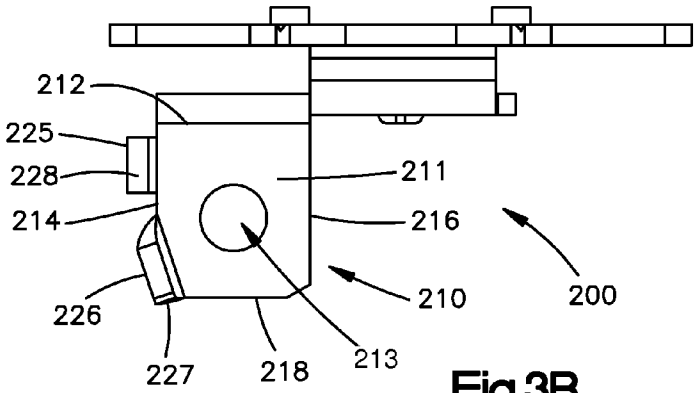
FIG. 3B is a top view of the mounting strap of FIG. 3A.
Figure 3A:
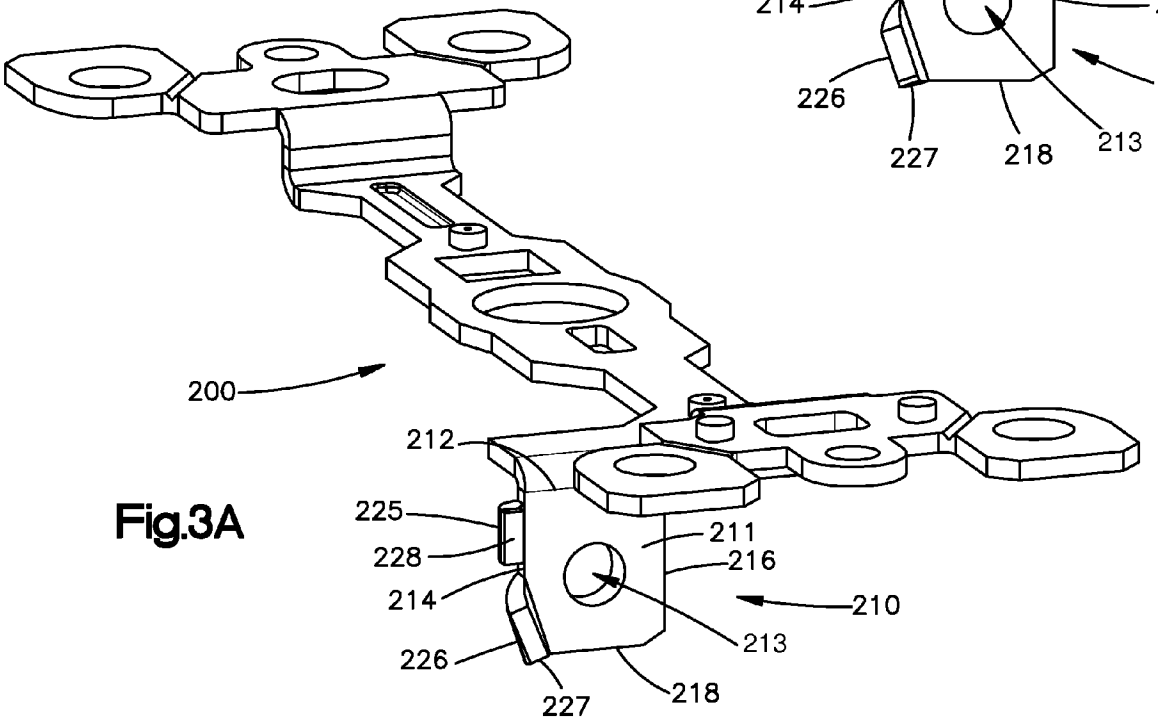
FIG. 3A is a perspective view of another exemplary embodiment of a mounting strap including a contact.
Figure 3C:
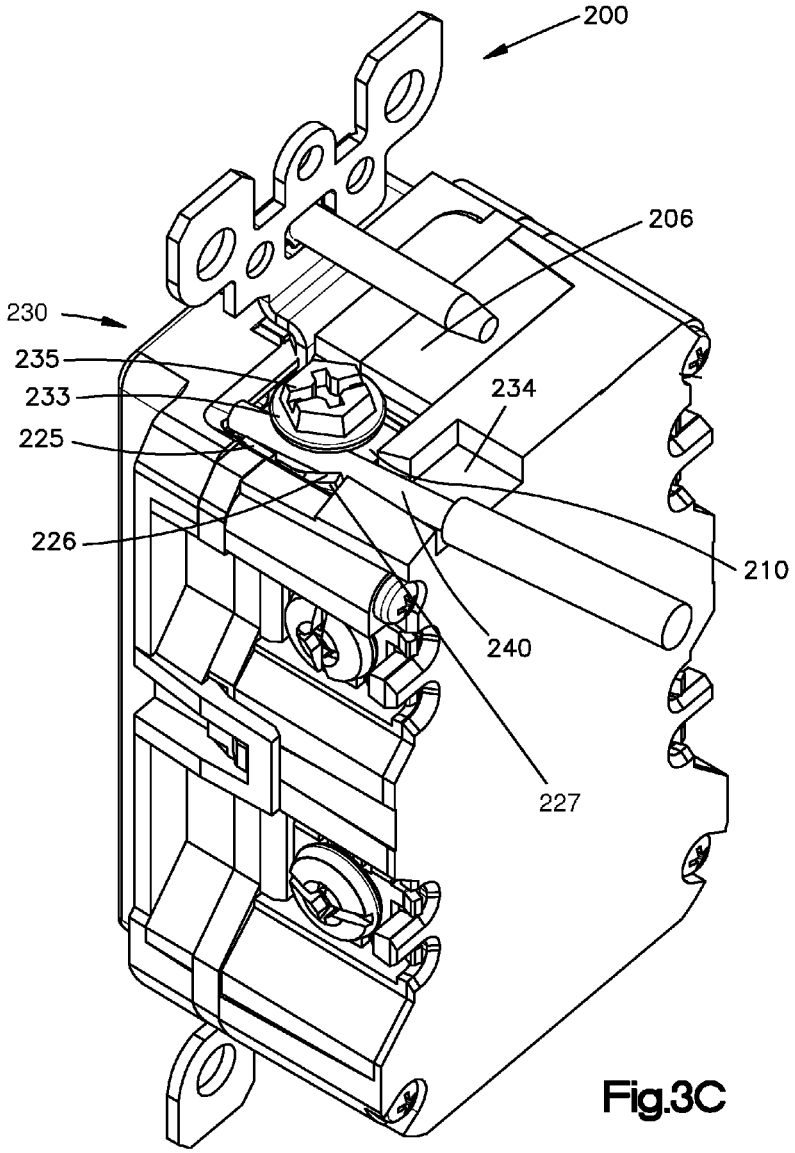
FIG. 3C is a perspective view of an exemplary embodiment of a wiring device having the mounting strap of FIGS. 3A-B.

Referring to FIGS. 3A-C, an alternate exemplary embodiment of a mounting strap 200 is shown. The mounting strap 200 is substantially similar to the mounting strap 5 illustrated in FIGS. 2A-D and discussed above, but for the following additional features. The contact 210 of the mounting strap 200 may include a first tab 225 and a second tab 226. More specifically, the first tab 225 may be positioned on a second side 214 of the contact 210 near the corner of the first side 212 and the second side 214. The first tab 225 may extend in a direction that is generally perpendicular to a substantially planar surface 211 of the contact 210. A top surface 228 of the first tab 225 is preferably substantially flat.

The second tab 226 may be positioned on the contact 210 between the second side 214 and the fourth side 218, forming a corner. Preferably, the second tab 226 may extend upwardly from the contact 210. The top surface of the second tab 226 preferably tapers to a point 227. As shown in this embodiment, the second tab 226 is tapered to the point 227; however, in other embodiments the top surface of the second tab may be substantially flat.

In use, as shown in FIG. 3C, the wiring device 230 includes the mounting strap 200, a ground terminal 237, and a body 206. The terminal 237 may include the contact 210 of the mounting strap 200 and a fastener 235. The fastener 235 may preferably include a washer head 233, and may pass through the aperture 213 formed in the contact 210. The body 206 may include an opening 234 for a bare portion of a conductor 240 to pass through, and the conductor 240 may be positioned in the terminal 237. More specifically, the conductor 240 may be positioned on the substantially planar surface 211 (see FIGS. 3A-B) of the contact 210 in between the first and second tabs 225, 226 and the aperture 213 formed therethrough. When the fastener 235 is tightened in the terminal, the conductor 240 is engaged directly between the washer head 233 and the contact 210. The friction between the conductor 240 and the washer head 233 provides connectivity of the conductor 240 in the terminal 237. The first tab 225 contacts a portion of the conductor 240 and pushes the conductor 240 towards the shank of the fastener that is positioned in the aperture 213, thereby positioning the conductor 240 underneath the washer head 233 when the fastener is being tightened, and increasing the engagement level of the conductor 240. The second tab 226 contacts another portion of the conductor 240, and absorbs or decreases the force that would otherwise be acting on the conductor to remove the conductor from the terminal. Thus, the second tab 226 provides strain relief when the conductor is bent and engaged in the terminal 237.

Figure 4B:
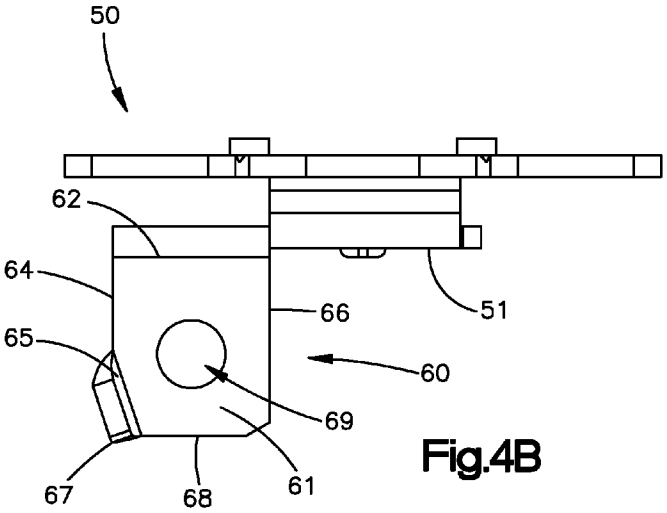
FIG. 4B is a top view of the mounting strap of FIG. 4A.
Figure 4A:
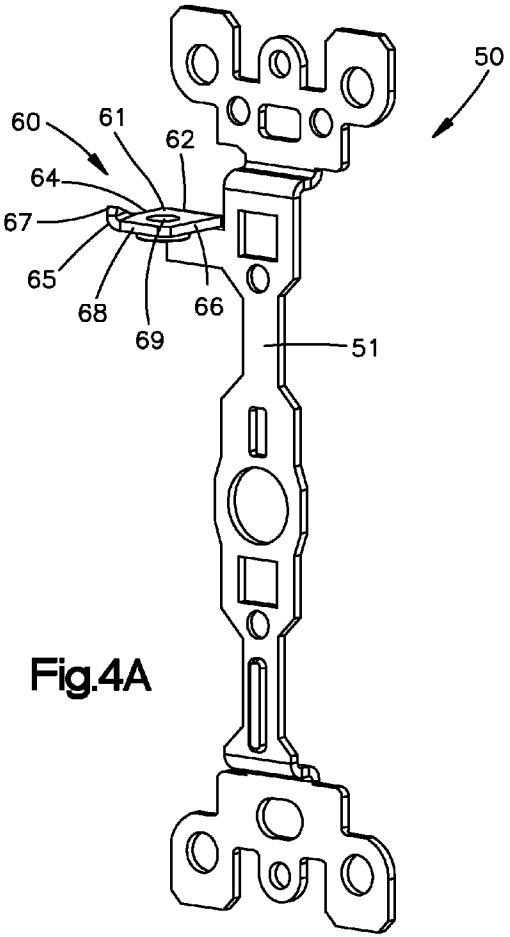
FIG. 4A is a perspective view of another exemplary embodiment of a mounting strap including a contact.

Referring to FIGS. 4A-B, an alternate exemplary embodiment of a mounting strap 50 is shown. The mounting strap 50 is substantially similar to the mounting strap 5 illustrated in FIGS. 2A-D and discussed above, but for the following additional features. A contact 60 may include a tab 65. The tab 65 is positioned between the second side 64 and the fourth side 68 of the contact 60, forming a corner. Preferably, the tab 65 may extend in an outward direction and at an angle from the substantially planar surface 61 of the contact 60. The top surface of the tab 65 preferably tapers to a point 67. In this embodiment, the tab 65 is tapered to the point 67 and angled outward from the substantially planar surface 61. However, in other embodiments, the tab may have a substantially flat top surface, and/or the tab may be generally perpendicular to the substantially planar surface of the contact instead of extending outward from the surface at an angle.

In use, the mounting strap 50 may be used in conjunction with a wiring device, such as but not limited to the wiring device 30 (see FIG. 2C). A fastener, such as but not limited to the fastener 3000 shown in FIGS. 28A-C, may pass through the aperture 69 formed in the contact 60 and be tightened in the terminal, and a conductor (not shown) may be engaged directly between the contact 60 and a head of the fastener. More specifically, with respect to the contact, the conductor may be positioned on the substantially planar surface 61 of the contact 60 between the aperture 69 formed therethrough and the second side 64. The tab 65 contacts the conductor, and absorbs or decreases the force that would otherwise be acting on the conductor to remove the conductor from the terminal. Thus, the tab 65 provides strain relief when the conductor is bent and engaged in the terminal. The outward angle of the tab 65 relative to the substantially planar surface 61 provides more strain relief for the conductor than there otherwise would be if the tab 65 was substantially perpendicular to the substantially planar surface 61.

Figure 5B:
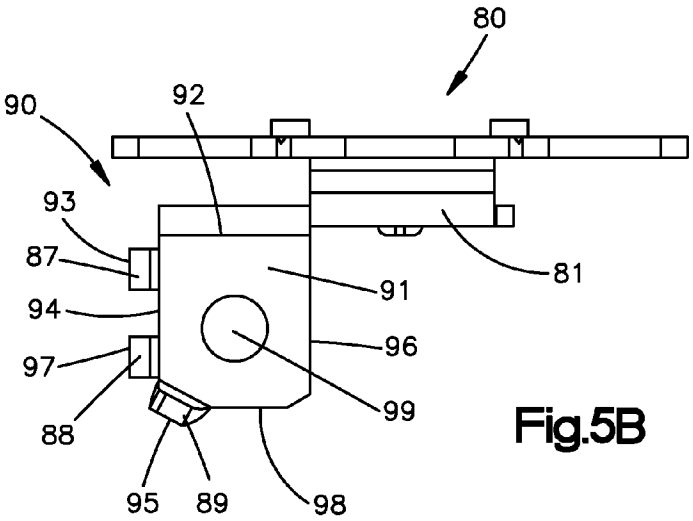
FIG. 5B is a top view of the mounting strap of FIG. 5A.
Figure 5A:
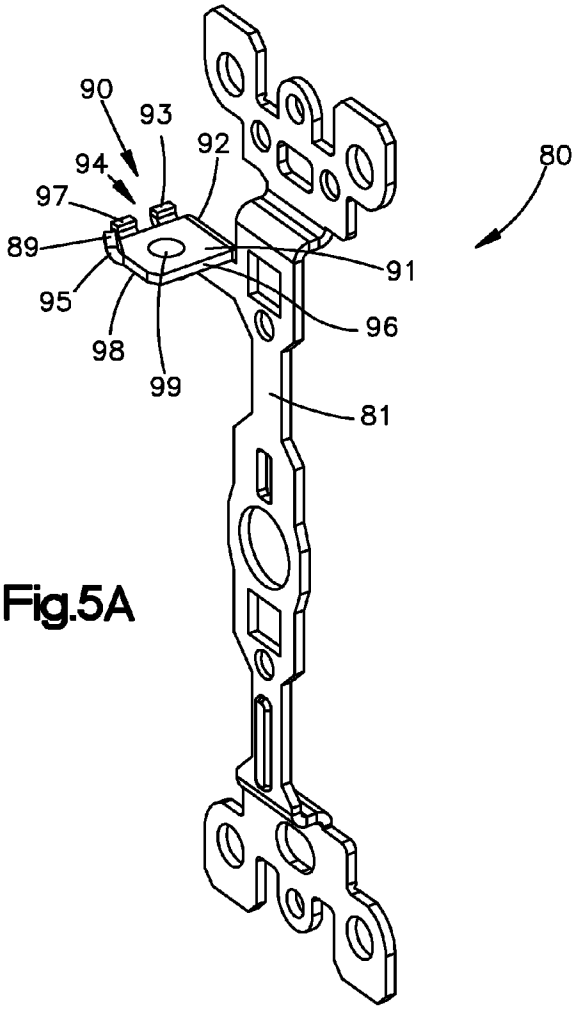
FIG. 5A is a perspective view of another exemplary embodiment of a mounting strap including a contact.

Referring to FIGS. 5A-B, another exemplary embodiment of a mounting strap 80 is shown. The mounting strap 80 is substantially similar to the mounting strap 5 illustrated in FIGS. 2A-D and discussed above, but for the following additional features. A contact 90 may include a first tab 95, a second tab 93 and a third tab 97. The first tab 95 may extend upward in a generally perpendicular direction from the substantially planar surface of the contact 90 between the second side 94 and the fourth side 98 of the contact 90, forming a corner. In this embodiment, the first tab 95 may be tapered to a point 89. However, in other embodiments, the tab may have a substantially flat top surface. In addition, in other embodiments, the first tab may extend in a more outward direction at an angle from the substantially planar surface of the contact.

The second and third tabs 93, 97 may extend from the second side 94 of the contact 90. The second tab 93 may be positioned on the second side 94 near the corner of the first side 92 and the second side 94; and, the third tab 97 may be positioned on the second side 94 near the corner of the second side 94 and the fourth side 98. The second and third tabs 93, 97 may extend in a direction that is generally perpendicular to a substantially planar surface 91 of the contact 90. A top surface 87 of the second tab 93 and a top surface 88 of the third tab 97 are preferably substantially flat.

In use, the mounting strap 80 may be used in conjunction with a wiring device, such as but not limited to the wiring device 30 (see FIG. 2C). A fastener, such as but not limited to the fastener 3000 shown in FIGS. 28A-C, may pass through the aperture 99 formed in the contact 90 and be tightened in the terminal, and a conductor (not shown) may be engaged directly between the contact 90 and the head of the fastener. More specifically, with respect to the contact, the conductor may be positioned on the substantially planar surface 91 of the contact 90 between the aperture 99 formed therethrough and the first, second, and third tabs 95, 93, 97. When the fastener is tightened in the terminal, the conductor is engaged directly between the head of the fastener and the contact 90. The friction between the conductor and the head of the fastener provides connectivity of the conductor in the terminal. The first, second and third tabs 95, 93, 97 contact the conductor, and push the conductor towards the shank of the fastener that is positioned in the aperture, thereby positioning the conductor underneath the head of the fastener when the fastener is being tightened, and increasing the engagement level of the conductor. Furthermore, the first tab 95 absorbs or decreases the force that would otherwise be acting on the conductor to remove the conductor from the terminal. Thus, the first tab 95 provides strain relief when the conductor is bent and engaged in the terminal.

Figure 6B:
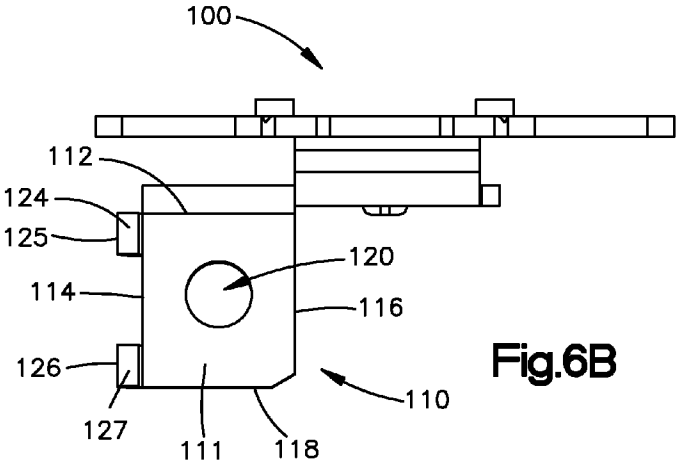
FIG. 6B is a top view of the mounting strap of FIG. 6A.
Figure 6A:
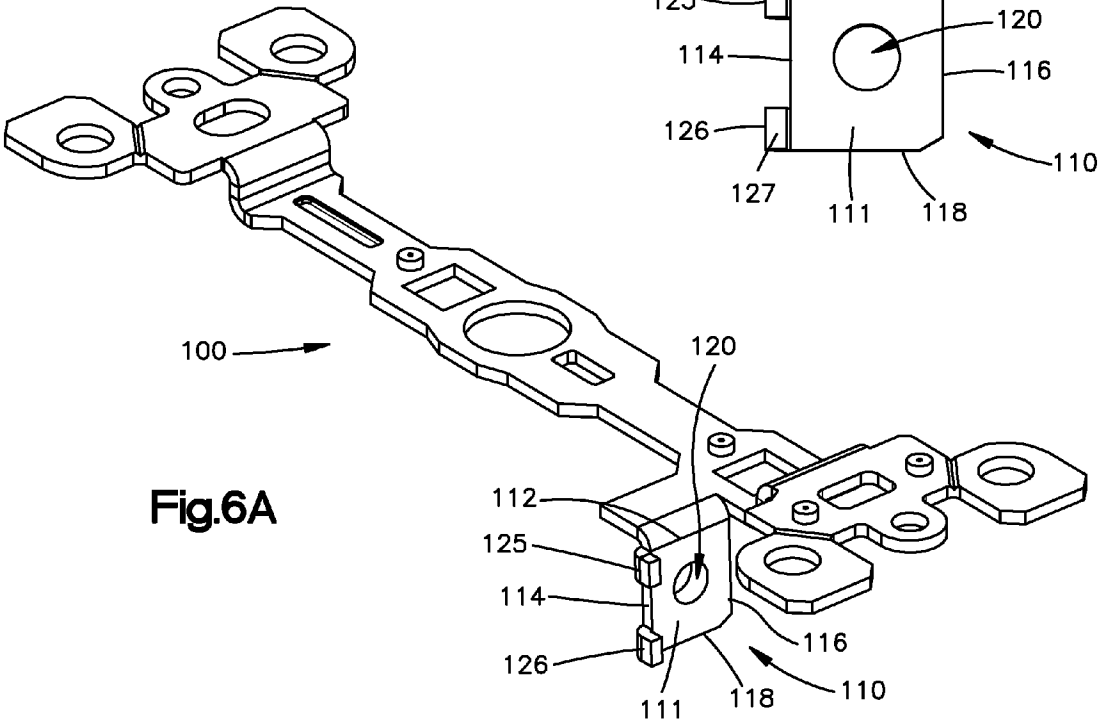
FIG. 6A is a perspective view of another exemplary embodiment of a mounting strap including a contact.

FIGS. 6A-B show another alternative exemplary embodiment of a mounting strap 100 that is substantially similar to the mounting strap 5 illustrated in FIGS. 2A-C and discussed above, but for the following additional features. The contact 110 may include first and second tabs 125, 126, wherein the first and second tabs 125, 126 may extend from the second side 114 of the contact 110. The first tab 125 may be positioned on the second side 114 near the corner of the first side 112 and the second side 114 of the contact 110; and, the second tab 126 may be positioned on the second side 114 near the corner of the second side 114 and the fourth side 118 of the contact 110. The first and second tabs 125, 126 may extend in a direction that is generally perpendicular to a substantially planar surface 111 of the contact 110. A top surface 124 of the first tab 125 and a top surface 127 of the second tab 126 are preferably substantially flat.

In use, the mounting strap 100 may be used in conjunction with a wiring device, such as but not limited to the wiring device 30 (see FIG. 2C). A fastener, such as but not limited to, the fastener 3000 shown in FIGS. 28A-C, may pass through the aperture 120 formed in the contact 110 and be tightened, and a conductor (not shown) may be engaged directly between the contact 110 and a head of the fastener. More specifically, with respect to the contact 110, the conductor may be positioned on the substantially planar surface 111 of the contact 110 between the aperture 120 formed therethrough and the second side 64. When the fastener is being tightened in the terminal, the first and second tabs 125, 126 push the conductor towards a body or shank of the fastener, thereby positioning the conductor underneath the head of the fastener, and increasing the engagement level of the conductor in the terminal.

Figure 7B:
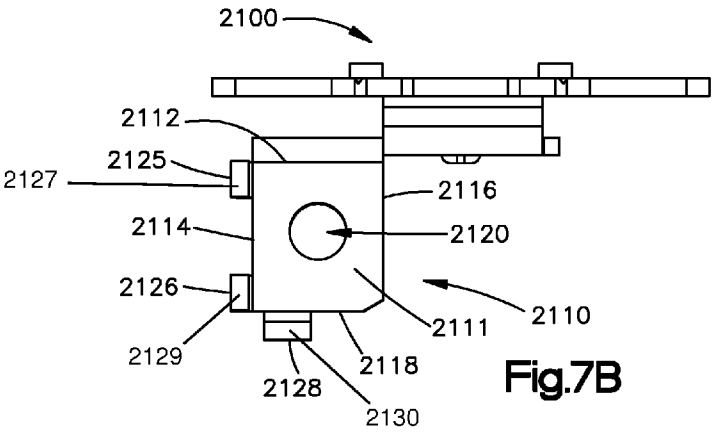
FIG. 7B is a top view of the mounting strap of FIG. 7A.
Figure 7A:
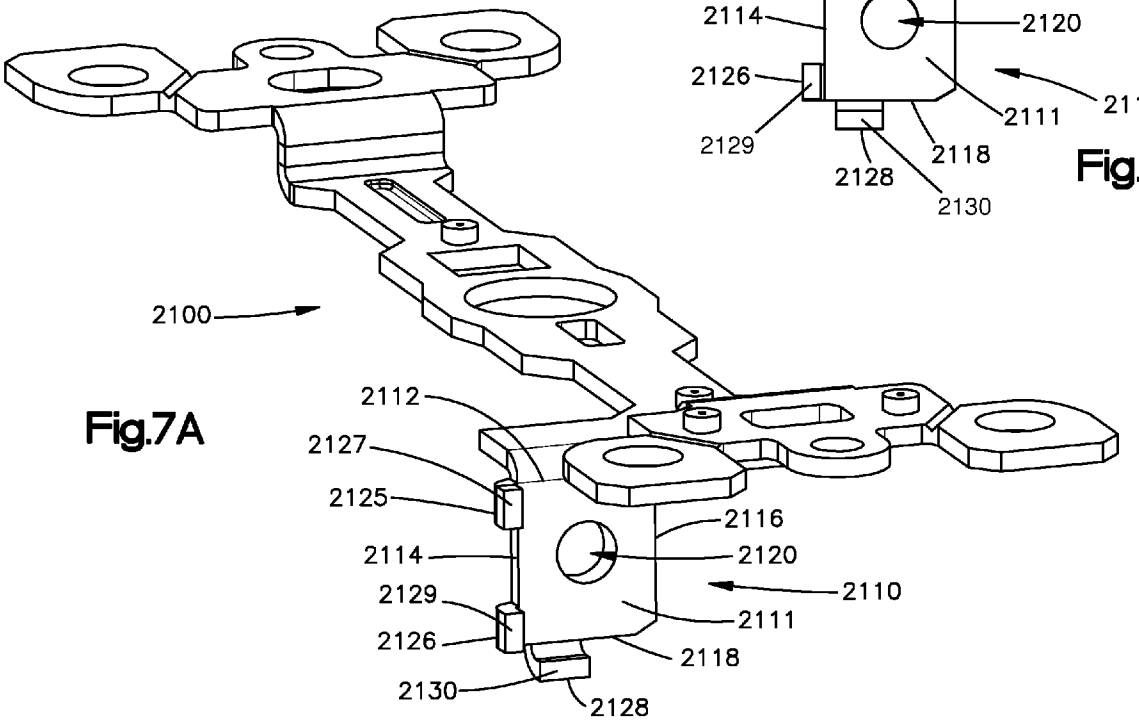
FIG. 7A is a perspective view of another exemplary embodiment of a mounting strap including a contact.

FIGS. 7A-B show yet another alternative exemplary embodiment of a mounting strap 2100 that is substantially similar to the mounting strap 5 illustrated in FIGS. 2A-D and discussed above, but for the following additional features. A contact 2110 may include a first tab 2125, a second tab 2126, and a third tab 2128. The first and second tabs 2125, 2126 may extend from the second side 2114 of the contact 2110. The first tab 2125 may be positioned on the second side 2114 of the contact 2110 near the corner of the first side 2112 and the second side 2114; and, the second tab 2126 may be positioned on the second side 2114 of the contact 2110 near the corner of the second side 2114 and the fourth side 2118. The first and second tabs 2125, 2126 may preferably extend in a direction that is generally perpendicular to a substantially planar surface 2111 of the contact 2110. A top surface 2127 of the first tab 2125 and a top surface 2129 of the second tab 2126 are preferably substantially flat.

The third tab 2128 may be positioned on the fourth side 2118 of the contact 2110 near the corner of the fourth side 2118 and the second side 2114. The third tab 2128 may extend from the fourth side 2118 of the contact 2110 so that the third tab 2128 is generally perpendicular to the substantially planar surface 2111 of the contact 2110. A top surface 2130 of the third tab 2128 is preferably substantially flat.

In use, the mounting strap 2100 may be used in conjunction with a wiring device, such as but not limited to the wiring device 30 (see FIG. 2C). A fastener, such as but not limited to the fastener 3000 shown in FIGS. 28A-C, may pass through the aperture 2120 formed in the contact 2110 and be tightened in the terminal, and a conductor (not shown) may be engaged directly between the contact 2110 and a head of the fastener. More specifically, with respect to the contact, a portion of the conductor may be positioned on the substantially planar surface 2111 between the aperture 2120 formed therethrough and the second side 2114, and another portion of the conductor may rest on the top surface 2130 of the third tab 2128. The first and second tabs 2125, 2126 contact the conductor, and push the conductor towards the shank of the fastener that is positioned in the aperture, thereby positioning the conductor underneath the head of the fastener when the fastener is being tightened, and increasing the engagement level of the conductor in the terminal. The third tab 2128 may bend downward, thereby creating a spring force and providing strain relief for the conductor. In addition, as conductor is pulled downward, the third tab 2128 will absorb or decrease the force that would otherwise be acting on the conductor, resulting in additional strain relief for the portion of the conductor secured in the terminal.

Figure 8B:
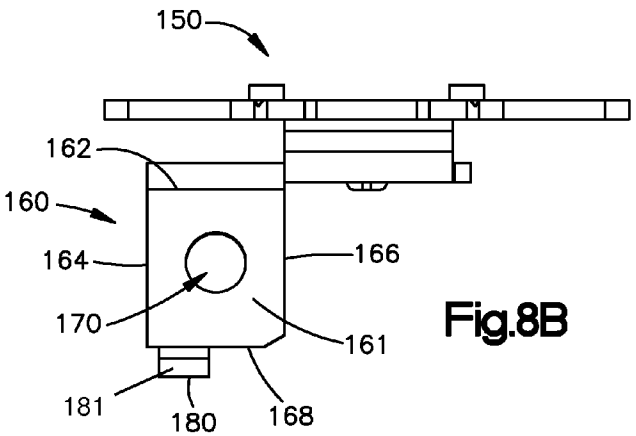
FIG. 8B is a top view of the mounting strap of FIG. 8A.
Figure 8A:
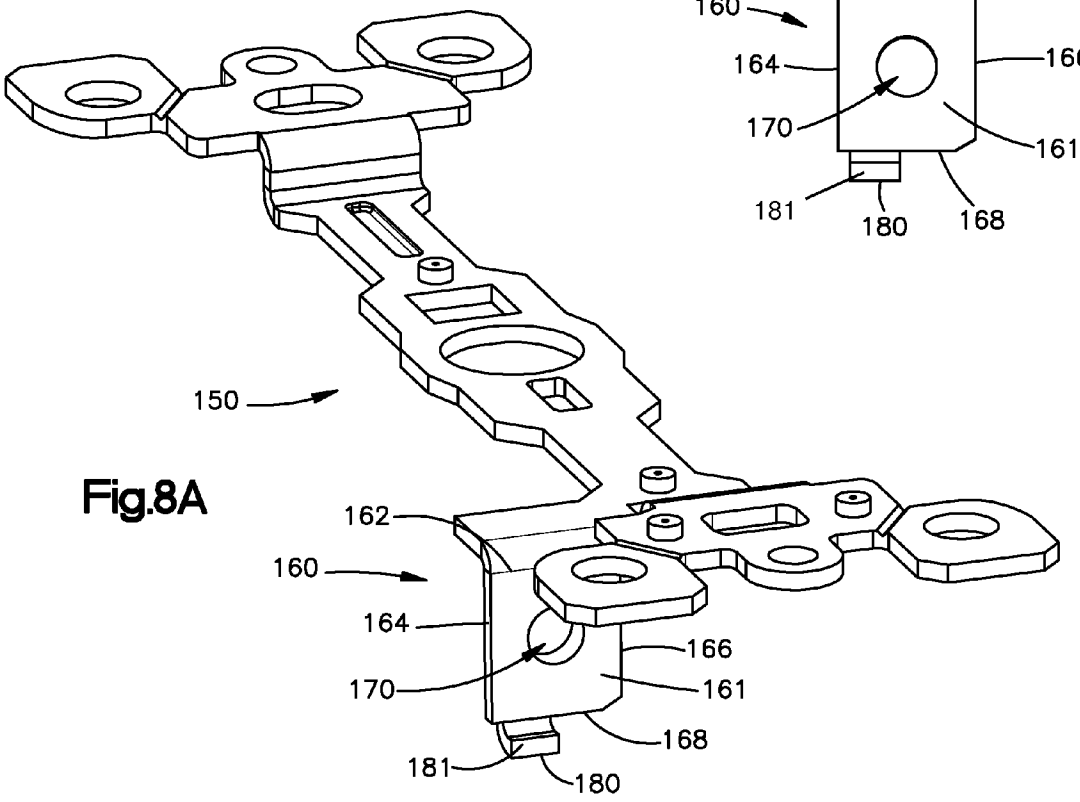
FIG. 8A is a perspective view of another exemplary embodiment of a mounting strap including a contact.

FIGS. 8A-B show an alternative exemplary embodiment of a mounting strap 150 that is substantially similar to the mounting strap 5 illustrated in FIGS. 2A-D and discussed above, but for the following additional features. A contact 160 may include a tab 180. The tab 180 may be positioned on the fourth side 168 of the contact 160 near the corner of the fourth side 168 and the second side 164. The tab 180 may extend from the fourth side 168 of the contact 160 so that the tab 180 is generally perpendicular to the substantially planar surface 161 of the contact 160. A top surface 181 of the tab 180 is preferably substantially flat.

In use, the mounting strap 150 may be used in conjunction with a wiring device, such as but not limited to the wiring device 30 (see FIG. 2C). A fastener such as but not limited to the fastener shown in FIGS. 28A-C, may pass through the aperture 170 formed in the contact 160 and be tightened in the terminal, and a conductor (not shown) may be engaged directly between the contact 160 and a head of the fastener. More specifically, with respect to the contact, a portion of the conductor may be positioned on the substantially planar surface 161 in between the aperture 170 formed therethrough and the tab 180, and another portion of the conductor may rest on the top surface 181 of the tab 180. The tab 180 helps engage and secure the conductor in place and provides strain relief for the conductor. More specifically, the tab 180 may bend downward, thereby creating a spring force and providing strain relief for the conductor. In addition, as the conductor is pulled downward, the tab 180 will absorb or decrease the force that would otherwise be acting on the conductor, resulting in additional strain relief for the portion of the conductor secured in the terminal.

In the embodiment shown in FIGS. 8A-B, there are no tabs extending from the second side 164 of the contact 160 to push the conductor towards the shank of the fastener. However, an edge on the body of the electrical device (such as edge 21 of the body 38 in FIG. 2C) may push the conductor towards the shank of the fastener that is positioned in the aperture formed in the contact, thereby positioning the conductor underneath the head of the fastener when the fastener is being tightened, and increasing the engagement level of the conductor in the terminal.

Figure 9B:
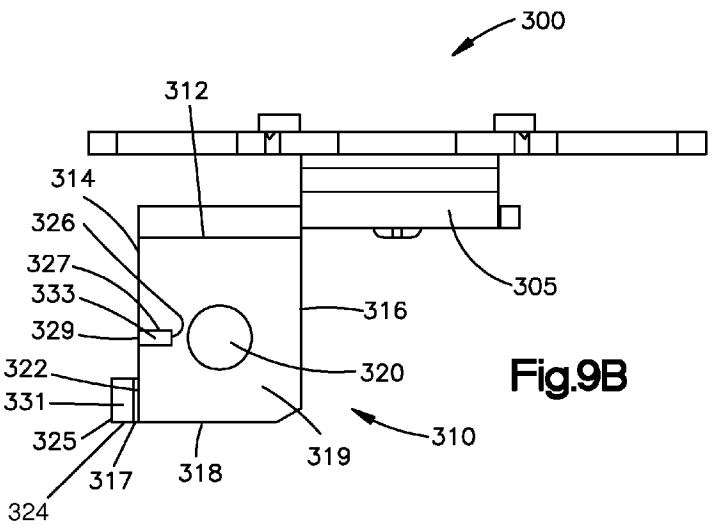
FIG. 9B is a top view of the mounting strap of FIG. 9A.
Figure 9A:
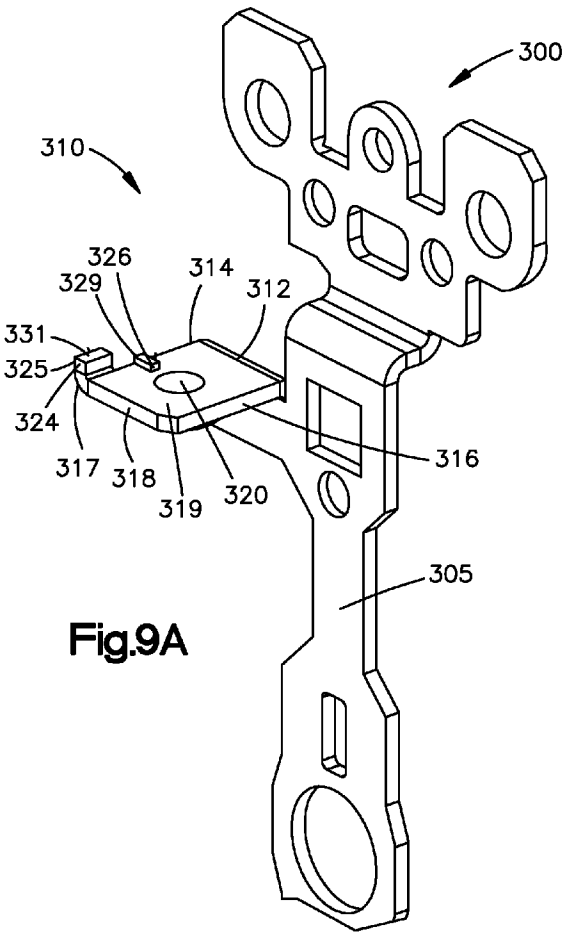
FIG. 9A is a partial perspective view of another exemplary embodiment of a mounting strap including a contact.

FIGS. 9A-B show another alternative exemplary embodiment of a mounting strap 300 that is substantially similar to the mounting strap 5 illustrated in FIGS. 2A-D and discussed above, but for the following additional features. A contact 310 may preferably include a tab 325 and a protrusion 326. The tab 325 and the protrusion 326 are both generally rectangular. The tab 325 extends from a side of the contact 310, preferably the second side 314 of the contact 310; and, the protrusion 326 extends from the substantially planar surface 319 of the contact 310. The tab 325 extends higher than the protrusion 326 relative to the substantially planar surface 319. The tab 325 may preferably have a substantially flat top surface 331; and, the protrusion may preferably have a substantially flat top surface 333. The tab 325 may be positioned near or at a corner 317 of the contact 310 in between the second side 314 and the fourth side 318. More preferably, one side 322 of the tab 325 may be flush with the second side 314 of the contact 310, and another side 324 of the tab 325 may be flush with the fourth side 318 of the contact 310.

The protrusion 326 may be positioned on the substantially planar surface 319 of the contact 310 between the first side 312 and the fourth side 318. That is, the protrusion 326 may extend upward in a generally perpendicular direction from the substantially planar surface 319 of the contact. One side 329 of the protrusion 326 may be flush with the second side 314 of the contact 310. Another side 327 of the protrusion 326 may be generally parallel to the first side 312 and the fourth side 318, and may extend towards the aperture 320 formed in the contact 310.

In use, the mounting strap 300 may be used in conjunction with a wiring device, such as but not limited to the wiring device 30 (see FIG. 2C). A fastener such as but not limited to the fastener 3000 shown in FIGS. 28A-C, may pass through the aperture 320 formed in the contact 310 and be tightened in the terminal, and a conductor (not shown) may be engaged directly between the protrusion 326 and the head of the fastener. The conductor may be positioned on the substantially planar surface 319 of the contact between the aperture 320 formed in the contact and the second side 314. More specifically, the conductor may be positioned on the substantially planar surface 319 of the contact 310 between the tab 325 and the body or shank of the fastener, in which the conductor extends across the top surface 333 of the protrusion 326. The tab 325 may push the conductor towards the shank of the fastener that is positioned in the aperture 320, thereby positioning the conductor underneath the head of the fastener when the fastener is being tightened, and increasing the engagement level of the conductor in the terminal. The protrusion 326 absorbs the pull forces applied to the conductor from the head of the fastener, resulting in strain relief for the conductor.

FIGS. 10A-D show another alternative exemplary embodiment of a mounting strap 460 that is substantially similar to the mounting strap 5 illustrated in FIGS. 2A-D and discussed above, but for the following additional features. A contact 480 may include a protrusion 485 and a tab 489. The protrusion 485 is preferably generally rectangular and may be positioned preferably on a substantially planar surface 481 of the contact 480. More specifically, the protrusion 485 resides on and extends from the substantially planar surface 481 of the contact 480 and is preferably flush with the second side 484 of the contact 480 and extends across a majority of the length of the second side 484. The protrusion 485 may extend upward in a generally perpendicular direction from the substantially planar surface 481 of the contact. The protrusion preferably has a substantially flat top surface 487.

The tab 489 may preferably extend from the fourth side 488 of the contact 480 in a generally perpendicular direction with respect to the substantially planar surface 481 of the contact. One side 483 of the tab 489 may be flush with the second side 484 of the contact 480. The tab 489 preferably includes a notch or a concave recess 492 formed in a top surface thereof for receiving a conductor 467 therein. More preferably, the top surface of the tab includes a first side 491 and a second side 493, forming the notch 492 that is generally "V-shaped." The first side 491 may have a steeper incline than the second side 493. The tab 489 is configured for a conductor to be positioned in between the first side 491 and the second side 493.

Figure 10B:
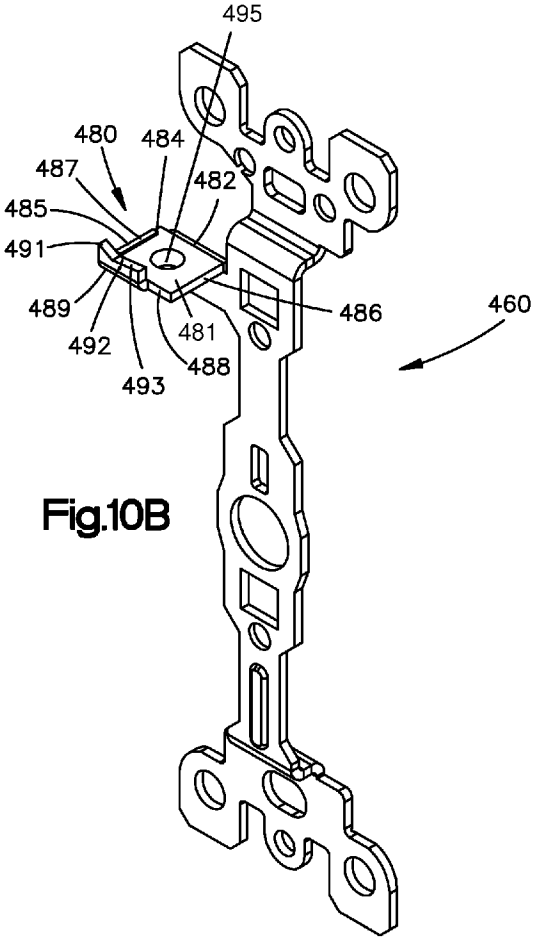
FIG. 10B is a perspective view of the mounting strap of FIG. 10A.
Figure 10A:
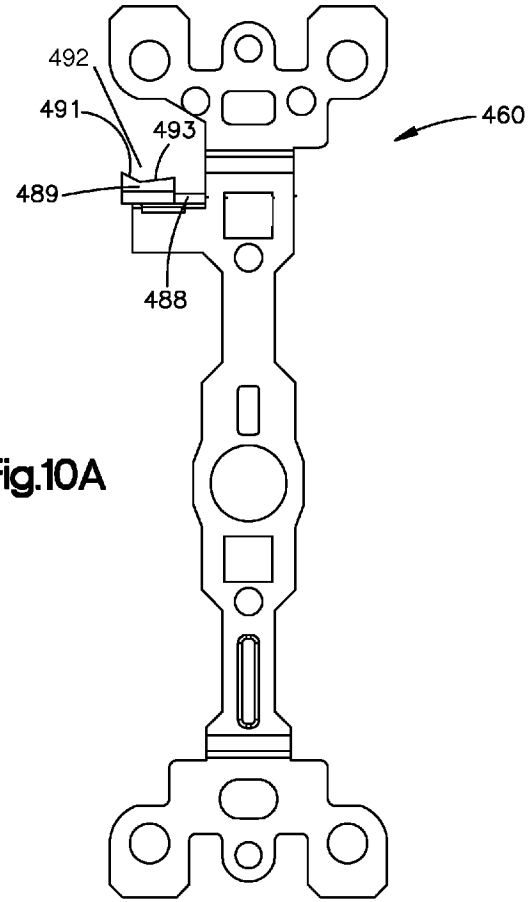
FIG. 10A is a front view of another exemplary embodiment of a mounting strap including a contact.
Figure 10D:
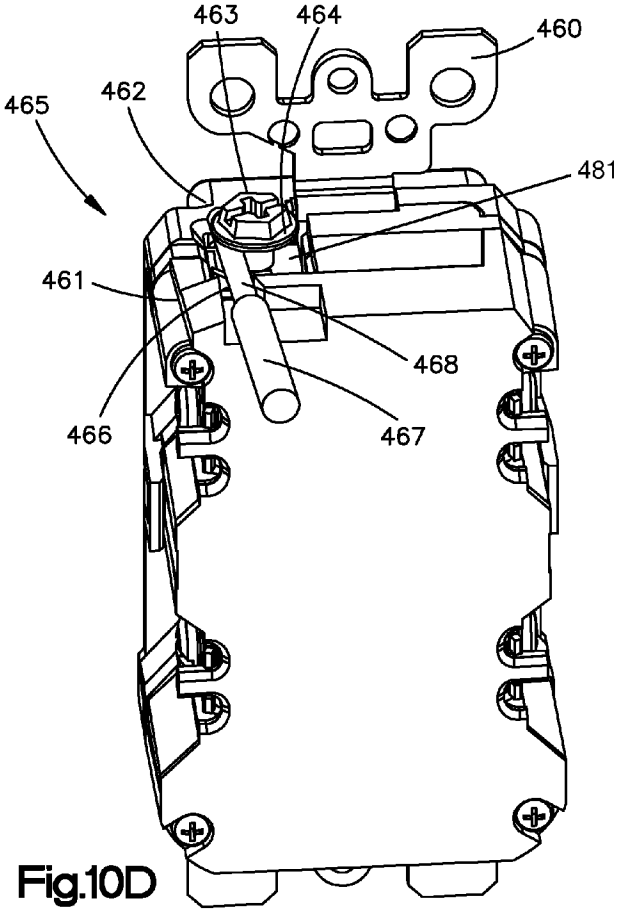
FIG. 10D is a perspective view of an exemplary embodiment of a wiring device having the mounting strap of FIGS. 10A-C.
Figure 10C:
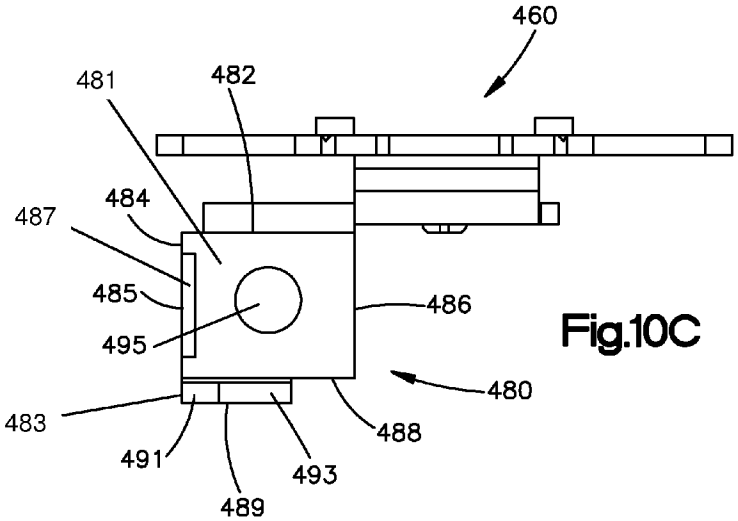
FIG. 10C is a top view of the mounting strap of FIGS. 10A-B.

In use, as shown in FIG. 10D, the mounting strap 460 may be inserted into a wiring device 465. The wiring device 465 may include a body 461 and a ground terminal 462, in which the ground terminal 462 may include the contact 480 of the mounting strap 460 and a fastener 463. The fastener 463 may preferably include a washer head 464, and may pass through the aperture 495 formed in the contact 480. The body 461 may include an opening 466 for a conductor 467 to pass through, and the conductor 467 may be positioned in the terminal 462. More specifically, the conductor 467 preferably having a bare portion 468 may be placed in the notch 492 and extend across the contact 480 between the aperture 495 formed in the contact 480 and the second side 484. When the fastener 463 is tightened in the terminal, the bare portion 468 of the conductor 467 is engaged directly between the washer head 464 and the contact 480. The contour of the tab 489 pushes the conductor into proper position while the washer head 464 clamps the bare portion 468 of the conductor 467 in between the contact 480 and the fastener 463. More specifically, when the fastener 463 applies force to the bare portion 468 of the conductor 467, the first side 491 of the tab 489 pushes the conductor towards the shank of the fastener 463 and the second side 493 of the tab 489 helps engage the conductor 467. When the fastener 463 is tightened in the terminal, the tab 489 slightly bends the conductor, resulting in strain relief for the conductor 467 and allowing the conductor to hold more weight. The protrusion 485 helps keep the conductor 467 under the washer head 464 when the conductor is compressed directly between the contact 480 and the fastener 463.

FIGS. 11A-D show another alternative exemplary embodiment of a mounting strap 1500 that is substantially similar to the mounting strap 5 illustrated in FIGS. 2A-D and discussed above, but for the following additional features. A contact 1510 may include a protrusion 1515 and a tab 1519. The protrusion 1515 is preferably generally rectangular and may be positioned on a substantially planar surface 1523 of the contact 1510. More specifically, the protrusion 1515 resides on and extends from the substantially planar surface 1523 of the contact 1510 and one side 1513 of the protrusion is preferably substantially flush with the second side 1514 of the contact 1510, extending across the majority of the length of the second side 1514. The protrusion 1515 may extend upward in a generally perpendicular direction from the substantially planar surface 1523 of the contact 1510, and preferably has a substantially flat top surface 1517.

The tab 1519 may be positioned on the fourth side 1518 of the contact 1510 near the corner of the second side 1514 and the fourth side 1518 of the contact 1510. Preferably, a first end 1521 of the tab 1519 is substantially flush with the second side 1514 of the contact 1510. The tab 1519 may extend from the fourth side 1518 in a generally perpendicular direction with respect to the substantially planar surface 1523 of the contact 1510. Preferably, the tab 1519 extends from the fourth side 1518 of the contact 1510 at a slight outward angle beyond ninety degrees. The tab 1519 may preferably include a notch or concave recess 1530 for receiving a conductor 1546 therein. More preferably, the tab 1519 is generally "U-shaped" and includes a first end 1521 and a second end 1525. The notch 1530 is positioned between the first and second ends 1521, 1525. The first end 1521 may include a top surface 1537, and the second end 1525 may include a top surface 1536. The top surface 1537 of the first end 1521 may extend higher than the top surface 1536 of the second end 1525. In addition, the notch 1530 may include a plurality of surfaces 1531, 1532, 1533, 1534, 1535. Surface 1531 is adjacent to surface 1532 at an obtuse angle. Surface 1532 is adjacent to surface 1533 at an obtuse angle. Surface 1533 is at a generally right angle to surface 1534. Surface 1534 is adjacent to surface 1535 at a reflex angle.

Figure 11B:
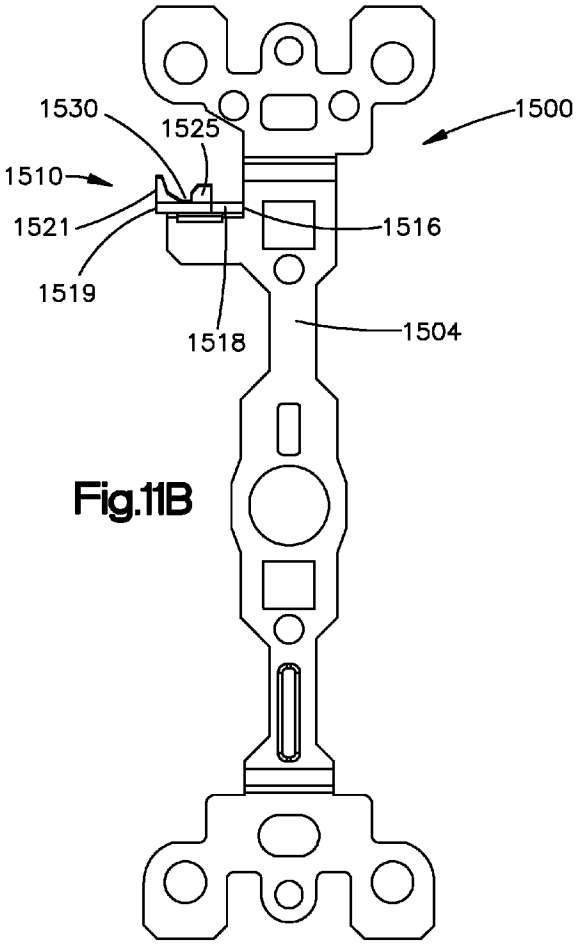
FIG. 11B is a front view of the mounting strap of FIG. 11A.
Figure 11A:
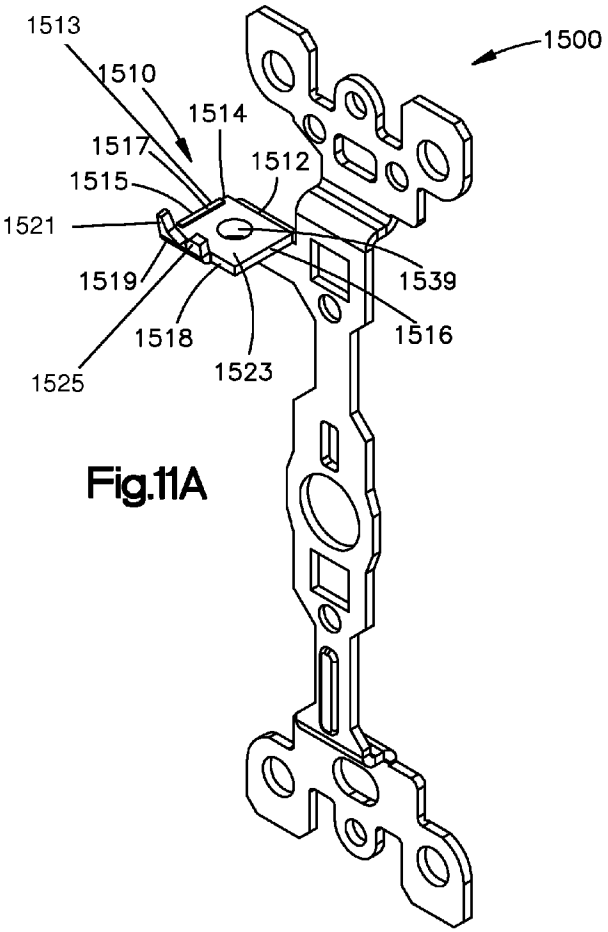
FIG. 11A is a perspective view of another exemplary embodiment of a mounting strap including a contact.
Figure 11D:
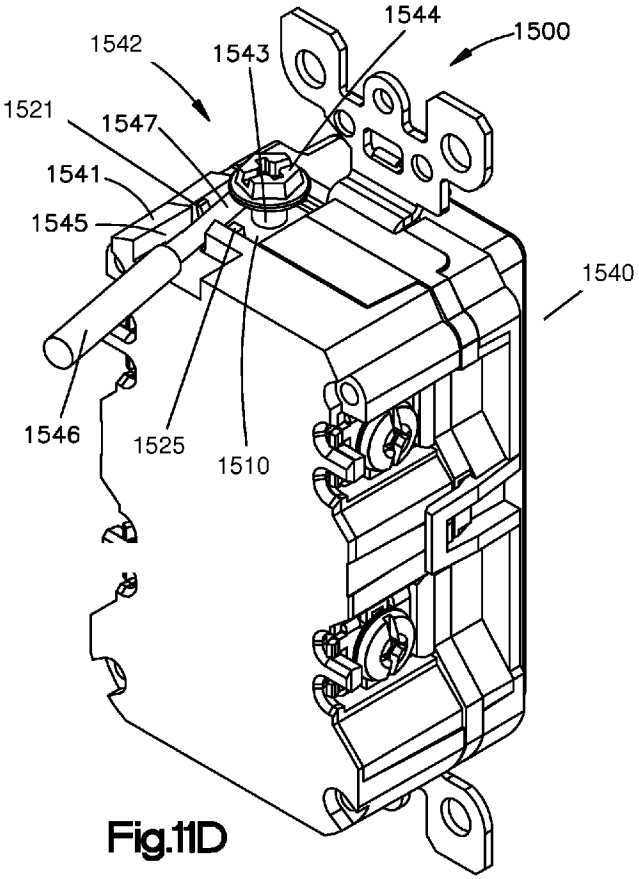
FIG. 11D is a perspective view of an exemplary embodiment of a wiring device having the mounting strap of FIGS. 11A-B.
Figure 11C:
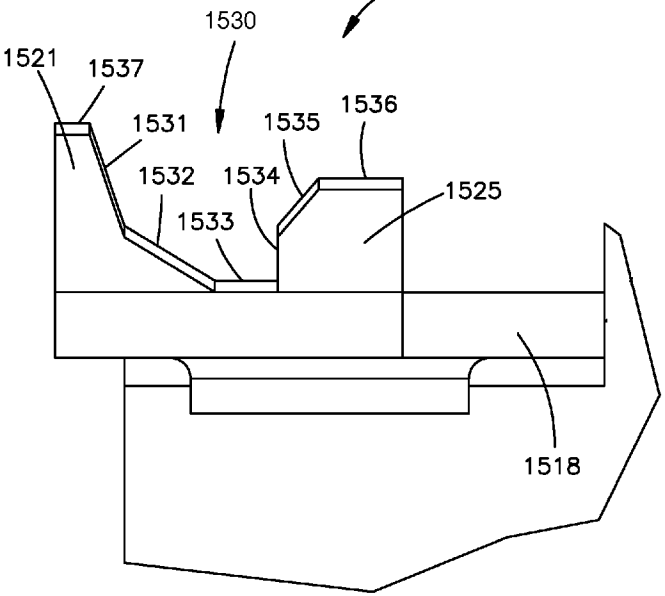
FIG. 11C is an enlarged view of a tab on the contact shown in FIGS. 11A-B.

In use, as shown in FIG. 11D, the mounting strap 1500 may be inserted into a wiring device 1540. The wiring device 1540 may include a body 1541 and a ground terminal 1542. The ground terminal 1542 may include the contact 1510 of the mounting strap 1500 and a fastener 1543. The fastener 1543 may preferably include a washer head 1544, and may pass through the aperture 1539 formed in the contact 1510. The body 1541 may include an opening 1545 for a conductor 1546 to pass through, and the conductor 1546 may be positioned in the terminal 1542. More specifically, the conductor 1546 preferably having a bare portion 1547 may be placed in the notch 1530 of the tab 1519 and extend across the contact 1510 between the protrusion and the aperture 1539 formed in the contact 1510. When the fastener 1543 is tightened in the terminal 1542, the bare portion 1547 of the conductor 1546 is engaged directly between the washer head 1544 and the contact 1510. The protrusion 1515 may push the bare portion 1547 of the conductor 1546 towards the shank of the fastener 1543, thereby positioning the conductor underneath the head of the fastener 1543 when the fastener 1543 is being tightened in the terminal 1542, and increasing the engagement level of the conductor 1546 in the terminal.

When the conductor 1546 is positioned in the notch 1530, the bare portion 1547 of the conductor 1546 may contact the tab 1519 on a plurality of different surfaces 1531, 1532, 1534, 1535, providing friction and securing the conductor in place while also providing strain relief. The geometry and features of the contact 1510 push the bare portion 1547 of the conductor 1546 in a direction towards the shank of the fastener 1543, thereby positioning the conductor underneath the head of the fastener 1543 when the fastener 1543 is being tightened in the terminal 1542, and increasing the engagement level of the conductor 1546 in the terminal 1542. Furthermore, the geometry of the notch 1530 causes the conductor to bend, resulting in strain relief for the conductor and allowing the conductor to hold more weight. More specifically, surfaces 1531 and 1532 provide space for the conductor to be inserted in the notch; and, surfaces 1533, 1534, and 1535 increase interference with the conductor, resulting in strain relief. In embodiments where the tab 1519 extends from the fourth side 1518 of the contact 1510 at a slight outward angle beyond ninety degrees, the tab 1519 may bend downward, thereby creating a spring force and providing additional strain relief for the conductor 1546. In addition, as the conductor 1546 is pulled downward, the tab 1519 will absorb or decrease the force that would otherwise be acting on the conductor, resulting in additional strain relief for the conductor 1546 that is secured in the terminal 1542.

Figure 12A:
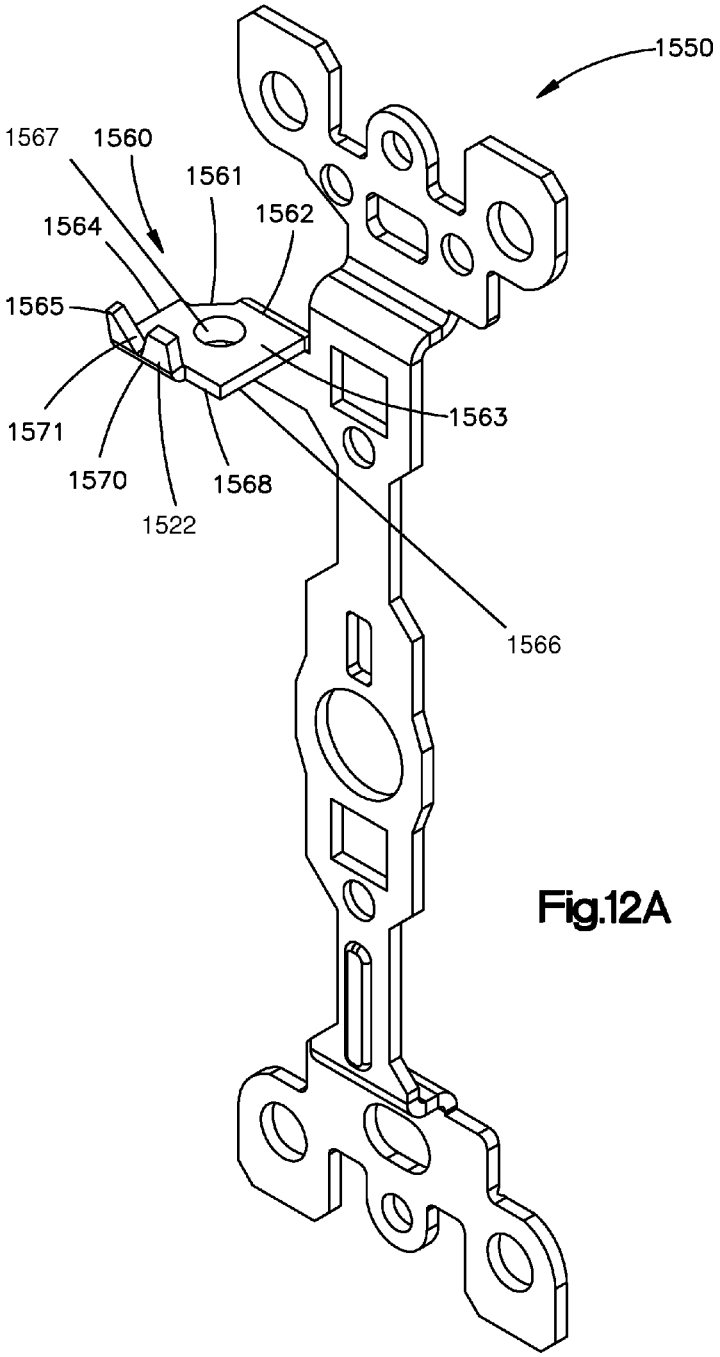
FIG. 12A is a perspective view of another exemplary embodiment of a mounting strap including a contact.
Figure 12C:
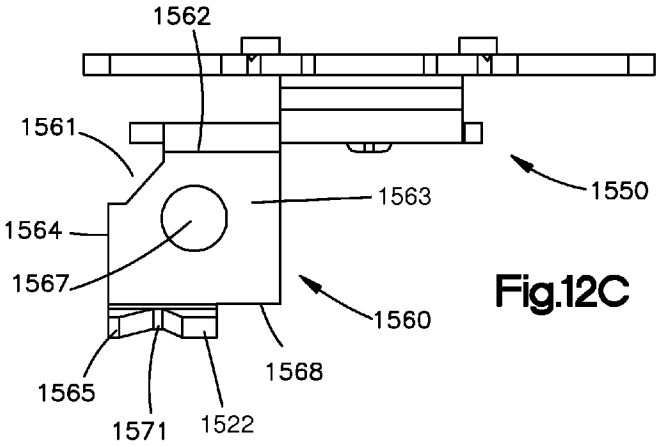
FIG. 12C is a top view of the mounting strap of FIGS. 12A-B.
Figure 12B:
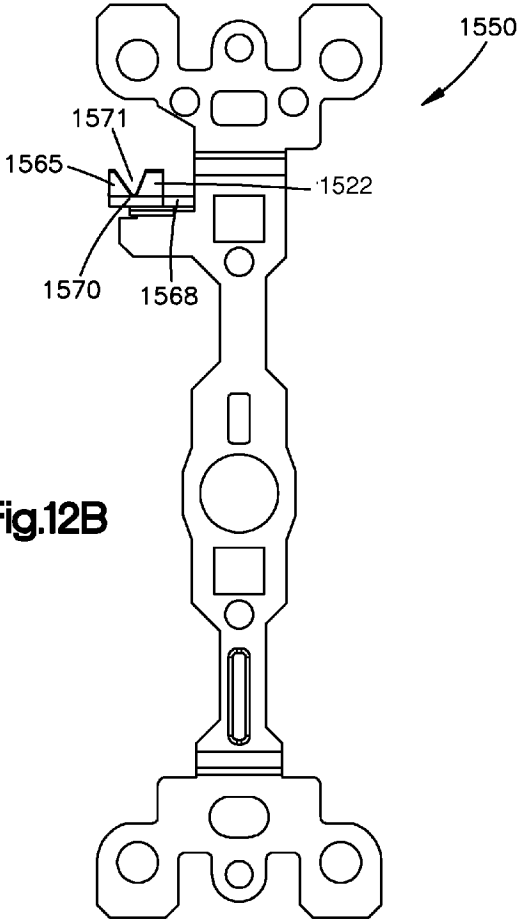
FIG. 12B is a front view of the mounting strap of FIG. 12A.

FIGS. 12A-C show another alternative exemplary embodiment of a mounting strap 1550 that is substantially similar to the mounting strap 5 illustrated in FIGS. 2A-D and discussed above, but for the following additional features. A contact 1560 may include a cut out 1561 formed therein and a tab 1570. The cut out 1561 may be positioned in between a first side 1562 and a second side 1564 of the contact 1560 and may extend therethrough.

The tab 1570 may be positioned on the fourth side 1568 of the contact 1560 near the corner of the second side 1564 and the fourth side 1568 of the contact 1560. Preferably, a first end 1565 of the tab 1570 is substantially flush with the second side 1564 of the contact 1560. The tab 1570 may extend from the fourth side 1568 of the contact 1560. That is, the tab 1570 may extend in a generally perpendicular direction to the substantially planar surface 1563 of the contact 1560. Preferably, the tab 1570 extends from the fourth side 1568 of the contact 1560 at a slight outward angle beyond ninety degrees. The tab 1570 may include a first end 1565 and a second end 1522. In addition, the tab 1570 may preferably include a notch or concave recess 1571 formed therein for receiving a conductor (not shown). The notch 1571 is positioned between first and second ends 1565, 1522 of the tab 1570. Preferably, the tab 1570 is generally "U-shaped" for receiving the conductor therein. The first end 1565 may preferably extend upward to a point, extending further than the second end 1522. In use, the mounting strap 1550 may be used in conjunction with a wiring device, such as but not limited to the wiring device 30 (see FIG. 2C). A fastener (not shown) may pass through the aperture 1567 formed in the contact 1560 and be tightened in the terminal. A conductor (not shown) may be engaged directly between the contact 1560 and a head of the fastener. The tab 1570 may be configured to place a conductor (not shown) in the notch 1571 and extend across the contact 1560 between the aperture 1567 formed in the contact and the second side 1564, in which the end of the conductor is bent into the cut out 1561 formed in the contact 1560. The geometry and features on the contact 1560, including the tab 1570 and the cut out 1561, push the conductor in a direction toward the shank of the fastener, thereby positioning the conductor underneath the head of the fastener when the fastener is being tightened in the terminal, and increasing the engagement level of the conductor in the terminal. The tab 1570 and the cut out 1561 position and secure the conductor in place, providing strain relief when the conductor is bent and allowing the conductor to hold more weight. More specifically, the contour of the first end 1565 of the tab 1570 provides space for the conductor to be inserted into the notch; and, the contour of the second end 1522 of the tab 1570 increases interference with the conductor, resulting in strain relief. The tab 1570 pushes the conductor to position while the head of the fastener directs the force to the terminal and clamps the conductor. In embodiments where the tab 1570 extends from the fourth side 1568 at a slight outward angle beyond ninety degrees, the tab 1570 may bend downward, thereby creating a spring force and providing additional strain relief for the conductor. In addition, as the conductor is pulled downward, the tab 1570 will absorb or decrease the force that would otherwise be acting on the conductor, resulting in additional strain relief for the portion of the conductor secured in the terminal.

The cut out 1561 formed in the contact 1560 provides additional space in the terminal to position the end of the conductor, and to secure the conductor in position while the conductor is being assembled in the terminal. It will be understood by one of ordinary skill that each of the other embodiments discussed in this disclosure may include a cut out extending through the contact, similar to the cut out 1561 shown in FIGS. 12A-C. In general, a cut out feature formed in the contact is configured so that a portion of the conductor may be pushed down into the cutout, thereby positioning the conductor in place while the fastener is being tightened.

Figure 13A:
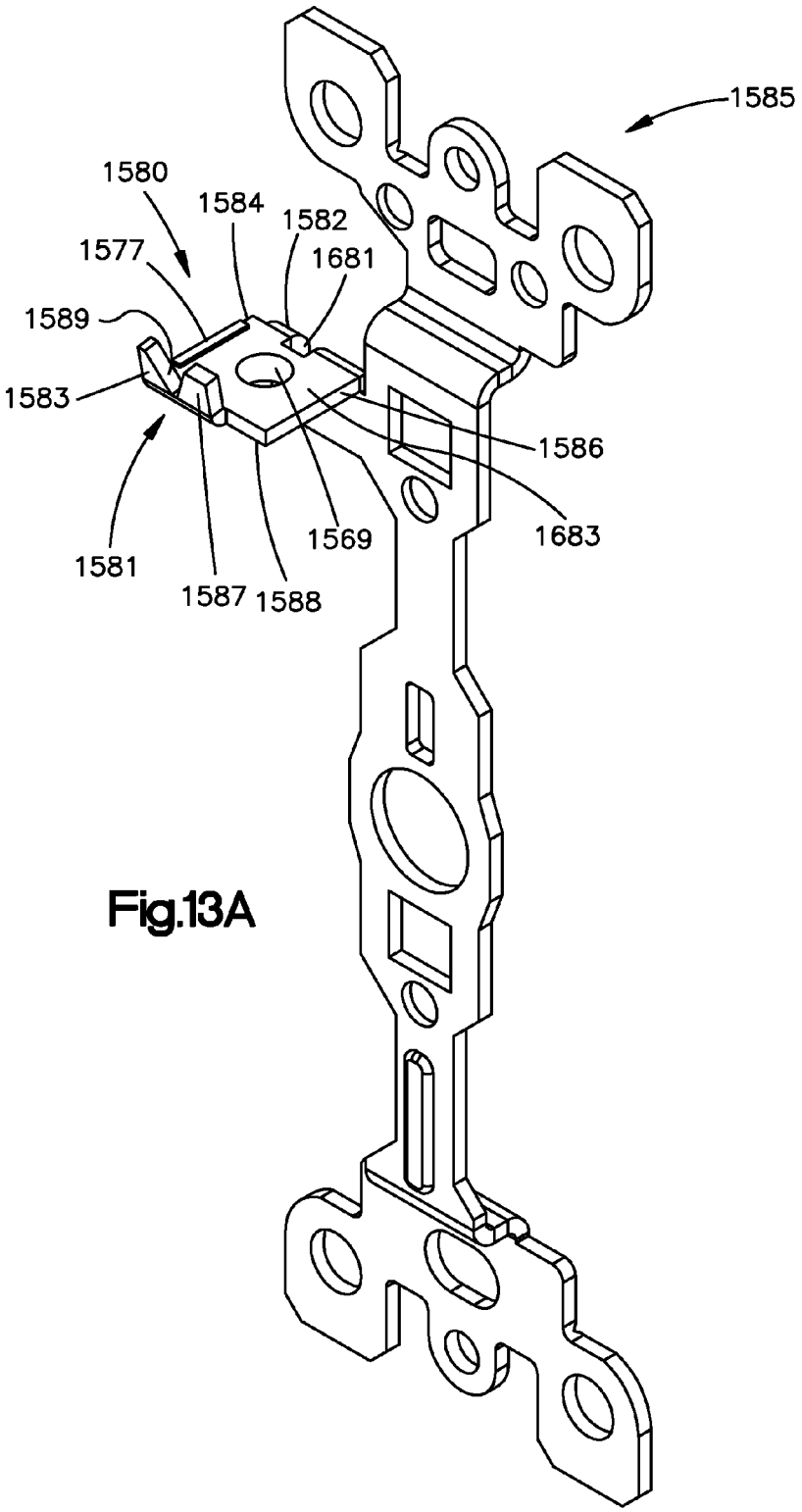
FIG. 13A is a perspective view of another exemplary embodiment of a mounting strap including a contact.
Figures 13B, 13C:
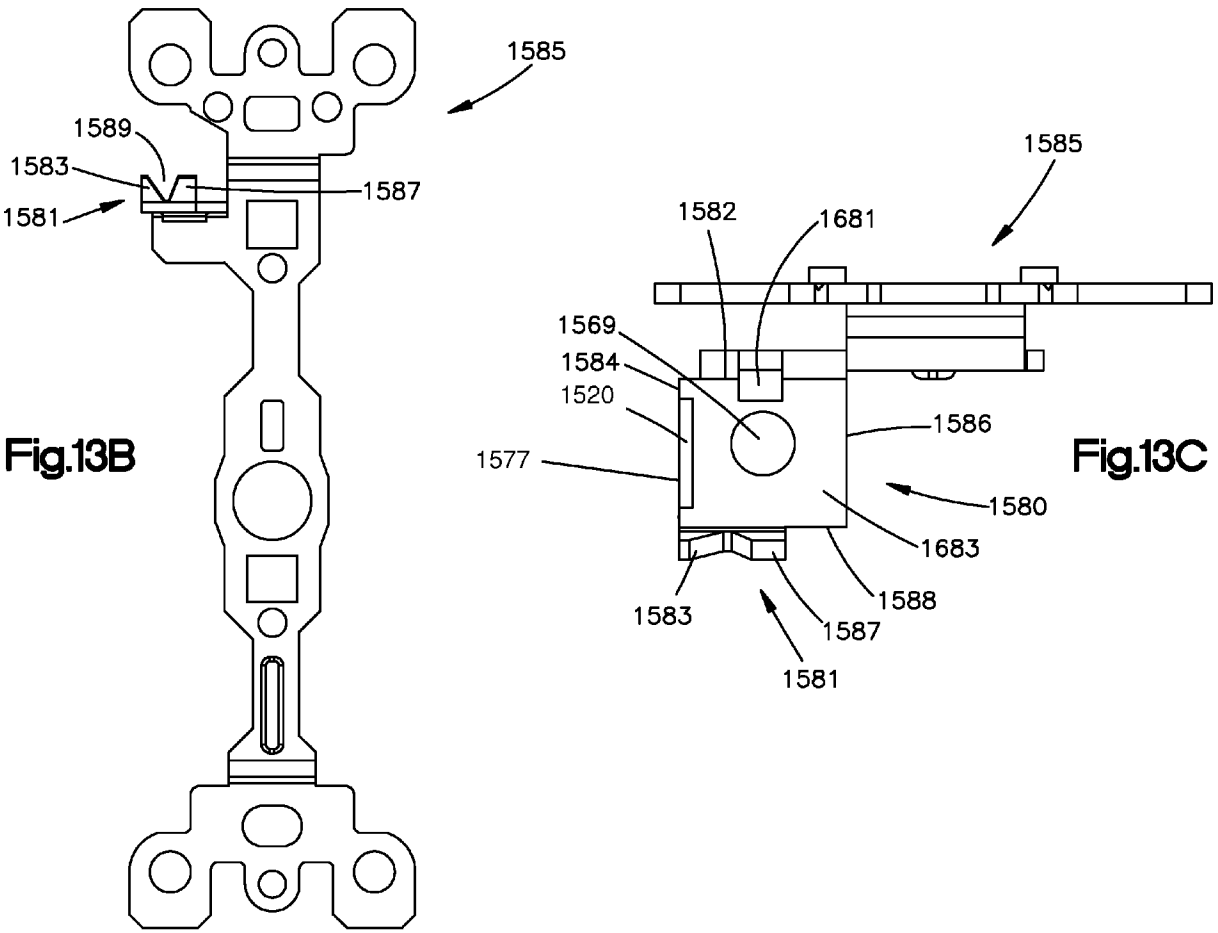
FIG. 13B is a front view of the mounting strap of FIG. 13A.
FIG. 13C is a top view of the mounting strap of FIGS. 13A-B.

FIGS. 13A-C show another alternative exemplary embodiment of a mounting strap 1585 that is substantially similar to the mounting strap 5 illustrated in FIGS. 2A-D and discussed above, but for the following additional features. A contact 1580 may include a cut out 1681 formed therein and a tab 1581. The cut out 1681 may be positioned on a first side 1582 of the contact 1580 and may extend therethrough.

The tab 1581 may extend from the fourth side 1588 of the contact 1580 near the corner of the second side 1584 and the fourth side 1588 of the contact 1580. Preferably, a first end 1583 of the tab 1570 is substantially flush with the second side 1584 of the contact 1580. The tab 1581 preferably may extend in a generally perpendicular direction with respect to the substantially planar surface 1683 of the contact 1580. Preferably, the tab 1581 extends from the fourth side 1588 of the contact 1580 at a slight outward angle beyond ninety degrees. The tab 1581 may include a first end 1583 and a second end 1587. In addition, the tab 1581 may include a notch or concave recess 1589 formed therein for receiving a conductor (not shown). The notch 1589 is positioned between the first and second ends 1583, 1587 of the tab 1581. Preferably, the notch 1589 is generally "U-shaped" or "V-shaped" for receiving the conductor therein. The first end 1583 may preferably extend upward to a point, and the second end 1587 may extend upward to a substantially flat surface.

The contact 1580 may also include a protrusion 1577. The protrusion 1577 may be generally rectangular and may be positioned on a substantially planar surface 1683 of the contact 1580. More specifically, the protrusion 1577 resides on and extends from the substantially planar surface 1683 of the contact 1580, and one side of the protrusion 1577 is preferably substantially flush with the second side 1584 of the contact 1580, extending across the majority of the length of the second side 1584. The protrusion 1577 may extend upward in a generally perpendicular direction from the substantially planar surface 1683 of the contact 1580, and preferably has a substantially flat top surface 1520.

In use, the mounting strap 1585 may be used in conjunction with a wiring device, such as but not limited to the wiring device 30 (see FIG. 2C). A fastener (not shown) may pass through the aperture 1569 formed in the contact 1580 and be tightened in the terminal. A conductor (not shown) may be engaged directly between the contact 1580 and a head of the fastener. The tab 1581 may be configured to place a conductor (not shown) in the notch 1589 and extend across the contact 1580 between the aperture 1569 formed in the contact and the protrusion 1577. The geometry and features of the contact 1580, including but not limited to the protrusion 1577, push the conductor in a direction toward the shank of the fastener, thereby positioning the conductor underneath the head of the fastener when the fastener is being tightened in the terminal, and increasing the engagement level of the conductor in the terminal. The tab 1581 may position and secure the conductor in place, providing strain relief when the conductor is bent and allowing the conductor to hold more weight. More specifically, the contour of the first end 1583 of the tab 1581 provides space for the conductor to be inserted into the notch; and, the contour of the second end 1587 of the tab 1581 increases interference with the conductor, resulting in strain relief. The tab 1581 pushes the conductor into position while the head of the fastener directs the force to the terminal and clamps the conductor. Furthermore, the cut out 1681 formed in the contact 1580 allows the contact 1580 to bend downward, thereby creating a spring force and providing additional strain relief for the conductor.

In embodiments where the tab 1581 extends from the fourth side 1588 at a slight outward angle beyond ninety degrees, the tab 1581 may bend downward, thereby creating more spring force and providing additional strain relief for the conductor. Furthermore, as the conductor is pulled downward, the tab 1581 will absorb or decrease the force that would otherwise be acting on the conductor, resulting in additional strain relief for the portion of the conductor secured in the terminal.

Figure 14A:
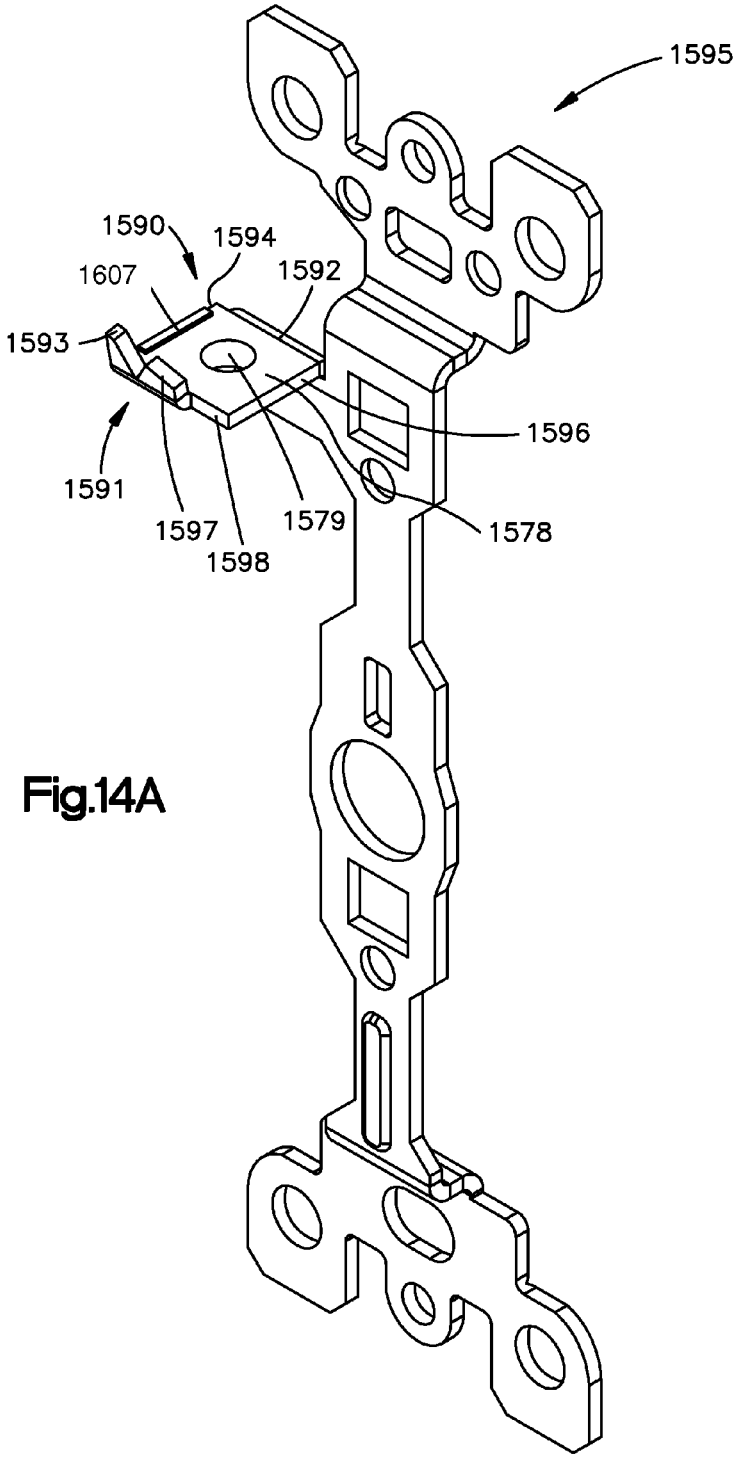
FIG. 14A is a perspective view of another exemplary embodiment of a mounting strap including a contact.
Figure 14C:
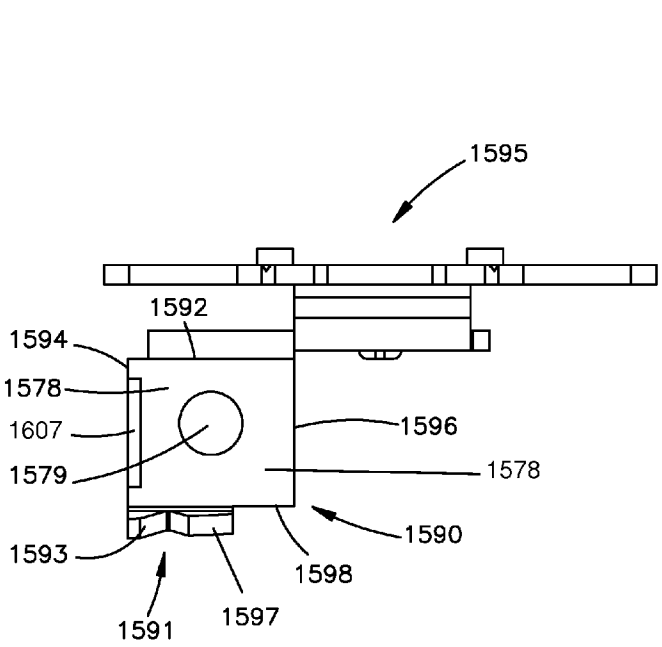
FIG. 14C is a top view of the mounting strap of FIGS. 14A-B.
Figure 14B:
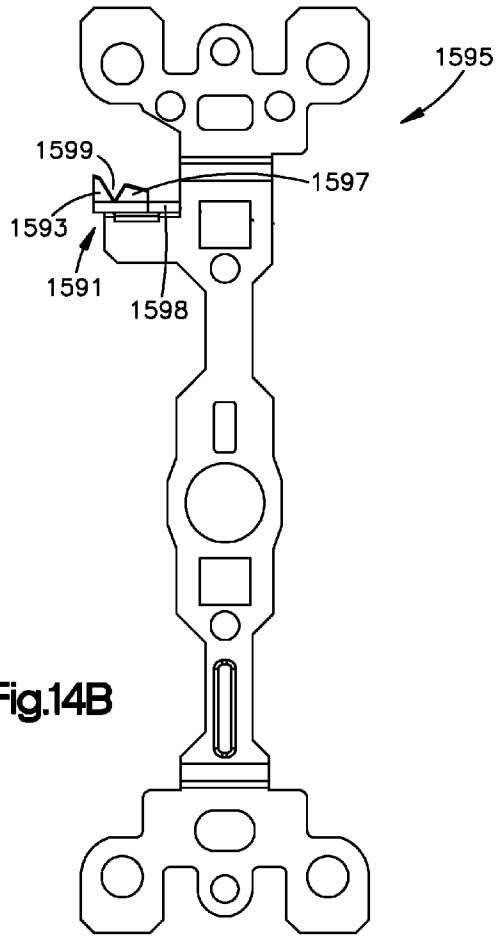
FIG. 14B is a front view of the mounting strap of FIG. 14A.

FIGS. 14A-C show another alternative exemplary embodiment of a mounting strap 1595 that is substantially similar to the mounting strap 5 illustrated in FIGS. 2A-D and discussed above, but for the following additional features. A contact 1590 may include a tab 1591 and a protrusion 1607. The tab 1591 may be positioned on the fourth side 1598 of the contact 1590 near the corner of the second side 1594 and the fourth side 1598 of the contact 1590. Preferably, a first end 1593 of the tab 1591 is substantially flush with the second side 1594 of the contact 1590. The tab 1591 may extend from the fourth side 1598 of the contact 1590 in a generally perpendicular direction with respect to the substantially planar surface 1578 of the contact. Preferably, the tab 1591 extends from the fourth side 1598 of the contact 1590 at a slight outward angle beyond ninety degrees. The tab 1591 may include a first end 1593 and a second end 1597. In addition, the tab 1591 may preferably include a notch or concave recess 1599 formed therein for receiving a conductor (not shown). The notch 1599 is positioned between the first and second ends 1593, 1597 of the tab 1591. The notch 1599 is preferably generally "V-shaped," and the first end 1593 and the second end 1597 may extend upward to a point, wherein the first end 1593 extends further than the second end 1597.

The contact 1590 may also include a protrusion 1607. The protrusion 1607 may be generally rectangular and may be positioned on a substantially planar surface 1578 of the contact 1590. More specifically, the protrusion 1607 resides on and extends from the substantially planar surface 1578 of the contact 1590, and one side of the protrusion is preferably substantially flush with the second side 1594 of the contact 1590, extending across the majority of the length of the second side 1594. The protrusion 1607 may extend upward in a generally perpendicular direction from the substantially planar surface 1578 of the contact 1590, and preferably has a substantially flat top surface.

In use, the mounting strap 1595 may be used in conjunction with a wiring device, such as but not limited to the wiring device 30 (see FIG. 2C). A fastener (not shown) may pass through the aperture 1579 formed in the contact 1590 and be tightened in the terminal. A conductor (not shown) may be engaged directly between the contact 1590 and a head of the fastener. The tab 1591 may be configured to place a conductor (not shown) in the notch 1599 and extend across the contact 1590 between the aperture 1567 formed in the contact and the protrusion 1607. The geometry and features of the contact 1590, including the tab 1591 and the protrusion 1607, push the conductor in a direction toward the shank of the fastener, thereby positioning the conductor underneath the head of the fastener when the fastener is being tightened in the terminal, and increasing the engagement level of the conductor in the terminal. The tab 1591 may position and secure the conductor in place, providing strain relief when the conductor is bent and allowing the conductor to hold more weight. More specifically, the contour of the notch 1599 formed in the tab 1591 pushes the conductor to position towards the shank of the fastener, while the head of the fastener directs the force to the terminal and clamps the conductor. In addition, the contour of the notch 1599 formed in the tab 1591 interferes with the conductor, resulting in strain relief. The tab 1591 is preferable for stranded conductors.

In embodiments where the tab 1591 extends from the fourth side 1598 at a slight outward angle beyond ninety degrees, the tab 1591 may bend downward, thereby creating a spring force and providing additional strain relief for the conductor. In addition, as the conductor is pulled downward, the tab 1591 will absorb or decrease the force that would otherwise be acting on the conductor, resulting in additional strain relief for the portion of the conductor secured in the terminal.

In the embodiments shown in FIGS. 3A-14C, it will be understood by one of ordinary skill in the art that a contact used in a terminal may include other features with various geometries to help engage and/or provide strain relief to a conductor engaged in a ground terminal directly between the fastener and the contact. In addition, it will be understood that the size of the features of the contacts (i.e. tabs, openings, notches, etc.) may be modified to compensate for different gauge conductors (i.e. 10#, 12#, 14#, etc.) and different types of conductors (i.e. solid, braided, etc.). Furthermore, the terminals shown in FIGS. 3A-14C are ground terminals; however, the embodiments described may be used in any type of terminal, including load terminals, line terminals, neutral terminals, etc.

Figure 15B:
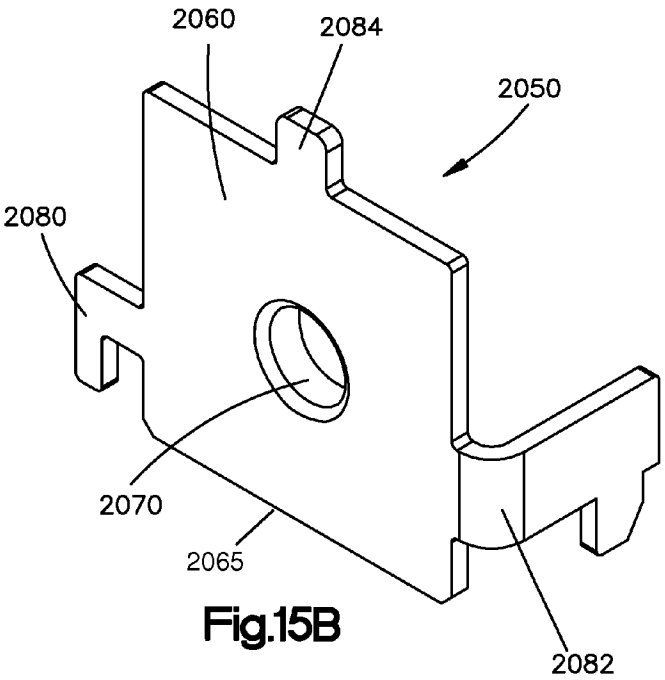
FIG. 15B is a perspective view of another exemplary embodiment of a contact.
Figure 15A:
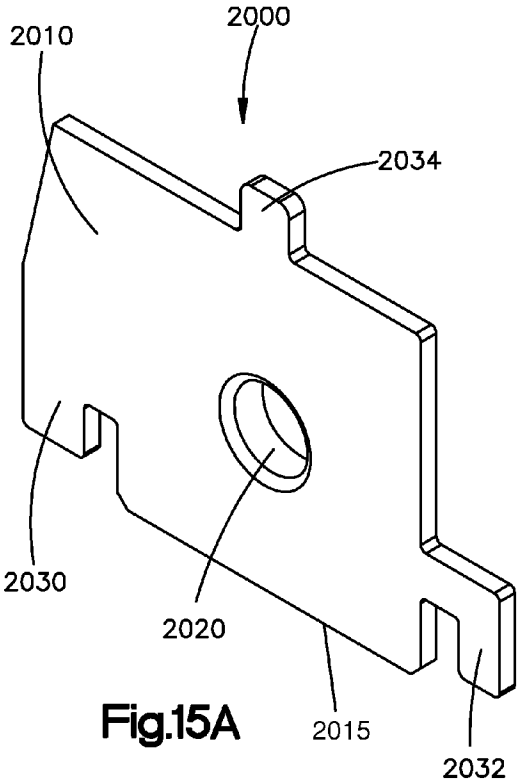
FIG. 15A is a perspective view of an exemplary embodiment of a contact.

A wiring device may include a side terminal. The side terminal may be either a load terminal or a neutral terminal. As shown in FIGS. 15A-B, the side terminal may include a contact, such as contact 2000 or contact 2050, to help engage a conductor in the respective terminal. The contact 2000, 2050 may include a substantially planar surface 2010, 2060, a side 2015, 2065, and an aperture 2020, 2070 formed therethrough that is configured to receive a fastener 2093. In some embodiments, the aperture 2020, 2070 may be threaded. It will be understood by one of ordinary skill in the art that the contact 2000, 2050 may have various arms, protrusions, or other features extending therefrom so that the contact appropriately aligns with other components of the wiring device. Examples may include but not limited, to, arms 2030, 2032, 2034 (see FIG. 15A), arms 2080, 2082, 2084 (see FIG. 15B), etc. These arms are shaped and located accordingly, depending on the location of the contact in the wiring device, the other wiring device components, etc., and do not impact what additional features may be included on the contact.

Figure 15D:
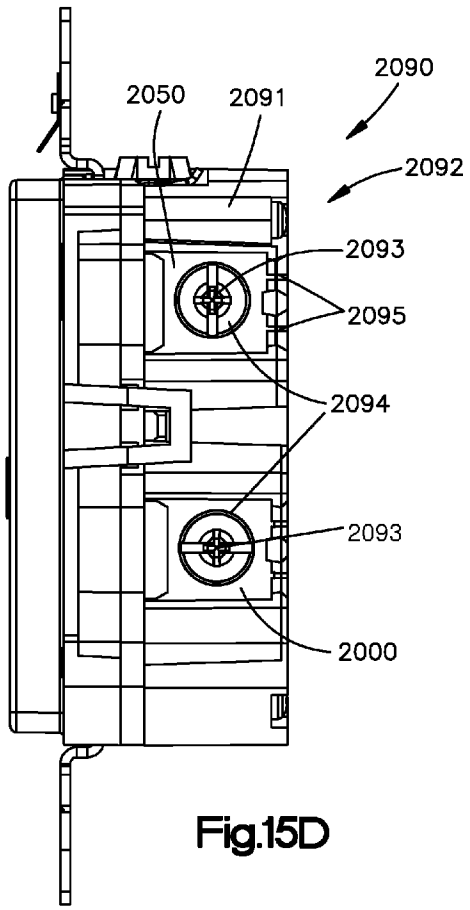
FIG. 15D is a side view of the wiring device of FIG. 15C.
Figure 15C:
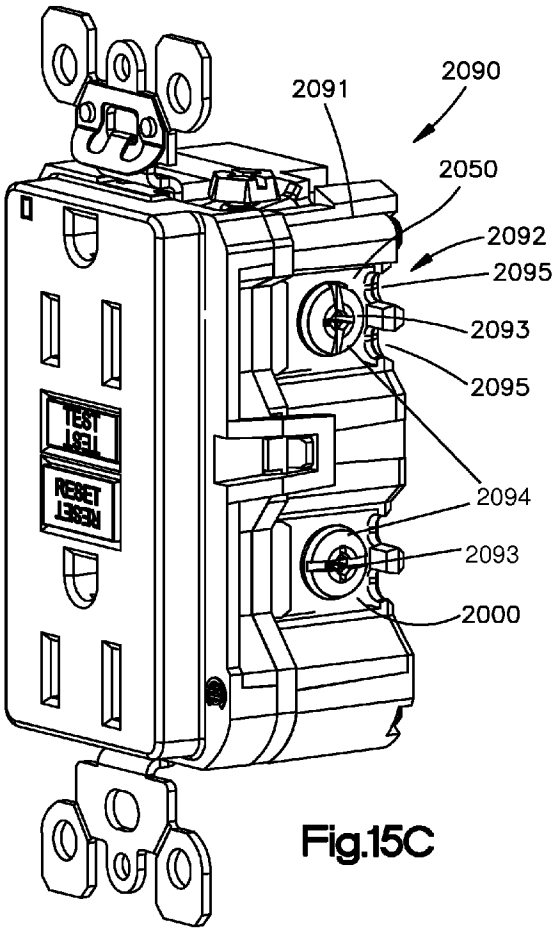
FIG. 15C is a perspective view of a wiring device including the contact of FIG. 15A and the contact of FIG. 15B.

In use, as shown in FIGS. 15C-D, the contact 2000, 2050 may be inserted into a wiring device 2090. The wiring device 2090 may include a body 2091 and a side terminal 2092, in which the terminal 2092 may include a contact (i.e. the contact 2000 or the contact 2050) and a fastener 2093. The fastener 2093 may preferably include a washer head 2094, and may pass through the respective aperture 2020, 2070 formed in the respective contact 2000, 2050. When the contact 2000, 2050 is inserted into the wiring device 2090, the side 2015, 2065 of the respective contact may be exposed.

The body 2091 of the wiring device 2090 may include one or more openings 2095 for a conductor (not shown) to be positioned within, and the conductor may also be positioned in the terminal 2092. It will be understood by one of ordinary skill in the art that in some embodiments, the body does not include the one or more openings.

The conductor preferably includes a bare portion, and may be positioned between the substantially planar surface 2010, 2060 of the respective contact 2000, 2050, and the washer head 2094 of the fastener 2093. When the fastener 2093 is tightened in the terminal, the conductor is engaged directly between the fastener 2093 and the respective contact 2000, 2050. A pressure plate is not required. As discussed in more detail in the exemplary embodiments, the contact may include various additional features that help engage and provide additional strain relief for the conductor connected to the terminal.

FIGS. 16A-D shows an exemplary embodiment of a contact 260 that is substantially similar to the contact 2000, 2050 illustrated in FIG. 15A-D and discussed above, but for the following additional features. The contact 260 may include a protrusion 270 formed on a substantially planar surface 265 of the contact 260. The protrusion 270 may be generally "U-shaped" and be positioned to partially surround the aperture 261 formed in the contact 260. In addition, the protrusion 270 may have rounded edges 271.

Figure 16B:
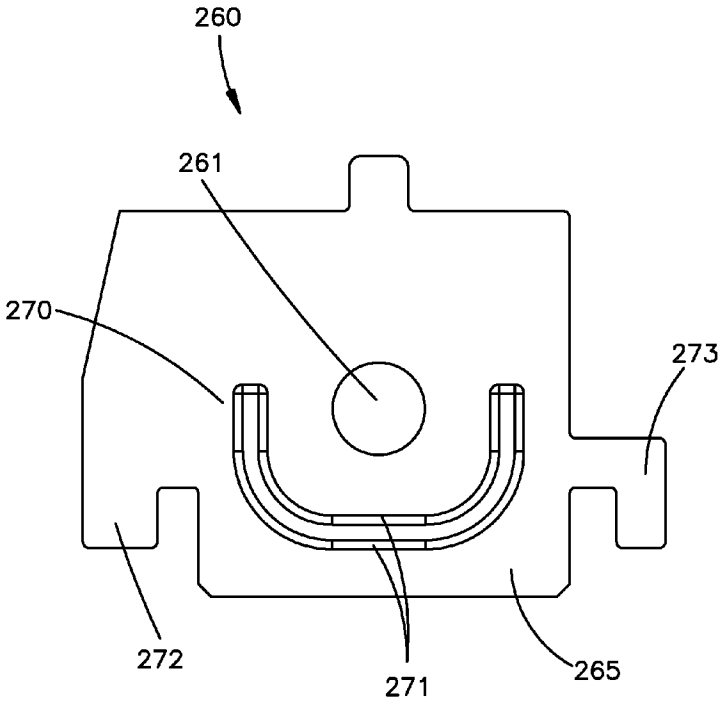
FIG. 16B is a top view of the contact of FIG. 16A.
Figure 16A:
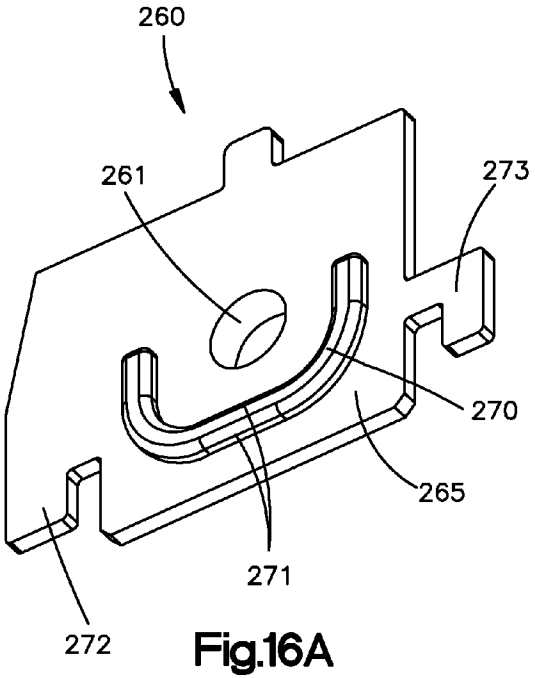
FIG. 16A is a perspective view of another exemplary embodiment of a contact.
Figure 16D:
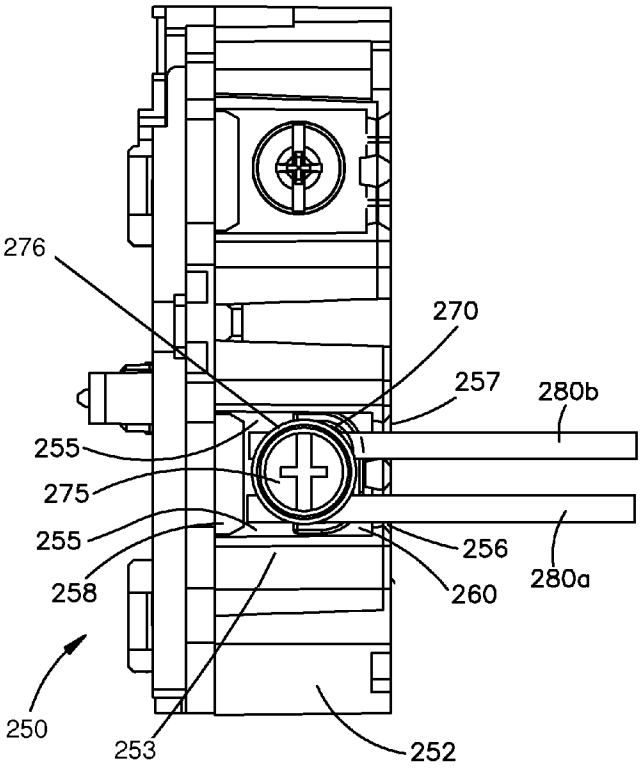
FIG. 16D is a side view of the wiring device of FIG. 16C.
Figure 16C:
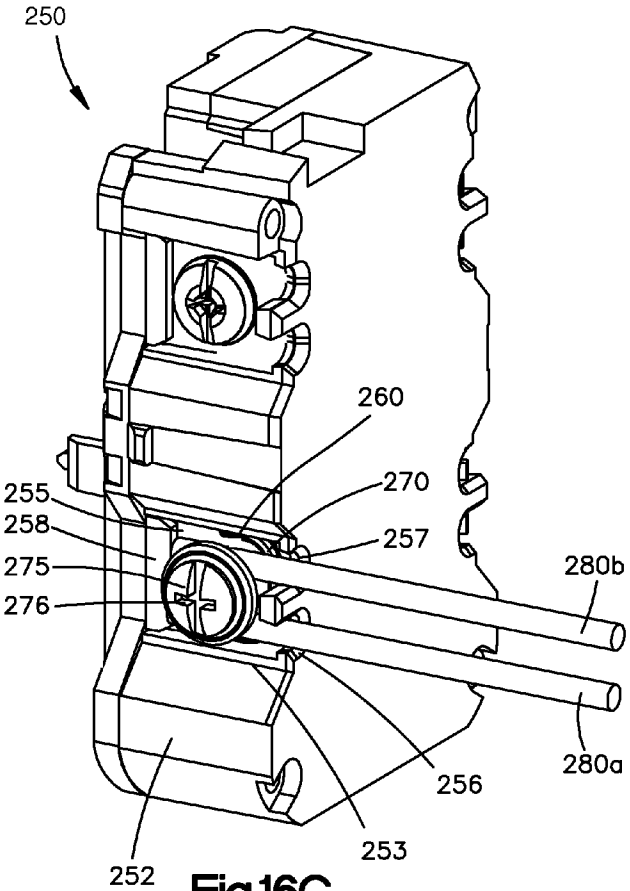
FIG. 16C is a perspective view of a wiring device including the contact of FIGS. 16A-B.

In use, as shown in FIGS. 16C-D, the contact 260 may be inserted into a wiring device 250. The wiring device 250 may include a body 252 and a side terminal 253. The terminal 253 may include the contact 260 and a fastener 275. The fastener 275 may preferably have a washer head 276, and may pass through the aperture 261 formed in the contact 260. One or more conductors 280*a*, 280*b* may be positioned on the substantially planar surface 265 of the contact 260 so that the one or more conductors are positioned on top of the protrusion 270. The fastener 275 may be tightened in the terminal 253 to engage the one or more conductors 280*a*, 280*b* directly between the contact 260 and the fastener 275, and more preferably between the protrusion 270 and the washer head 276. The one or more conductors 280*a*, 280*b* follows the contour of the rounded edges 271 of the protrusion 270, requiring more pull force to dissemble the conductor from the terminal than if the protrusion 270 was not present. As a result, the terminal 253 provides strain relief and securely holds the one or more conductors 280*a*, 280*b* in place without the use of a conventional pressure plate.

When the fastener is tightened in the terminal, the conductor is engaged directly between the contact and the head of the fastener. In some embodiments, a wedge, such as wedge 255 in FIGS. 16C-D, guides and positions the conductor so that a portion of the end of the conductor is positioned underneath a hood, such as hood 258 in FIGS. 16C-D. The hood 258 and wedge 255 help guide, position, and secure the one or more conductors 280*a*, 280*b* in the terminal. It will be understood by one of ordinary skill in the art that other embodiments as shown and described may include a wedge and a hood similar to the wedge 255 and the hood 258 shown in FIGS. 16C-D.

Figure 17B:
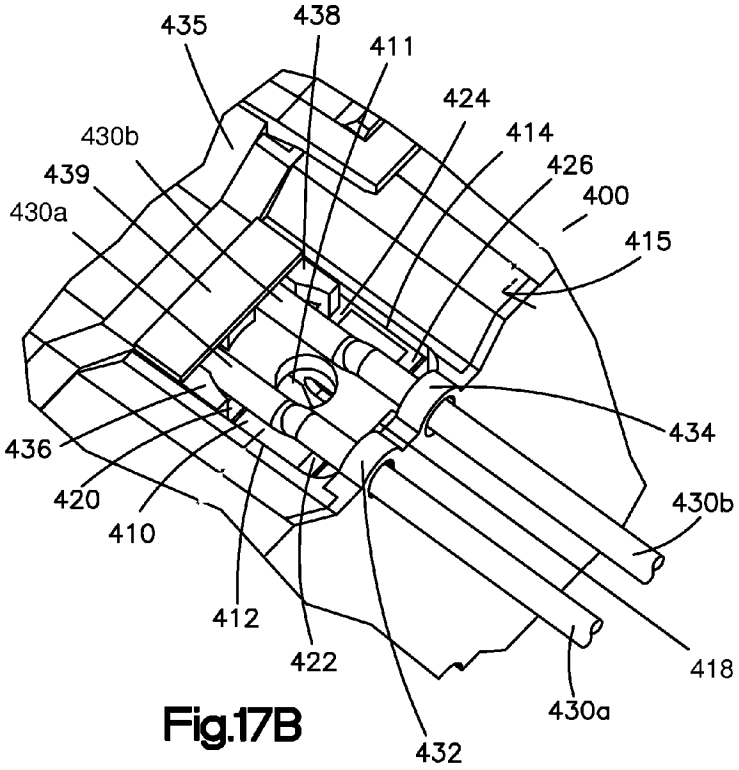
FIG. 17B is a perspective view of a wiring device terminal including the contact of FIG. 17A.
Figure 17A:
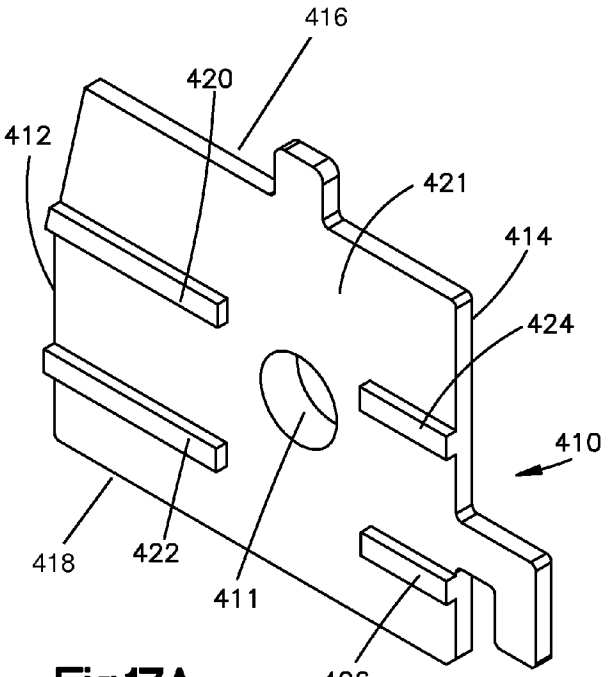
FIG. 17A is a perspective view of another exemplary embodiment of a contact.

FIGS. 17A-B shows an alternative exemplary embodiment of a contact 410 that is substantially similar to the contact 2000, 2050 illustrated in FIG. 15A-D and discussed above, but for the following additional features. The contact 410 may include a plurality of protrusions 420, 422, 424, 426 that extend from a substantially planar surface 421 of the contact 40. Preferably, the first and second protrusions 420, 422 are substantially flush with a first side 412 of the contact 410 and extend towards the middle of the contact 410, while third and fourth protrusions 424, 426 are substantially flush with a second side 414 of the contact 410 and extend towards the middle of the contact 410. The plurality of protrusions 420, 422, 424, 426 are preferably substantially parallel to one another and to the third and fourth sides 416, 418 of the contact 410.

In use, as shown in FIG. 17B, the contact 410 may be inserted into a wiring device 400. The wiring device 400 may include a body 435 and a terminal 415, wherein the terminal 415 may include the contact 410 and a fastener (not shown). The fastener may preferably include a washer head, and may pass through the aperture 411 formed in the contact 410. In addition, the terminal 415 may include clasps 432, 434, wedges 436, 438, and a hood 439. The clasps 432, 434 are configured for one or more conductors 430*a*, 430*b* to pass through. One or more conductors 430*a*, 430*b* may pass through the respective clasp 432, 434 and extend across the substantially planar surface 421 of the contact 410 between the aperture 411 formed in the contact and the respective first and second sides 412, 414 of the contact 410. An end of the one or more conductors 430*a*, 430*b* may be placed under the hood 439 and contact the wedges 436, 438. When the fastener is tightened in the terminal 415, the one or more conductors 430*a*, 430*b* engage directly between the fastener and the contact 410 so that the conductor 430*a* is in contact with the first and second protrusions 420, 422, and/or a conductor 430*b* is in contact with the third and fourth protrusions 424, 426. The fastener may be tightened in the terminal so that the one or more conductors 430*a*, 430*b* are engaged directly between the fastener and the contact 410. The plurality of protrusions 420, 422, 424, 426 create friction between the contact 410 and the respective conductor, requiring more pull forces to separate the one or more conductors from the terminal 415. The clasps 432, 434, wedges 436, 438, and hood 439 are configured to guide and position the one or more conductors 430*a*, 430*b* while the fastener is being tightened.

Figure 18C:
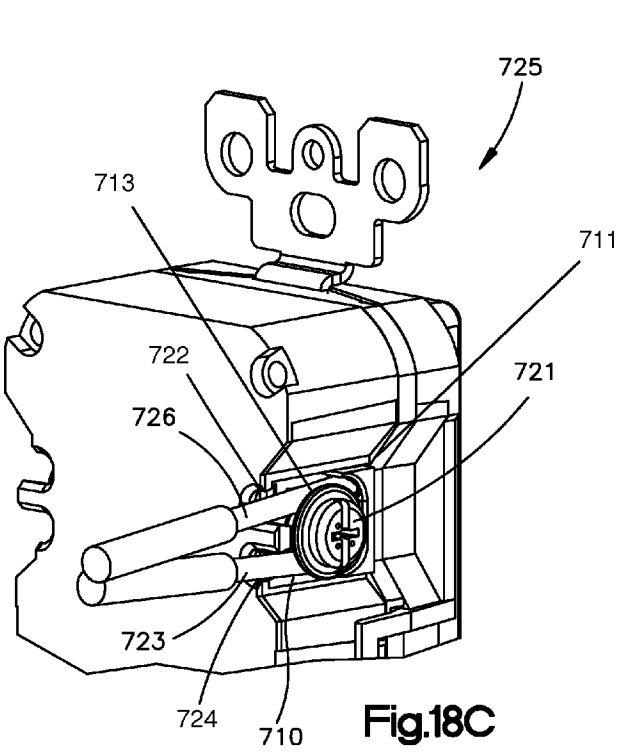
FIG. 18C is a partial perspective view of a wiring device including the contact of FIGS. 18A-B.
Figure 18A:
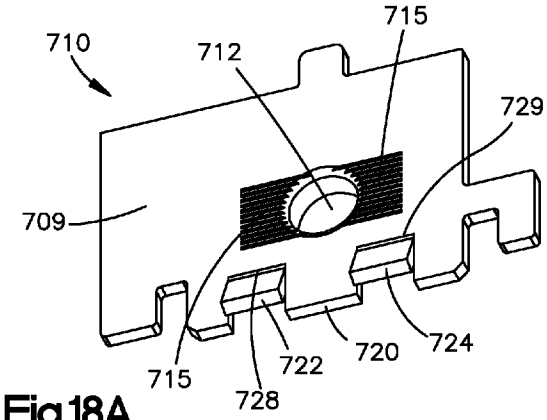
FIG. 18A is a perspective view of another exemplary embodiment of a contact.
Figure 18B:
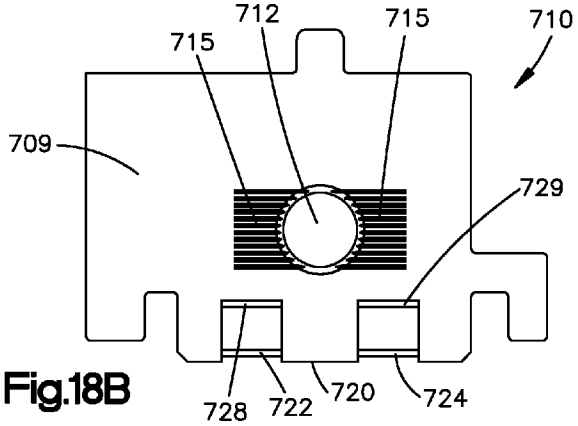
FIG. 18B is a top view of the contact of FIG. 18A.

FIGS. 18A-B shows an exemplary embodiment of a contact 710 that is substantially similar to the contact 2000, 2050 illustrated in FIG. 15A-D and discussed above, but for the following additional features. The contact 710 may include first and second protrusions 722, 724. The first and second protrusions 722, 724 are spaced a distance apart and flush with a side 720 of the contact 710. Each of the first and second protrusions 722, 724 may preferably include a respective hinge 728, 729 arranged and configured on an inner portion of the contact 710. More preferably, the hinge 728, 729 is a living hinge. The first and second protrusions 722, 724 may be configured to spring upward. The contact 710 may also include a substantially planar surface 709 having an optional plurality of ridges or serrations 715, extending across at least a portion of the substantially planar surface 709.

In use, as shown in FIG. 18C, the contact 710 may be inserted into a wiring device 725. The contact 710 may be positioned in a terminal 711, and a fastener 721 may pass through the aperture 712 formed in the contact 710. One or more conductors 723, 726 may be positioned on the substantially planar surface 709 of the contact 710 so that a conductor 726 may be in contact with the first protrusion 722. In addition, a conductor 723 may be in contact with the second protrusion 724. Preferably, the one or more conductors 723, 726 may also be in contact with the optional plurality of ridges 715. The fastener 721 may be tightened in the terminal 711 so that the one or more conductors 723, 726 is engaged directly between the head 713 of the fastener 721 and the contact 710. More specifically, as the fastener 721 is being tightened in the terminal 711, the head 713 of the fastener 721 will push the conductor 723 towards the second protrusion 724 and push the conductor 726 towards the first protrusion 722. The first and second protrusions 722, 724 push the respective conductors 723, 726 upward, providing strain relief for the one or more conductors 723, 726 and preventing the one or more conductors 723, 726 from pulling out of the terminal 711. The more force that the head 713 of the fastener 721 puts on the one or more conductors 723, 726, the more strain relief there will be. The first and second protrusions 722, 724 may be adjusted according to the gauge (i.e. 10#, 12#, 14#, etc.) of the one or more conductors 723, 726. In addition, the conductors 723, 726 may be of different gauges, which may be secured in the same terminal at the same time. The respective protrusion will adjust according to the gauge of the respective conductor. The larger the conductor, the more the protrusion on the contact will bend downward. Furthermore, the optional plurality of ridges 715 creates friction to help engage the one or more conductors 723, 726 in the terminal 711.

Figure 19B:
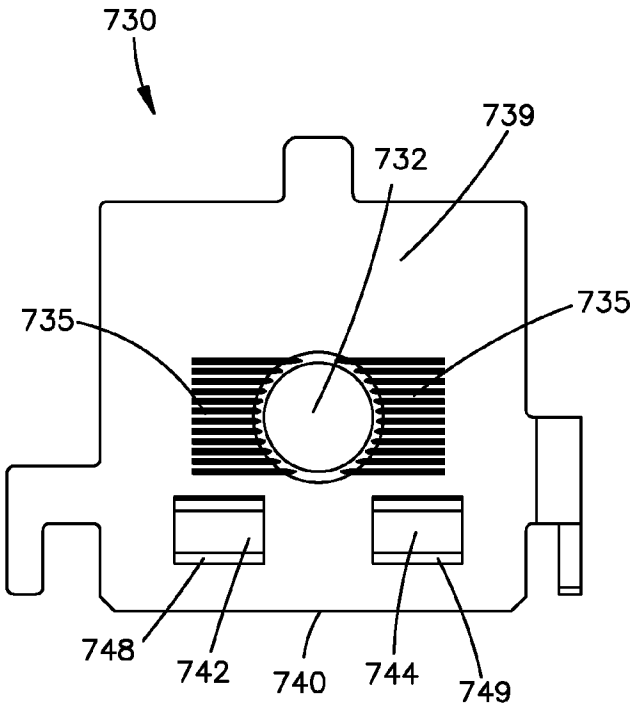
FIG. 19B is a top view of the contact of FIG. 19A.
Figure 19A:
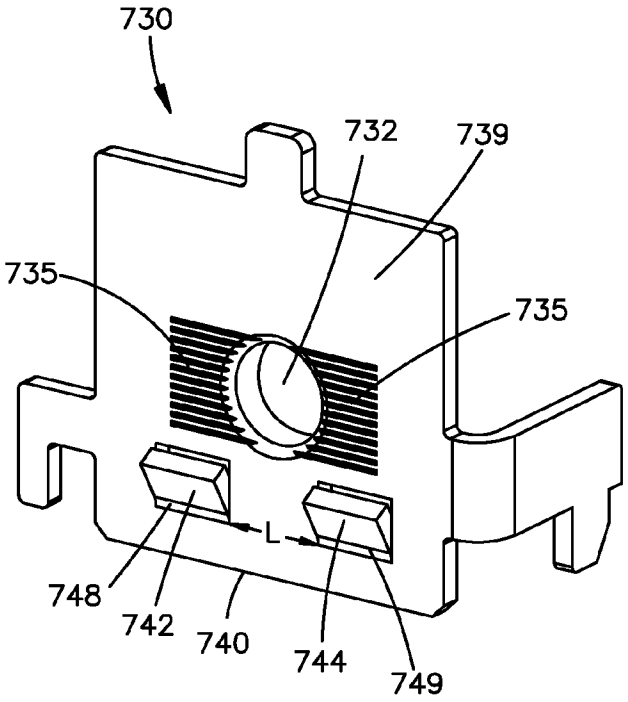
FIG. 19A is a perspective view of another exemplary embodiment of a contact.
Figure 19C:
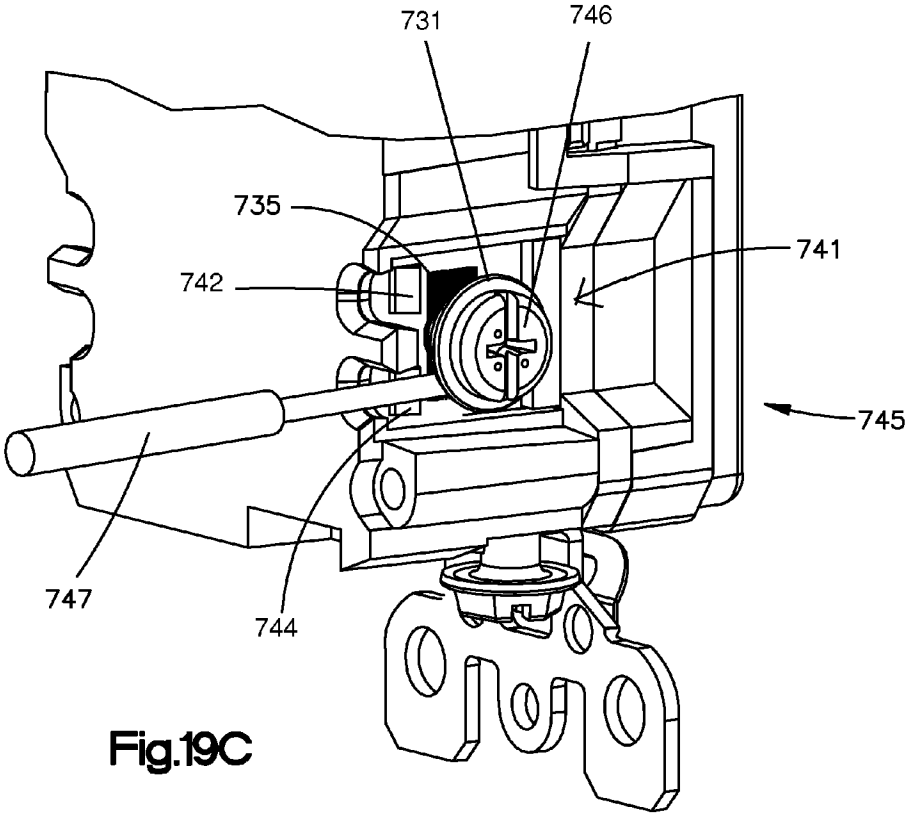
FIG. 19C is a partial perspective view of a wiring device including the contact of FIGS. 19A-B.

FIGS. 19A-C shows an alternate exemplary embodiment of a contact 730 that is substantially similar to the contact 2000, 2050 illustrated in FIGS. 15A-D and discussed above, but for the following additional features. The contact 730 may include a substantially planar surface 739 and first and second protrusions 742, 744. The first and second protrusions 742, 744 are spaced a distance "L" apart and offset from a side 740 of the contact 730. The first and second protrusions 742, 744 may preferably each include a respective hinge 748, 749, wherein the hinges 748, 749 are parallel to the side 740 and offset from the side 740. More preferably, the hinge 748, 749 is a living hinge. The first and second protrusions 742, 744 may be configured to spring upward towards the side 740 of the contact 730. The substantially planar surface 739 of the contact 730 may include optional plurality of ridges 735, extending across at least a portion of the substantially planar surface 739.

In use, as shown in FIG. 19C, the contact 730 may be used in conjunction with a wiring device 745. The contact 730 may be positioned in a terminal 741 and a fastener 746 may pass through the aperture 732 formed in the contact 730. A conductor 747 may be positioned on the substantially planar surface 739 of the contact 730 so that the conductor 747 may be in contact with the second protrusion 744. In addition, a conductor, such as but not limited to the conductor 747, may be in contact with the first protrusion 742. Preferably, the one or more conductors may also be in contact with the optional plurality of ridges 735. The fastener 746 may be tightened in the terminal 741 so that the one or more conductors is engaged directly between the head 731 of the fastener 746 and the contact 730. More specifically, as the fastener 746 is being tightened in the terminal 741, the head 731 of the fastener 746 will push the conductor (not shown) towards the first protrusion 742 and push the conductor 747 towards the second protrusion 744. The first and second protrusions 742, 744 push the respective one or more conductors upward, providing strain relief for the one or more conductors 747 and preventing the one or more conductors from pulling out of the terminal 741. The more force that the head 731 of the fastener 746 puts on the one or more conductors, the more strain relief there will be. The first and second protrusions 742, 744 may be adjusted according to the gauge (i.e. 10#, 12#, 14#, etc.) of the one or more conductors. In addition, the one or more conductors may be of different gauges, which may be secured in the same terminal at the same time. The respective protrusion will adjust its position according to the gauge of the respective conductor. The larger the conductor, the greater the protrusion on the contact will bend downward. Furthermore, the optional plurality of ridges 735 creates friction to help secure the one or more conductors in the terminal.

It should be noted that assuming all else is the same between the embodiments shown in FIGS. 18A-C and FIGS. 19A-C, the first and second protrusions 742, 744 in the embodiment shown in FIGS. 19A-C may be stiffer during assembly of the terminal than the first and second protrusions 722, 724 in the embodiment shown in FIGS. 18A-C, as the first and second protrusions 742, 744 are offset from the side 740 and the first and second protrusions 722, 724 are flush with the side 720.

Figure 20B:
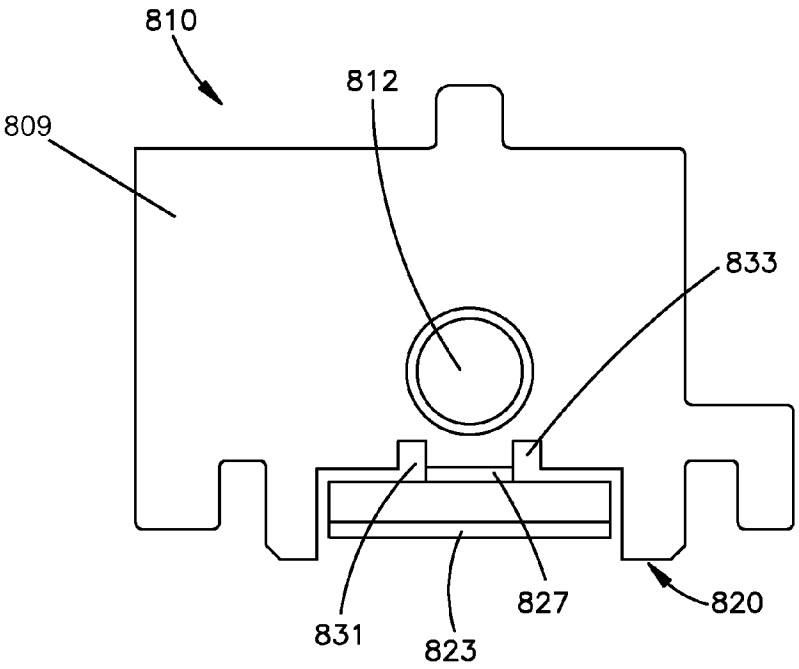
FIG. 20B is a top view of the contact of FIG. 20A.
Figure 20A:
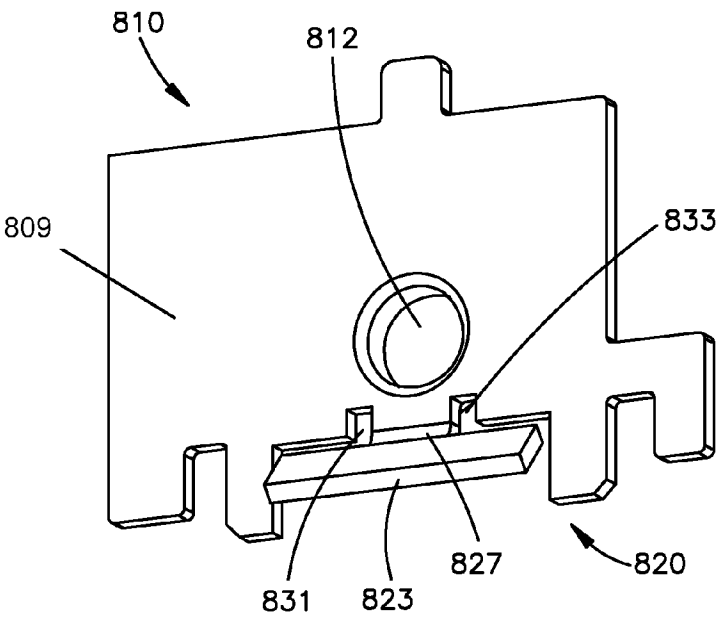
FIG. 20A is a perspective view of another exemplary embodiment of a contact.

FIGS. 20A-B shows an alternate exemplary embodiment of a contact 810 that is substantially similar to the contact 2000, 2050 illustrated in FIGS. 15A-D and discussed above, but for the following additional features. The contact 810 may include a protrusion 823. The protrusion 823 may be positioned so that the protrusion is flush with a side 820 of the contact 810. Preferably, the protrusion 823 may extend across a majority of the length of the side 820 of the contact 810. The protrusion 823 may include a hinge 827 having a plurality of notches 831, 833 to support the protrusion 823 on the hinge 827. More preferably, the hinge 827 is a living hinge. The protrusion 823 may be configured to spring upward.

In use, the contact 810 may be inserted into a wiring device, such as but not limited to, the wiring device 2090 (see FIG. 15C). When a terminal is assembled, the contact 810 may be positioned in a terminal and a fastener may pass through the aperture 812 formed in the contact 810. One or more conductors (not shown) may be positioned on the substantially planar surface 809 of the contact 810 so that the one or more conductors is in contact with the protrusion 823. The fastener may be tightened in the terminal so that the one or more conductors are engaged directly between the head of the fastener and the contact 810. More specifically, as the fastener is being tightened in the terminal, the head of the fastener will push the one or more conductor towards the protrusion 823. The protrusion 823 may push the one or more conductors upward, providing strain relief for the one or more conductors and preventing the one or more conductors from pulling out of the terminal. The plurality of notches 831, 833 help maintain steady spring force. The more force that the head of the fastener puts on the conductors, the more strain relief there will be for the one or more conductors. The protrusion 823 may be adjusted according to the gauge (i.e. 10#, 12#, 14#, etc.) of the one or more conductors. The larger the conductor, the greater the protrusion on the contact will bend downward. In addition, the one or more conductors may be of different gauges, which may be secured in the same terminal at the same time. The protrusion will adjust according to the gauge of the conductors.

It should also be noted that in the embodiment shown in FIGS. 20A-B, the contact 810 does not include a plurality of ridges across the surface of the contact; however, it will be understood by one of ordinary skill that a plurality of ridges may be included on the contact 810 in a similar fashion to the plurality of ridges 715 illustrated in FIGS. 19A-B. As such, including a plurality of ridges on at least a portion of the contact 810 will create more friction and help engage the conductor between the contact 810 and a fastener.

Figure 21B:
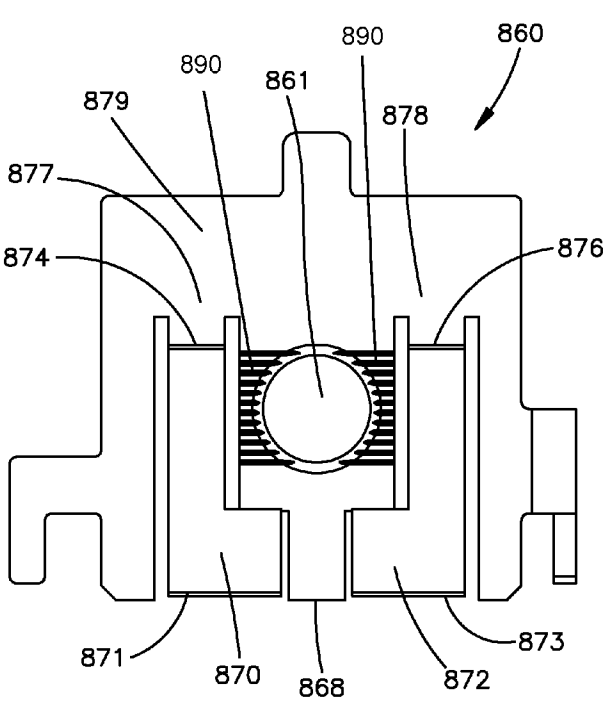
FIG. 21B is a top view of the contact of FIG. 21A.
Figure 21A:
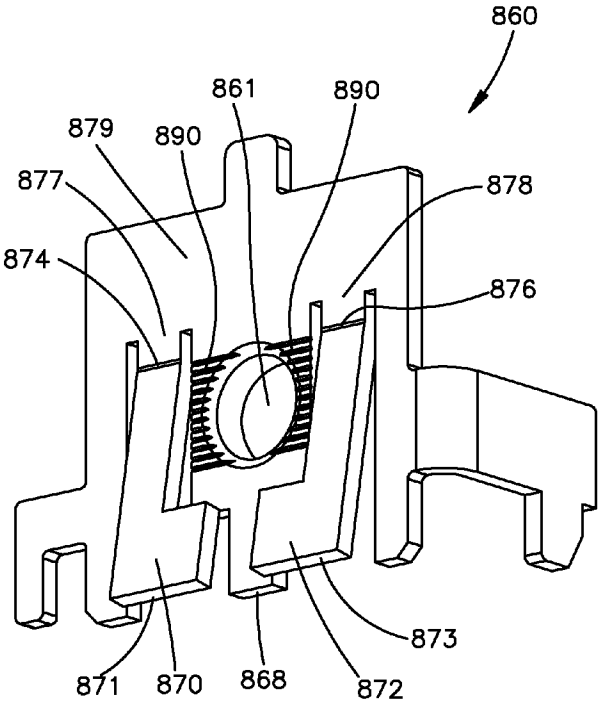
FIG. 21A is a perspective view of another exemplary embodiment of a contact.

FIGS. 21A-B shows an alternate exemplary embodiment of a contact 860 that is substantially similar to the contact 2000, 2050 illustrated in FIG. 15A-D and discussed above, but for the following additional features. The contact 860 may include a first protrusion 870 and a second protrusion 872. Preferably, the first and second protrusions 870, 872 are "L-shaped." The first and second protrusions 870, 872 may preferably each include a respective first end 871, 873 that is flush with a side 868 of the contact 860, and a respective second end 877, 878 having a respective hinge 874, 876 positioned on an inner portion of the contact 860. The first protrusion 870 may be positioned on one side of the aperture 861 formed in the contact 860, and the second protrusion 872 may be positioned on an opposite side of the aperture 861 formed in the contact 860. Preferably, the second protrusion 872 is a mirror image of the first protrusion 870. The first and second protrusions 870, 872 hinge from the second end 877, 878, and may be pulled or sprung upward from the side 868 of the contact 860. The contact 860 may also include an optional plurality of ridges 890 extending across at least a portion of a substantially planar surface 879 of the contact 860 between the first protrusion 870 and the aperture 861 formed in the contact, and between the aperture 861 formed in the contact and the second protrusion 872. Preferably, the optional plurality of ridges 890 extend across at least a portion of the substantially planar surface 879 so that the ridges extend across at least the same length of the contact as the diameter of the aperture 861.

Figure 21C:
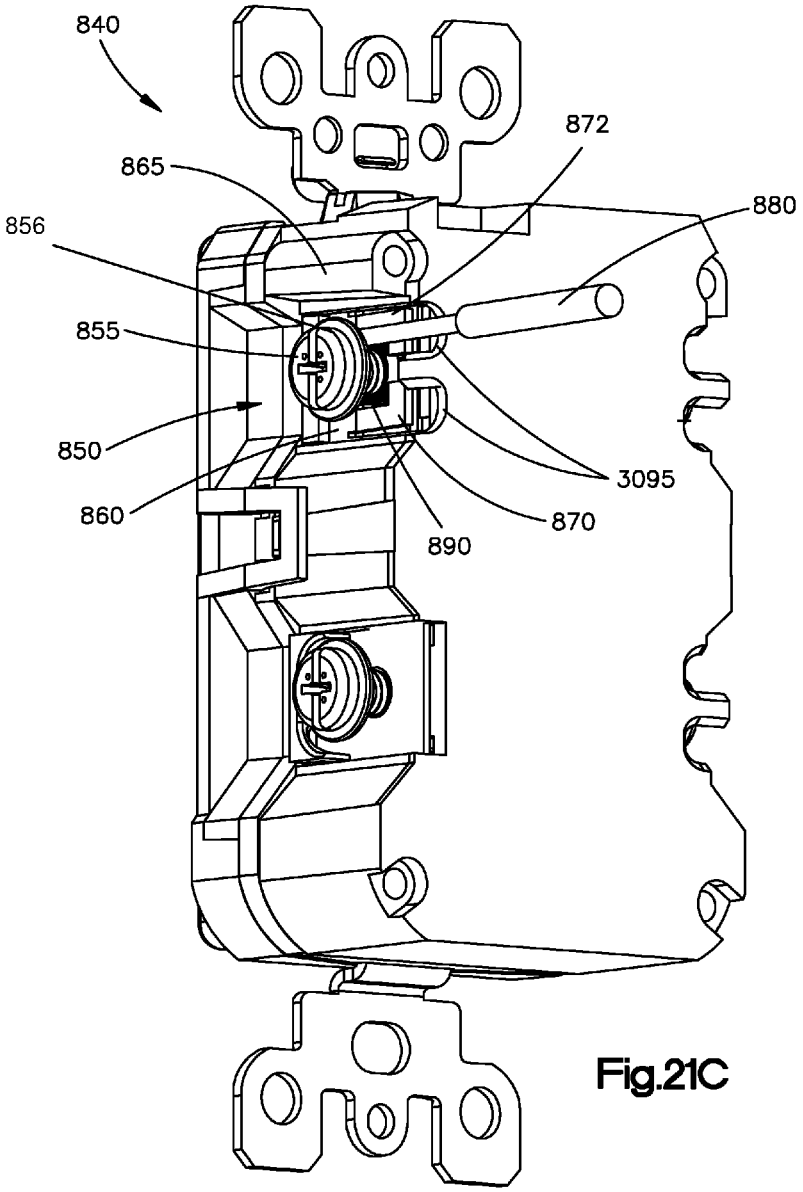
FIG. 21C is a perspective view of a wiring device including the contact shown in FIGS. 21A-B.

In use, as shown in FIG. 21C, the contact 860 may be used in conjunction with a wiring device 840. The contact 860 may be positioned in a terminal 850 and a fastener 855 may pass through the aperture 861 formed in the contact 860. One or more conductors such as but not limited to a conductor 880, may be positioned on the substantially planar surface 879 of the contact 860 so that the conductor is in contact with the first protrusion 870. In addition, a conductor, such as but not limited to the conductor 880, may be positioned so that it is in contact with the second protrusion 872. Preferably, the conductor(s) may also be in contact with the optional plurality of ridges 890. The fastener 855 may be tightened in the terminal 850 so that the one or more conductors 880 are engaged directly between the head 856 of the fastener 855 and the contact 860. As the fastener 855 is tightened in the terminal 850, the head of the fastener 855 will push the conductor 880 towards the first protrusion 870 as well as a conductor (not shown) towards the second protrusion 872. The first and second protrusions 870, 872 push the respective one or more conductors upward, providing strain relief for the one or more conductors and preventing the one or more conductors from pulling out of the terminal. The more force that the head of the fastener puts on the conductors, the more strain relief there will be. The first and second protrusions 870, 872 may be adjusted according to the gauge (i.e. 10#, 12#, 14#, etc.) of the one or more conductors. In addition, the one or more conductors may be of different gauges, which may be secured in the same terminal at the same time. The respective protrusion will adjust according to the gauge of the respective conductor. The larger the conductor, the greater the protrusion on the contact will bend downward. Furthermore, the plurality of ridges 890 provides additional friction between the contact 860 and the one or more conductors 880, which helps engage the one or more conductors 880 in the terminal. In addition, the body 865 of the wiring device 840 may include one or more openings 3095 for a conductor 880 to be positioned, and the conductor may be positioned in the terminal 850.

Figure 22B:
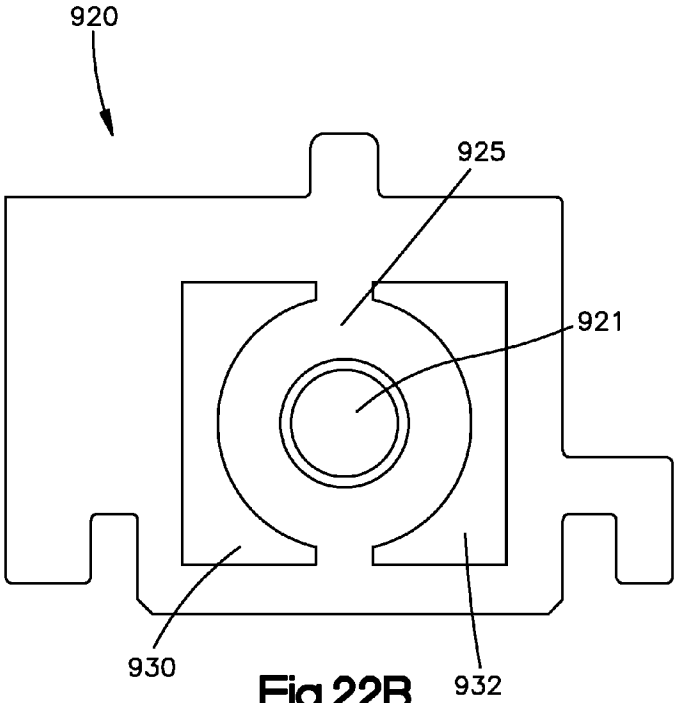
FIG. 22B is a top view of the contact of FIG. 22A.
Figure 22A:
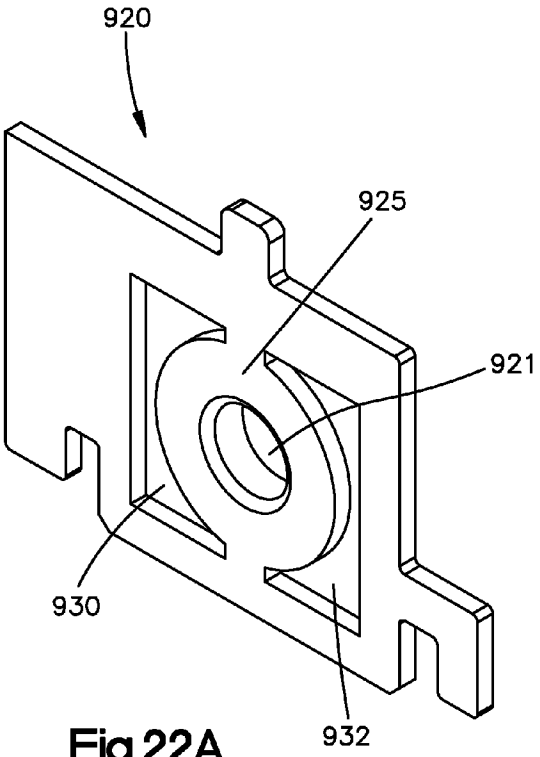
FIG. 22A is a perspective view of another exemplary embodiment of a contact.

FIGS. 22A-B shows an exemplary embodiment of a contact 920 that is substantially similar to the contact 2000, 2050 illustrated in FIGS. 15A-D and discussed above, but for the following additional features. The contact 920 may include first and second cut outs 930, 932 formed therethrough. The first cut out 930 may be positioned on one side of the aperture 921 formed in the contact 920 and the second cut out 932 may be positioned on another side of the aperture 921 formed in the contact 920. Preferably, the first and second cut outs 930, 932 are mirror images of one another. The first and second cut outs 930, 932 form a generally square or rectangular-type section in the contact 920, and the material between the aperture 921 and the first and second cut outs 930, 932 forms a generally circular section 925 in the contact 920.

Figure 22C:
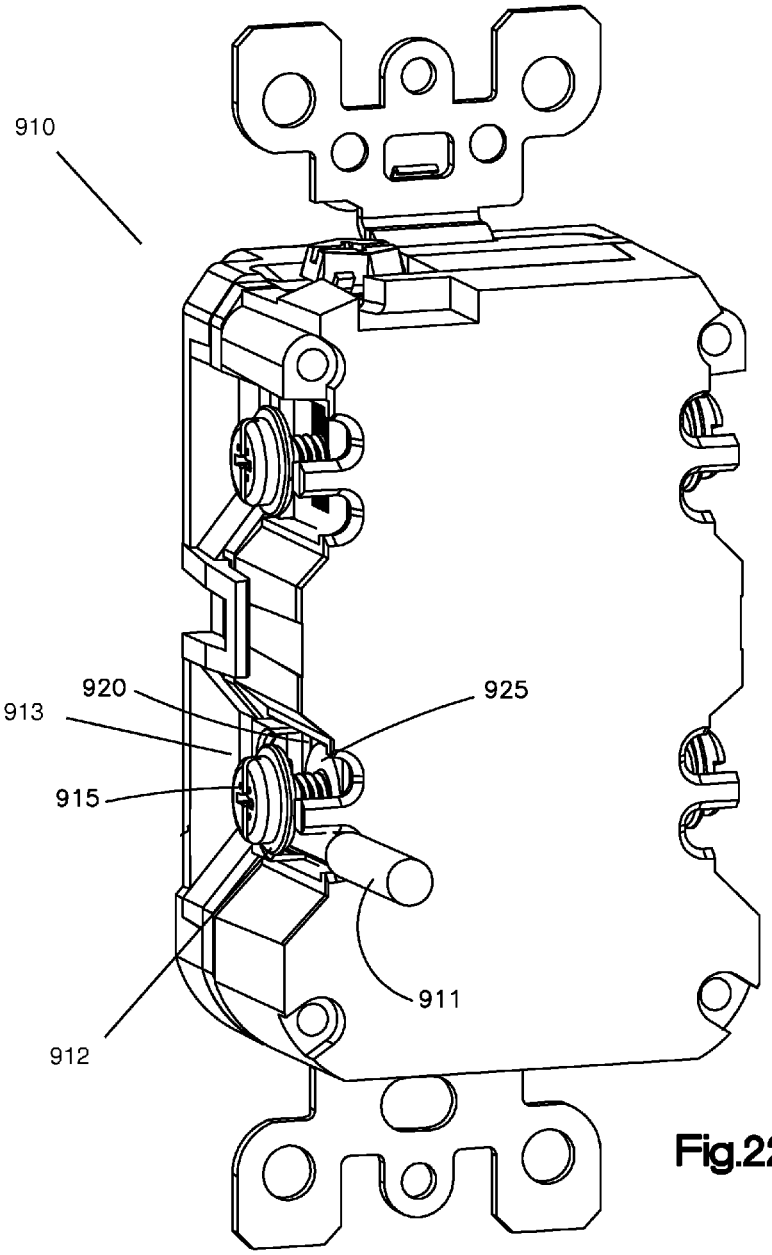
FIG. 22C is a perspective view of a wiring device including the contact of FIGS. 22A-B.

In use, as shown in FIG. 22C, the contact 920 may be inserted into a wiring device 910. A fastener 915 may pass through the aperture 921 formed in the contact 920. One or more conductors 911 may be engaged directly between the head 912 of the fastener 915 and the contact 920. The configuration of the aperture 921 formed in the contact, the circular section 925, and the first and second cut outs 930, 932 formed in the contact 920 allow the contact 920 to deform or bend accordingly. More specifically, when the fastener is being tightened in the terminal 913, the one or more conductors 911 contacts the circular section 925, and the force of reaction from this contact bends or deforms the circular section 925. This bend or deformation of the circular section 925 of the contact 920 provides strain relief for the one or more conductors because the one or more conductors are forced to push towards the contact 920.

Figure 23B:
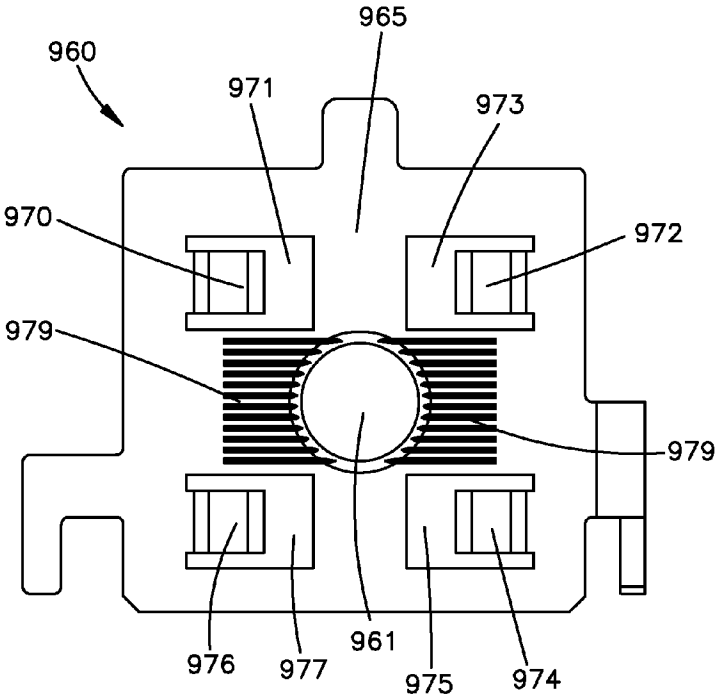
FIG. 23B is a top view of the contact of FIG. 23A.
Figure 23A:
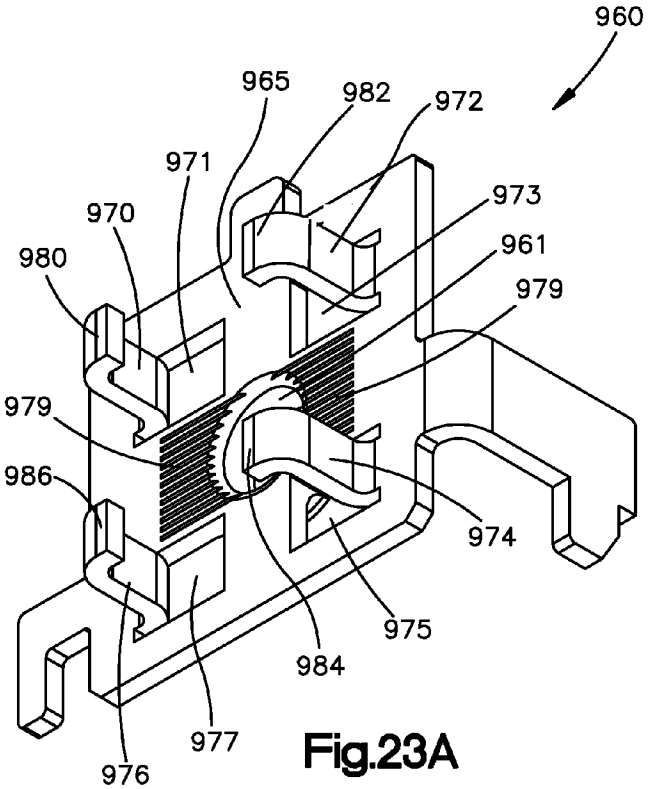
FIG. 23A is a perspective view of another exemplary embodiment of a contact.
Figure 23C:
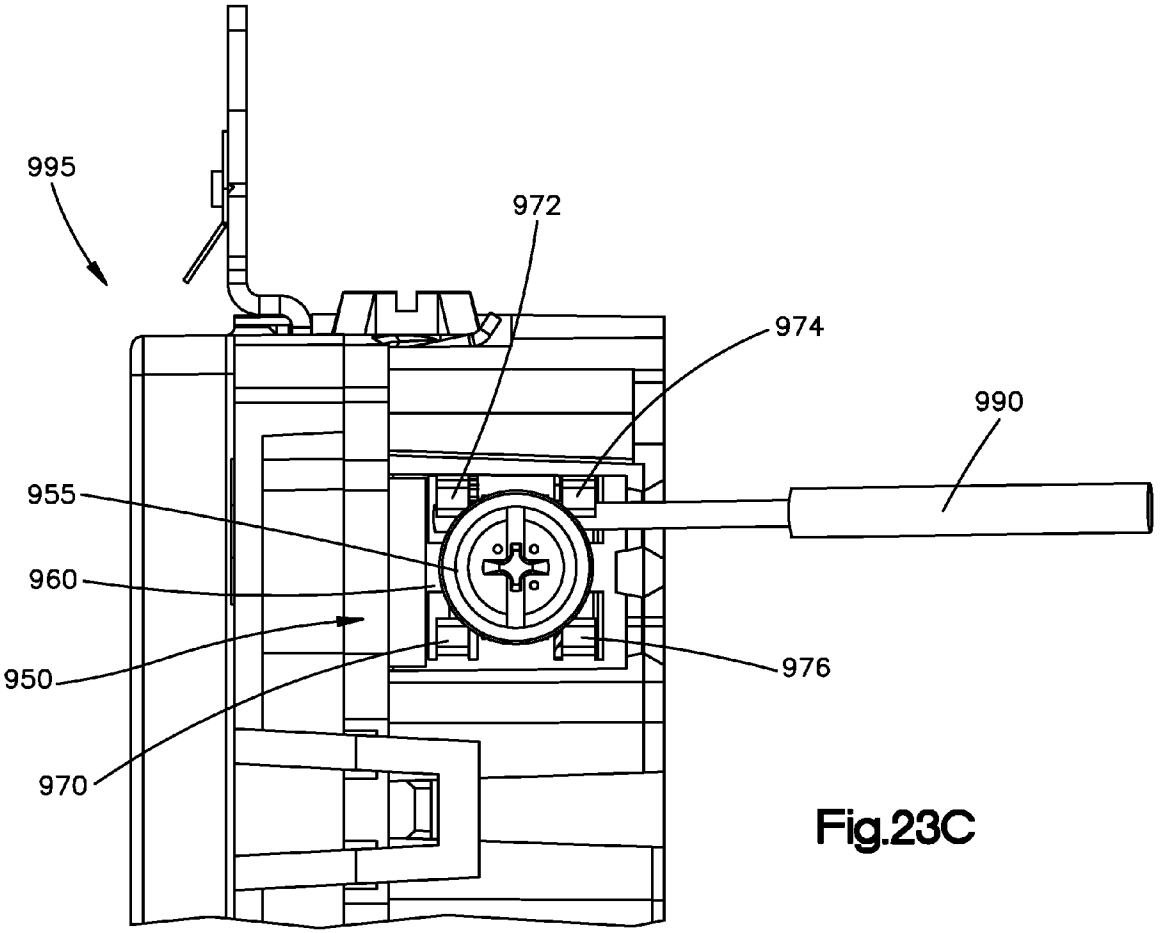
FIG. 23C is a partial side view of a wiring device including the contact of FIGS. 23A-B.

FIGS. 23A-C shows an exemplary embodiment of a contact 960 that is substantially similar to the contact 2000, 2050 illustrated in FIGS. 15A-D and discussed above, but for the following additional features. The contact 960 may include a plurality of protrusions 970, 972, 974, 976. The plurality of protrusions 970, 972, 974, 976 may extend upward from a substantially planar surface 965 of the contact 960. Preferably, each of the protrusions of the plurality of protrusions 970, 972, 974, 976 bow inward and may include curved portions 980, 982, 984, 986, respectively. A plurality of openings 971, 973, 975, 977 extend through the contact 960 adjacent to and on an inner side of the plurality of protrusions 970, 972, 974, 976, respectively. Thus, the curved portions 980, 982, 984, 986 of the respective protrusions 970, 972, 974, 976 overhang the respective openings 971, 973, 975, 977. An optional plurality of ridges 979 may extend across at least a portion of the substantially planar surface 965 between the plurality of protrusions 970, 972, 974, 976 and the aperture 961 formed in the contact.

In use, as shown in FIG. 23C, the contact 960 may be used in conjunction with a wiring device 995. The contact 960 may be positioned in a terminal 950 and a fastener 955 may pass through the aperture 961 formed in the contact 960. One or more conductors 990 may be positioned and engaged between the fastener 955 and the contact 960. More specifically, a conductor (not shown) may be positioned on the contact 960 under the protrusions 970 and 976, and a conductor 990 may be positioned on the contact 960 under the protrusions 972 and 974. Thus, one conductor may be positioned on top of the openings 971 and 977, and the conductor 990 may be positioned on top of the openings 973 and 975. While the fastener 955 is tightened in the terminal 950, the plurality of protrusions 970, 972, 974, 976 help guide and push the one or more conductors 990 towards the body or shank of the fastener 955. When the terminal 950 is assembled, the plurality of protrusions 970, 972, 974, 976 and the fastener 955 engage the one or more conductors 990 in the terminal. The plurality of protrusions 970, 972, 974, 976 are particularly helpful in trapping and engaging stranded conductors. In alternative embodiments, the fastener 955 may contact the top surfaces of the plurality of protrusions 970, 972, 974, 976, pushing the plurality of protrusions downward.

Figure 24B:
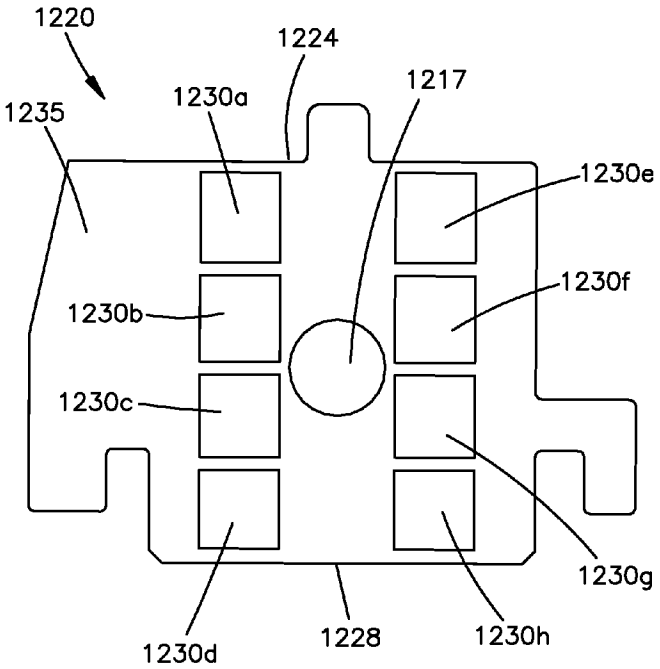
FIG. 24B is a top view of the contact of FIG. 24A.
Figure 24A:
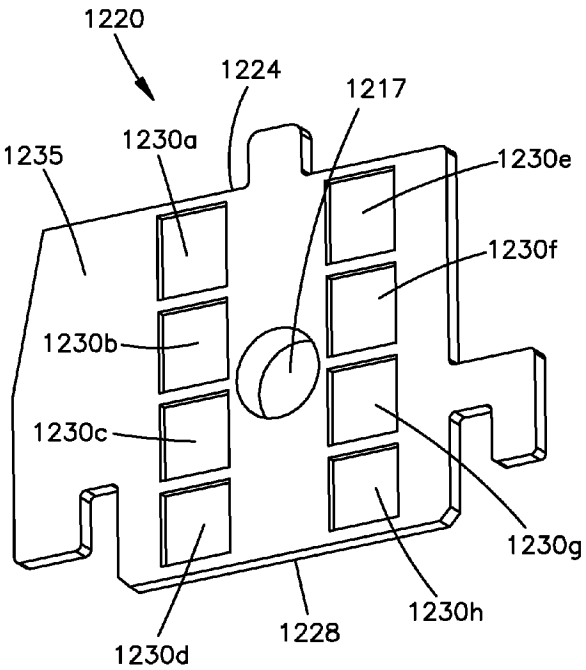
FIG. 24A is a perspective view of another exemplary embodiment of a contact.
Figure 24C:
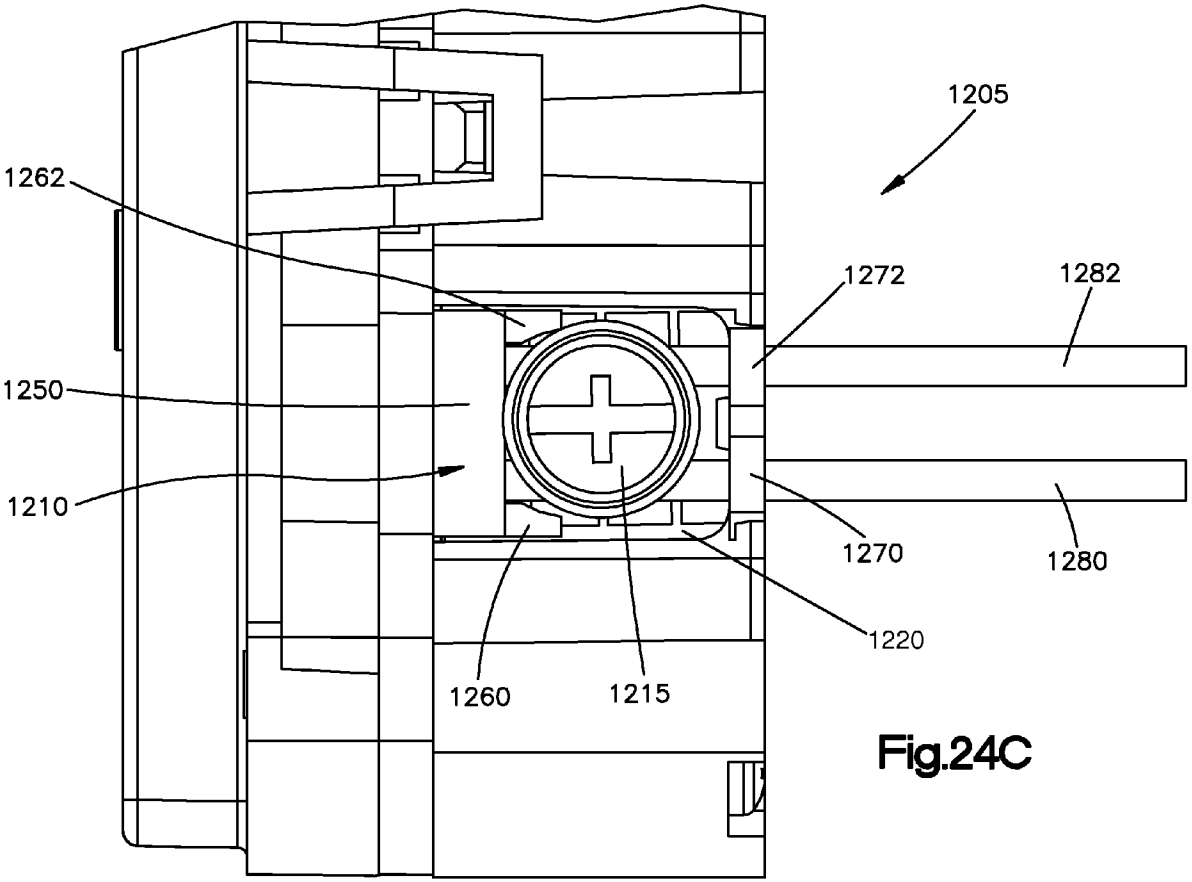
FIG. 24C is a partial side view of a wiring device including the contact of FIGS. 24A-B.

FIGS. 24A-C shows another exemplary embodiment of a contact 1220 that is substantially similar to the contact 2000, 2050 illustrated in FIGS. 15A-D and discussed above, but for the following additional features. The contact 1220 may include a first set of a plurality of indents 1230*a-d* and a second set of a plurality of indents 1230*e-h*. As shown, each indent 1230*a-h* in the first and second sets of plurality of indents is preferably generally square-shaped. The first and second sets of plurality of indents 1230*a-d*, 1230*e-h* may be positioned on a substantially planar surface 1235 of the contact 1220. Preferably, the first set of plurality of indents 1230*a-d* may be positioned on one side of the aperture 1217 formed in the contact 1220. More specifically, the first set of plurality of indents 1230*a-d* may be aligned and extend across the top surface 1235 between a first side 1224 of the contact 1220 and a second side 1228 of the contact 1220. In addition, the second set of plurality of indents 1230*e-h* may be positioned on an opposite side of the aperture 1217 than the first set of plurality of intents 1230*a-d*. More specifically, the second set of plurality of indents 1230*e-h* may be aligned and extend across the substantially planar surface 1235 between the first side 1224 of the contact 1220 and the second side 1228 and the second side of the contact 1220.

Figure 24D:
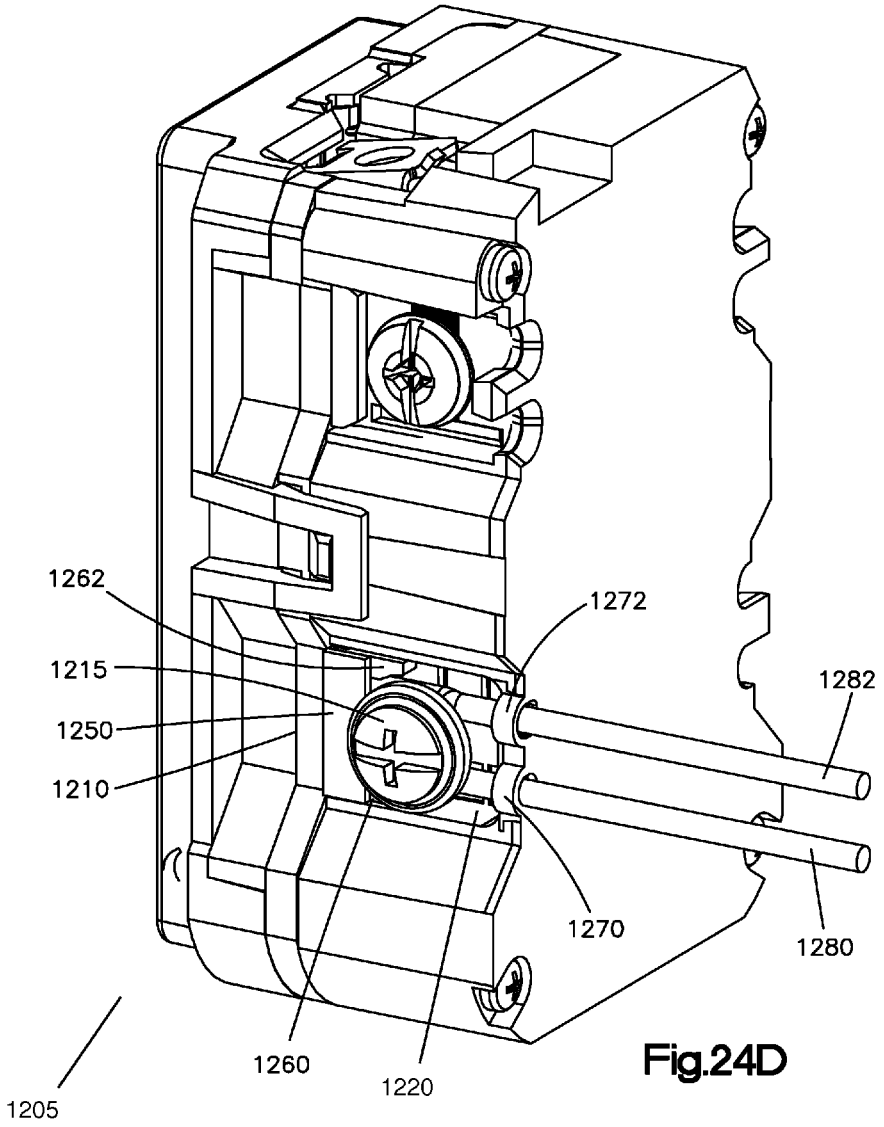
FIG. 24D is a perspective view of the wiring device of FIG. 24C.

In use, as shown in FIGS. 24C-D, the contact 960 may be used in conjunction with a wiring device 1205. The contact 1220 may be positioned in the terminal 1210. A fastener 1215 may pass through the aperture 1217 formed in the contact 1220. A first conductor 1280 may be positioned in the terminal 1210 so that a portion of the first conductor 1280 is in contact with the first set of plurality of indents 1230*a-d* of the contact 1220. A second conductor 1282 may be positioned in the terminal 1210 so that a portion of the second conductor 1282 is in contact with the second set of plurality of indents 1230*e-h* of the contact 1220. The first and second sets of plurality of indents 1230*a-d*, 1230*e-h* provide an increased surface area on the contact 1220 to contact the respective first and second conductors 1280, 1282 and provide additional friction to help engage the conductors in the terminal 1210. It should be understood that while each of the first and second sets of the plurality of indents as shown each includes four indents, one skilled in the art will understand that any number of indents may be included in a set, for example, two, three, five, etc.

In the embodiment shown in FIGS. 24C-D, the wiring device 1205 may include clasps 1270, 1272, wedges 1260, 1262, and a hood 1250 to further guide, position and secure the first and second conductors 1280, 1282 in the terminal 1210. However, alternative embodiments may not include the clasps 1270, 1272, the wedges 1260, 1262, and/or the hood 1250.

Figure 25B:
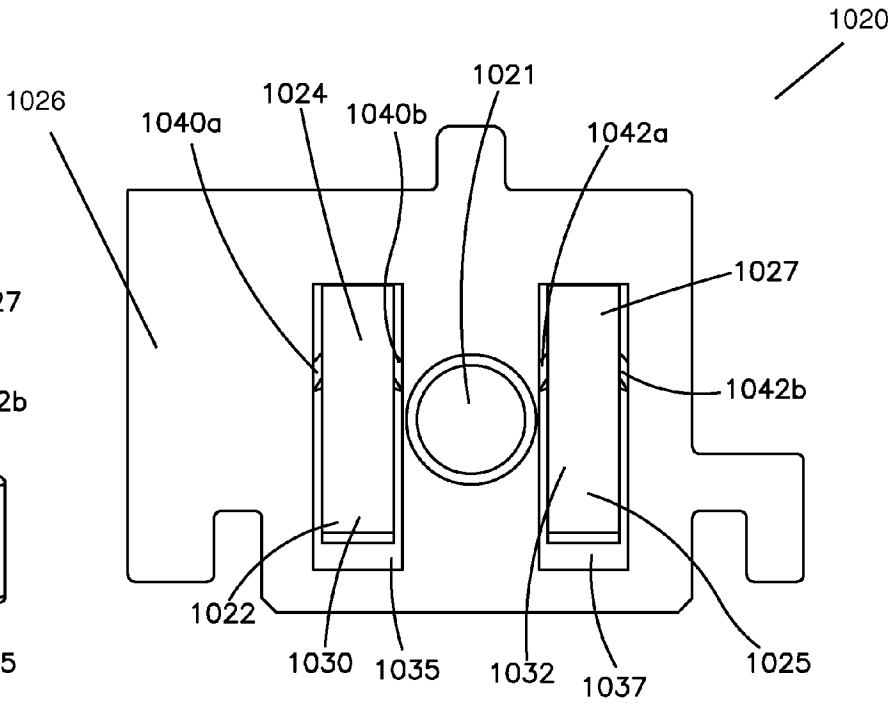
FIG. 25B is a top view of the contact of FIG. 25A.
Figure 25A:
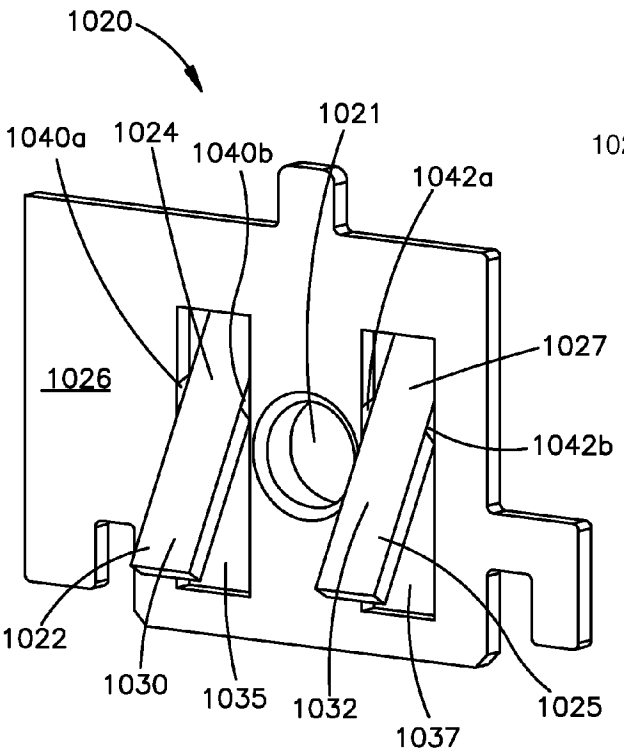
FIG. 25A is a perspective view of another exemplary embodiment of a contact.
Figure 25C:
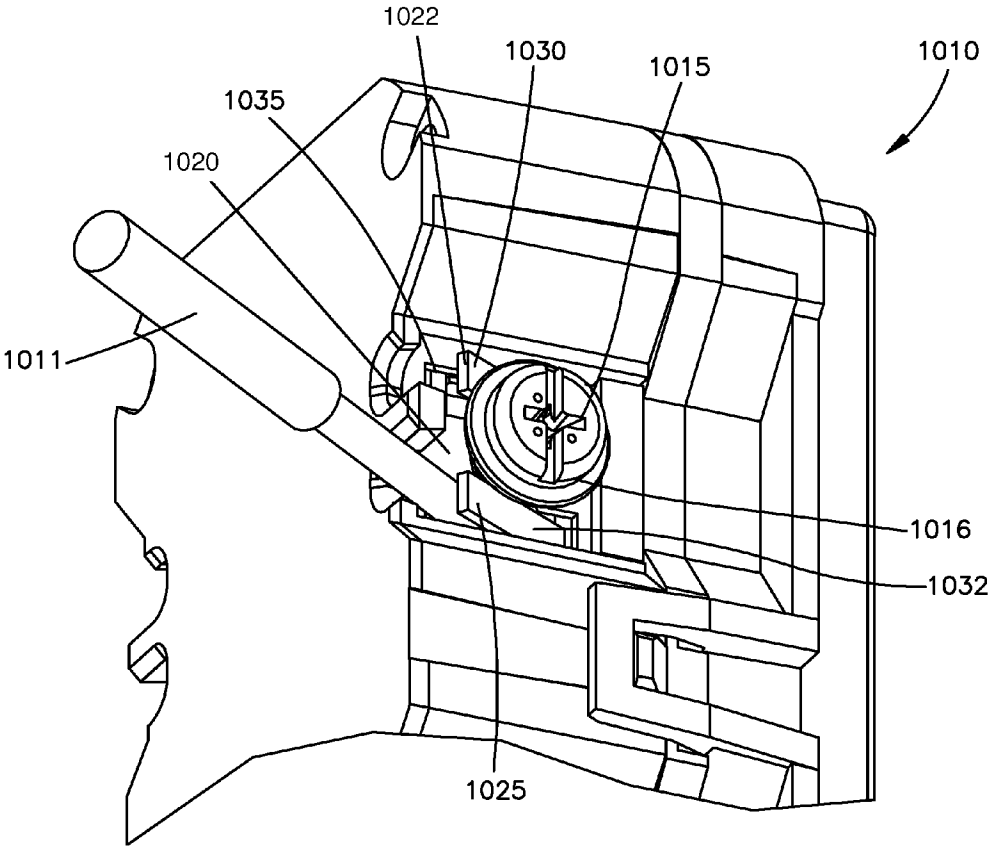
FIG. 25C is a partial perspective view of a wiring device including the contact of FIGS. 25A-B.

FIGS. 25A-C shows an exemplary embodiment of a contact 1020 that is substantially similar to the contact 2000, 2050 illustrated in FIGS. 15A-D and discussed above, but for the following additional features. The contact 1020 may include a first protrusion 1030 and a second protrusion 1032. Preferably, the first protrusion 1030 is positioned on one side of the aperture 1021 formed in the contact 1020, while the second protrusion 1032 is positioned on an opposite side of the aperture 1021 formed in the contact 1020. Preferably, the first and second protrusions 1030, 1032 are generally rectangular-shaped and a portion of each of the protrusions 1030, 1032 project from the substantially planar surface 1026 of the contact 1020 at an angle. More preferably, the contact 1020 includes first and second apertures 1035, 1037 formed there through and that substantially correspond in size and shape with the first and second protrusions 1030, 1032, respectively. In use, the first and second protrusions 1030, 1032 are located within and extend through the first and second apertures 1035, 1037, respectively, and are connected to the contact 1020 at contact points 1040, 1042. More specifically, the first protrusion 1030 is connected to the contact 1020 at contact points 1040*a*, 1040*b*, and the second protrusion 1032 is connected to the contact 1020 at contact points 1042*a*, 1042*b*. Specifically, a first end 1022 of the first protrusion 1030 may project above the substantially planar surface 1026 of the contact 1020, forming aperture 1035 in the contact, while a second end 1024 of the first protrusion 1030 may project below the substantially planar surface 1026 of the contact 1020. Similarly, a first end 1025 of a second protrusion 1032 may project above a substantially planar surface 1026 of the contact, forming aperture 1037, while a second end 1027 of the second protrusion 1032 may project below the substantially planar surface 1026 of the contact 1020.

In use, as shown in FIG. 25C, the contact 1020 may be inserted into a wiring device 1010. A fastener 1015 may pass through the aperture 1021 formed in the contact 1020. In addition, a conductor 1011 may pass through the aperture 1037 formed in the contact 1020. Another conductor (not shown) may pass through the aperture 1035 formed in the contact 1020. When the fastener 1015 is tightened in the terminal, a head 1016 of the fastener 1015 contacts and presses on a portion of the first and second protrusions 1030, 1032, and the protrusions 1030, 1032 trap and engage the conductors in the apertures 1035, 1037. It should be noted that in this embodiment, a plastic component, in lieu of a PCB component, may be positioned behind the contact so that the wiring device does not short circuit.

Figure 26B:
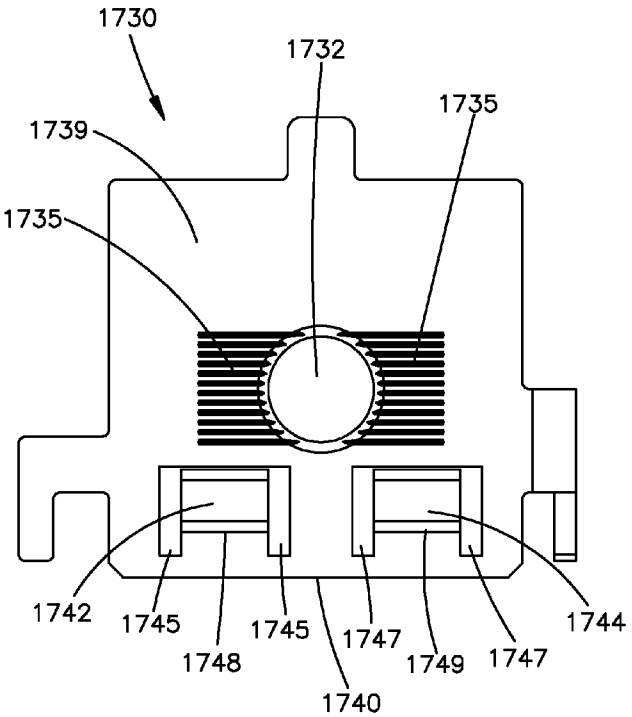
FIG. 26B is a top view of the contact of FIG. 26A.
Figure 26A:
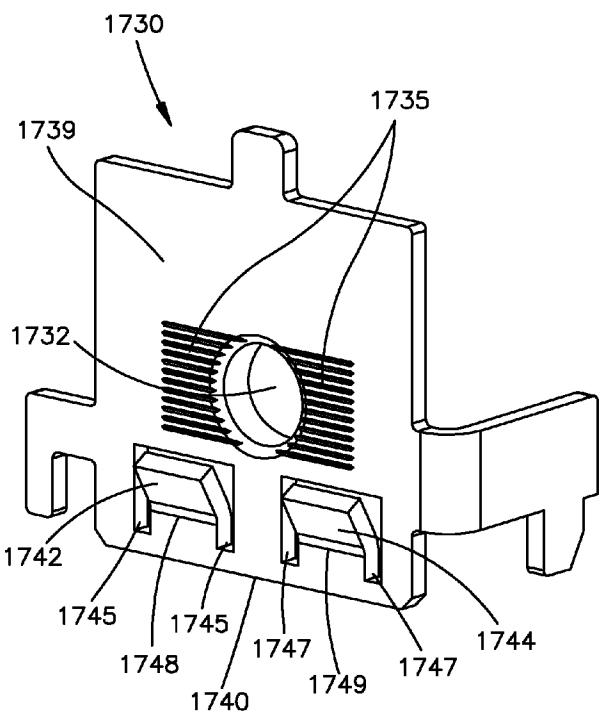
FIG. 26A is a perspective view of another exemplary embodiment of a contact.

FIGS. 26A-B shows an exemplary embodiment of a contact 1730 that is substantially similar to the contact 2000, 2050 illustrated in FIGS. 15A-D and discussed above, but for the following additional features. The contact 1730 may include a substantially planar surface 1739 and first and second protrusions 1742, 1744. The contact 1730 may also include optional plurality of ridges 1735 that extend across at least a portion of the substantially planar surface 1739. The first and second protrusions 1742, 1744 are spaced a distance apart and configured to extend upward beyond the substantially planar surface 1739 of the contact 1730. The first protrusion 1742 may include a first end 1745 and a hinge 1748. The hinge 1748 may be offset from a side 1740 of the contact 1730. Preferably, the hinge 1748 may also be offset from the first end 1745 of the first protrusion 1742. The second protrusion 1744 may include a first end 1747 and a hinge 1749. The hinge 1749 may be offset from the side 1740 of the contact 1730. Preferably, the hinge 1749 may also be offset from the first end 1747 of the second protrusion 1744. In some embodiments, the hinges 1748, 1749 may be parallel to the side 1740. The first and second protrusions 1742, 1744 may be configured to spring upward. The first and second protrusions 1742, 1744 may be more elastic and flexible than the first and second protrusions 742, 744 (see FIG. 19A-B) because the respective hinges 1748, 1749 of the first and second protrusions 1742, 1744 are offset from the respective first ends 1745, 1747. Thus, the first and second protrusions 1742, 1744 may extend further upward towards a fastener in an assembled terminal (not shown). The increase in flexibility and elasticity is particularly helpful when stranded conductors are electrically connected in the assembled terminal.

Figure 27B:
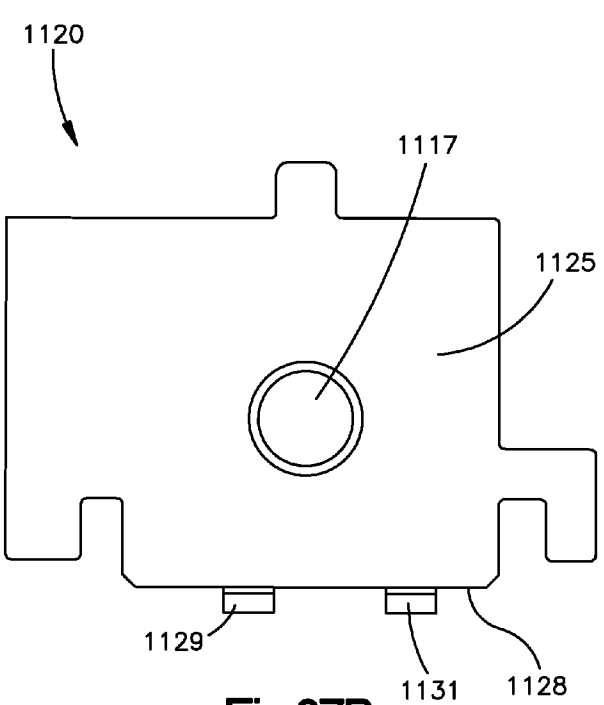
FIG. 27B is a top view of the contact of FIG. 27A.
Figure 27A:
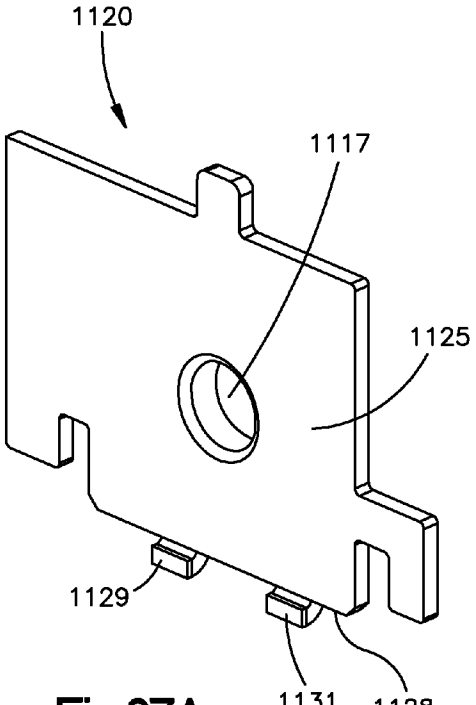
FIG. 27A is a perspective view of another exemplary embodiment of a contact.

FIGS. 27A-B shows another exemplary embodiment of a contact 1120 that is substantially similar to the contact 2000, 2050 illustrated in FIGS. 15A-D and discussed above, but for the following additional features. The contact 1120 may include first and second tabs 1129, 1131. The first and second tabs 1129, 1131 may be spaced a distance apart and may extend from a side 1128 of the contact 1120. Preferably, the first and second tabs 1129, 1131 curves extending from the side 1128 of the contact 1120 at an angle in an outward and upward direction. Preferably, the first and second tabs 1129, 1131 may be composed of a rigid material.

Figure 27C:
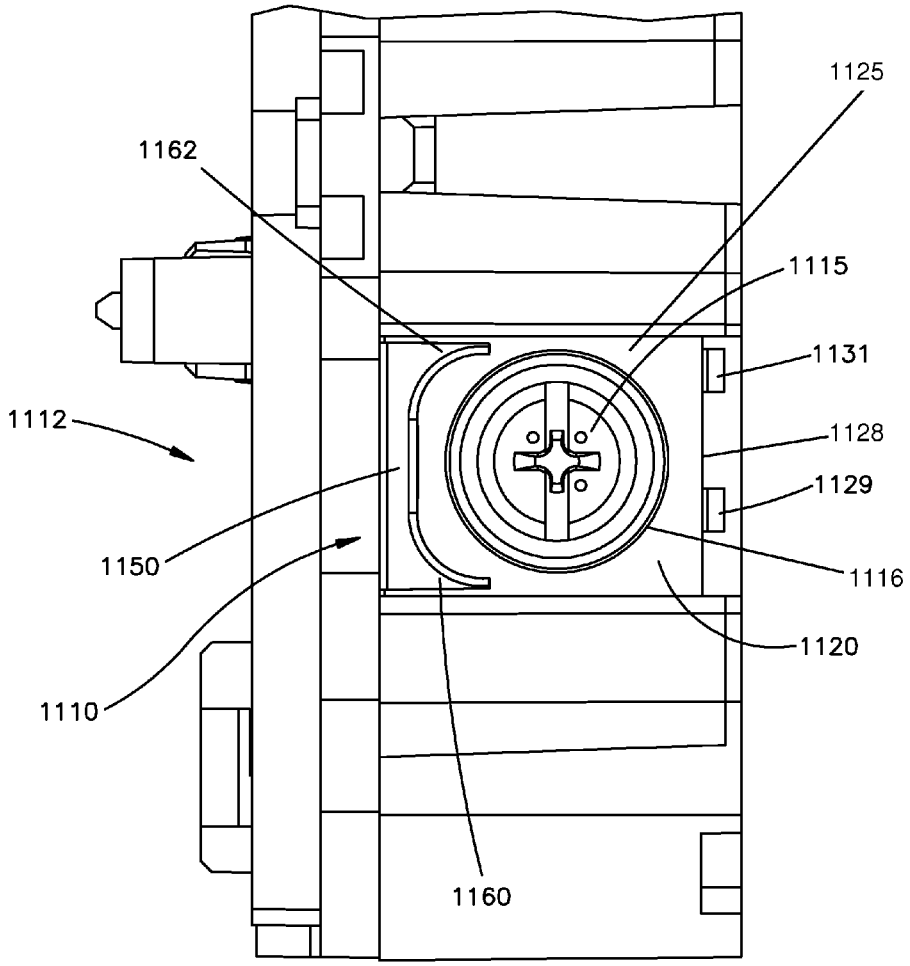
FIG. 27C is a partial side view of a wiring device including the contact of FIGS. 27A-B.

In use, as shown in FIG. 27C, the contact 1120 may be used in conjunction with a wiring device 1112. The contact 1120 may be positioned in a terminal 1110, and a fastener 1115 may pass through the aperture 1117 formed in the contact 1120. One or more conductors (not shown) may be positioned on the substantially planar surface 1125 of the contact 1120 so that a conductor may be in contact with the first tab 1129 of the contact 1120. In addition, a conductor may be in contact with the second tab 1131 of the contact 1120. The fastener 1115 may be tightened so that the one or more conductors is engaged directly between the head 1116 of the fastener 1115 and the contact 1120. As the fastener 1115 is being tightened in the terminal, the head 1116 of the fastener 1115 will push a conductor towards the first tab 1129 as well as a conductor towards the second tab 1131. The first and second tabs 1129, 1131 push the respective conductors upward, providing strain relief for the one or more conductors and preventing the one or more conductors from pulling out of the terminal 1110. The more force that the head 1116 of the fastener 1115 puts on the conductors, the more strain relief there will be. The first and second tabs 1129, 1131 may adjust according to the gauge (i.e. 10#, 12#, 14#, etc.) of the one or more conductors. In addition, the one or more conductors may be of different gauges, which may be secured in the same terminal at the same time. The respective tab will adjust according to the gauge of the respective conductor. The larger the conductor, the greater the tab on the contact will bend downward.

In addition, the terminal 1110 may include a hood 1150 having first and second curved ends 1160, 1162. The hood 1150 is configured to help guide, position and secure the conductors (not shown) in the terminal 1110. In some embodiments, the hood 1150 may not be included in the terminal.

In some embodiments, the contact 1120 may have a plurality of ridges (not shown) that extend across at least a portion of the substantially planar surface 1125 of the contact (such as the plurality of ridges 715 in FIGS. 18A-C). The optional plurality of ridges creates additional friction to help engage the one or more conductors.

Different types of conductors may be used in the embodiments disclosed, including but not limited to solid conductors, stranded conductors, and the like. The conductors may also be of different gauges, including but not limited to #10 AWG, #12 AWG, and #14 AWG. Furthermore, in the various embodiments discussed, the terminals may engage a single conductor or multiple conductors, and different wiring techniques may be used in each of these embodiments. For example, the embodiments discussed allow for back wiring, wrap wiring, side wiring, quick wiring, etc.

Some of the embodiments are discussed above in relation to a contact used in a ground terminal, and other embodiments are discussed above in relation to a contact used in a side terminal. However, it will be understood by one of ordinary skill that the features discussed above in relation to a ground terminal contact may be used in connection with a side terminal contact, and the features discussed above in relation to a side terminal contact may be used in connection with a ground terminal contact.

A method for assembling a ground terminal will now be described. To start, if necessary, one end of a conductor is stripped so that there is a bare end exposed. The bare end of the conductor is positioned on a contact as described in detail above. A fastener may pass through an aperture formed in the contact. The fastener may then be tightened so that the conductor is positioned directly between the contact and the head of the fastener. When the fastener is tightening, the conductor is pushed towards the body or shank of the fastener by one or more features of the contact, as described in detail in the various embodiments above. When the fastener is tightened, the conductor is engaged directly between the contact and the head of the fastener.

A method for assembling a terminal, including but not limited to a side terminal, will now be described. If necessary, one end of a conductor is stripped so that there is a bare end exposed. The bare end of the conductor is positioned on a contact in the terminal as described in detail above. A fastener may pass through an aperture formed in the contact. The fastener may then be tightened so that the conductor is positioned directly between the contact and the head of the fastener. When the fastener is tightening, the conductor is pushed towards the body or shank of the fastener by one or more features of the contact, as described in detail in the embodiments above. When the fastener is tightened, the conductor is engaged directly between the contact and the head of the fastener. In some embodiments, a wedge, such as wedge 255 in FIGS. 16C-D, guides and positions the conductor so that a portion of the end of the conductor is positioned underneath a hood, such as hood 258 in FIGS. 16C-D, on the terminal before the fastener is tightened.

The wiring device terminal according to the present disclosure is advantageous and meets the unfilled needs of many terminals. The terminal according to the present disclosure does not require a pressure plate, yet still traps and engages the conductor on all sides of the conductor. By eliminating the pressure plate, which is a separate component, the number of unique parts decreases. This decreases manufacturing costs and complexity, by decreasing material costs and molding costs as well as decreasing labor costs due to simplifying assembly and better allowing for production automation. Furthermore, the wiring device terminal according to the present disclosure is reusable and provides strain relief to the conductor(s). The terminal can also engage different types of conductors, including but not limited to conductors of different construction (i.e. solid, stranded, etc.), different gauges, different termination techniques, etc. The terminal of the present disclosure is capable of two-wire termination on one fastener, with conductors of the same gauge or different gauges. In addition, the wiring device terminal may be used in different types of wiring devices (i.e. switches, receptacles, GFCIs, etc.) and in different types of terminals within a wiring device, such as load or line terminals, neutral terminals, and ground terminals.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. A wiring device terminal for receiving a conductor, the terminal comprising:
   a. a contact comprising:
      i. a substantially planar surface having an aperture formed therethrough; and
      ii. at least one tab extending from an exposed side of the contact, the at least one tab arranged and configured to engage the conductor; and
   b. a fastener adapted and configured to pass through the aperture and selectively and securingly engage the conductor;
   wherein when the conductor is inserted into the terminal it is secured directly between the contact and the fastener and is engaged by the at least one tab providing strain relief for the conductor.

2. The terminal of claim 1, wherein the at least one tab extends from the exposed side of the contact in a generally perpendicular direction.

3. The terminal of claim 1, wherein the terminal is one selected from the group consisting of a ground terminal, a line terminal, a load terminal, or a neutral terminal.

4. The terminal of claim 1, wherein the contact is integral with and extending from a mounting strap.

5. The tenninal of claim 1, wherein the contact further comprises a plurality of ridges extending across at least a portion of the substantially planar surface of the contact, wherein the plurality of ridges provide friction between the contact and the conductor.

6. The terminal of claim 1, wherein the contact further comprises a protrusion extending from the substantially planar surface of the contact, the protrusion arranged and configured to position the conductor under the fastener when the conductor is compressed between the contact and the fastener.

7. The terminal of claim 1, wherein the fastener is one selected from the group consisting of a serrated head fastener or a washer head fastener.

8. The terminal of claim 1, wherein the tab comprises a notch to receive the conductor.

9. The terminal of claim 1, wherein the tab comprises a first end and a second end, wherein the first end extends higher than the second end.

10. The terminal of claim 8, wherein the notch comprises a plurality of surfaces that contact the conductor, wherein at least one of the plurality of surfaces position the conductor underneath the fastener and at least one of the plurality of surfaces bends the conductor to provide strain relief for the conductor.

11. The terminal of claim 1, wherein the contact further comprises a cut out formed therethrough, wherein the cut out is arranged and configured to position an end of the conductor therein and to secure the conductor while the conductor is being assembled in the terminal.

12. The terminal of claim 11, wherein the at least one tab comprises first and second protrusions spaced a distance apart.

13. The terminal of claim 1, wherein the fastener further comprises a head and a body, wherein the body is adapted and configured to pass through the aperture formed in the contact, and wherein the head includes a bottom surface that is adapted and configured for selectively and securingly engaging the conductor.

14. A wiring device terminal for receiving a conductor, the terminal comprising:

a. a contact comprising:

i. a substantially planar surface having an aperture formed therethrough; and ii. at least one protrusion extending from the substantially planar surface, the at least one protrusion arranged and configured to engage the conductor; and b. a fastener adapted and configured to pass through the aperture and selectively and securingly engage the conductor;

wherein when the conductor is inserted into the terminal it is secured directly between the contact and the fastener and is engaged by the at least one protrusion providing strain relief for the conductor.

15. The terminal of claim 14, wherein the terminal is one selected from the group consisting of a ground terminal, a line terminal, a load terminal, or a neutral terminal.

16. The terminal of claim 14, wherein the contact is integral with and extending from a mounting strap.

17. The terminal of claim 14, wherein the at least one protrusion comprises a living hinge.

18. The terminal of claim 14, wherein the at least one protrusion comprises first and second protrusions spaced a distance apart.

19. The terminal of claim 14, wherein the contact further comprises a plurality of ridges extending across at least a portion of the substantially planar surface of the contact, wherein the plurality of ridges provide friction between the contact and the conductor.

20. The terminal of claim 14, wherein the at least one protrusion comprises first and second L-shaped protrusions, the first and second protrusions each having a first end that is flush with an exposed side of the contact and a second end having a living hinge arranged and configured on an inner portion of the contact, wherein the first protrusion is arranged and configured on one side of the aperture and the second protrusion is a mirror image of the first protrusion and arranged and configured on an opposite side of the aperture.

21. The terminal of claim 14, wherein the at least one protrusion is substantially U-shape and arranged and configured to partially surround the aperture.

22. The terminal of claim 14, wherein the fastener is one selected from the group consisting of a serrated head fastener or a washer head fastener.

23. The terminal of claim 14, wherein the fastener further comprises a head and a body, wherein the body is adapted and configured to pass through the aperture formed in the contact, and wherein the head includes a bottom surface that is adapted and configured for selectively and securingly engaging the conductor.

24. The terminal of claim 14, wherein the contact comprises a plurality of protrusions, and wherein each of the plurality of protrusions includes a curved portion to engage the respective conductors.

25. The terminal of claim 24, wherein the contact further comprises a plurality of ridges, the plurality of ridges extending across at least a portion of the substantially planar surface of the contact between the plurality of protrusions and the aperture, wherein the plurality of ridges provide friction between the contact and the conductor.

26. The terminal of claim 24, wherein each of the plurality of protrusions include a curved portion to engage the respective conductors.

27. A wiring device terminal for receiving a conductor, the terminal comprising:

a. a contact comprising:

i. a substantially planar surface having an aperture formed therethrough; and ii. a plurality of indents, the plurality of indents arranged and configured around the aperture so that a first set of the plurality of indents is positioned on one side of the aperture and a second set of the plurality of indents is positioned on an opposite side of the aperture; and b. a fastener adapted and configured to pass through the aperture and selectively and securingly engage the conductor;

wherein the conductor may be engaged in the terminal directly between the contact and the fastener, and wherein the plurality of indents provide friction between the contact and the conductor.

28. The terminal of claim 27, wherein the fastener is one selected from the group consisting of a serrated head fastener or a washer head fastener.

29. The terminal of claim 27, wherein the fastener further comprises a head and a body, wherein the body is adapted and configured to pass through the aperture formed in the contact, and wherein the head includes a bottom surface that is adapted and configured for selectively and securingly engaging the conductor.

30. A wiring device terminal for receiving a conductor, the terminal comprising:

a. a contact comprising:

i. a substantially planar surface having an aperture formed therethrough; and ii. at least one protrusion extending from the substantially planar surface, the at least one protrusion arranged and configured to engage the conductor; and b. a fastener adapted and configured to pass through the aperture and selectively and securingly engage the conductor;

wherein the conductor may be engaged in the terminal directly between the contact and the fastener, and wherein the at least one protrusion provides strain relief for the conductor, and wherein the at least one protrusion comprises first and second L-shaped protrusions, the first and second protrusions each having a first end that is flush with an exposed side of the contact and a second end having a living hinge arranged and configured on an inner portion of the contact, wherein the first protrusion is arranged and configured on one side of the aperture and the second protrusion is a mirror image of the first protrusion and arranged and configured on an opposite side of the aperture.

31. A wiring device terminal for receiving a conductor, the terminal comprising:

a. a contact comprising:

i. a substantially planar surface having an aperture formed therethrough; and ii. a plurality of ridges, the plurality of ridges arranged and configured around the aperture so that a first set of the plurality of ridges is positioned on one side of the aperture and a second set of the plurality of ridges is positioned on an opposite side of the aperture; and b. a fastener adapted and configured to pass through the aperture and selectively and securingly engage the conductor;

wherein the conductor may be engaged in the terminal directly between the contact and the fastener, and wherein the plurality of ridges provide friction between the contact and the conductor.

32. The terminal of claim 31, wherein the fastener is one selected from the group consisting of a serrated head fastener or a washer head fastener.

33. The terminal of claim 31, wherein the fastener further comprises a head and a body, wherein the body is adapted and configured to pass through the aperture formed in the contact, and wherein the head includes a bottom surface that is adapted and configured for selectively and securingly engaging the conductor.

* * * * *